US008064810B2

(12) United States Patent
Okumura et al.

(10) Patent No.: US 8,064,810 B2
(45) Date of Patent: Nov. 22, 2011

(54) IMAGE FORMING APPARATUS WITH IMAGE BEARING MEMBER ADJUSTMENT

(75) Inventors: Ichiro Okumura, Abiko (JP); Makoto Shihoh, Yokohama (JP); Yasushi Murayama, Tokyo (JP); Kosuke Fujimoto, Kawasaki (JP); Isao Hayashi, Kawasaki (JP); Yoshihiro Shigemura, Yokohama (JP); Katsumasa Nishikawa, Tokyo (JP); Masaaki Naoi, Yokosuka (JP); Shinji Yamamoto, Yokohama (JP); Hiroshi Ito, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 485 days.

(21) Appl. No.: 12/265,353

(22) Filed: Nov. 5, 2008

(65) Prior Publication Data

US 2009/0123197 A1 May 14, 2009

(30) Foreign Application Priority Data

Nov. 9, 2007 (JP) ..... 2007-292017
Sep. 16, 2008 (JP) ..... 2008-236582

(51) Int. Cl.
*G03G 15/01* (2006.01)

(52) U.S. Cl. ..... 399/301; 347/116; 399/394

(58) Field of Classification Search ..... 399/301, 399/394, 395, 396, 165; 347/116
See application file for complete search history.

(56) References Cited

U.S. PATENT DOCUMENTS 4,615,612 A 10/1986 Ohno et al. ..... 399/227
(Continued)

FOREIGN PATENT DOCUMENTS

EP 0 291 738 A1 11/1988
(Continued)

OTHER PUBLICATIONS

European Search Report dated Feb. 25, 2009, in counterpart European Application No. 08168482.1-2209.

(Continued)

*Primary Examiner* — Sophia S Chen
(74) *Attorney, Agent, or Firm* — Fitzpatrick, Cella, Harper & Scinto

(57) ABSTRACT

An image forming apparatus includes first and second image bearing members on which toner images are to be formed, a conveying member, and a conveying member position index detecting device for detecting a conveying member position index provided on the conveying member. The apparatus also includes an image bearing member position index detecting device for detecting image bearing member position indices provided on the second image bearing member, an adjusting device for adjusting a rotational speed of the second image bearing member, and a controller for controlling the adjusting device so as to adjust a position of an image bearing member position index correspondingly to the conveying member position index, on the basis of detection results of the conveying member position index detecting device and the image bearing member position index detecting device.

10 Claims, 42 Drawing Sheets

U.S. PATENT DOCUMENTS

| | | | | |
|---|---|---|---|---|
| 4,903,067 | A | 2/1990 | Murayama et al. | 347/129 |
| 5,160,946 | A | 11/1992 | Hwang | 347/116 |
| 5,983,043 | A | 11/1999 | Ohwaki et al. | 399/48 |
| 7,057,163 | B2 | 6/2006 | Chee | 250/231.16 |
| 7,238,932 | B2 | 7/2007 | Chee | 250/231.16 |
| 7,457,554 | B2 | 11/2008 | Matsuda et al. | 399/50 |
| 2003/0052957 | A1 * | 3/2003 | Yamada et al. | 347/116 |
| 2003/0052959 | A1 * | 3/2003 | Fujimoto | 347/116 |
| 2006/0222418 | A1 * | 10/2006 | Ebara et al. | 399/301 |
| 2007/0172257 | A1 | 7/2007 | Matsuda et al. | 399/167 |
| 2007/0242986 | A1 * | 10/2007 | Matsuyama et al. | 399/301 |
| 2008/0232854 | A1 | 9/2008 | Matsuda et al. | 399/176 |

FOREIGN PATENT DOCUMENTS

| | | | |
|---|---|---|---|
| JP | 64-6981 | A | 1/1989 |
| JP | 5-241457 | A | 9/1993 |
| JP | 11-183542 | A | 7/1999 |
| JP | 2004-29019 | A | 1/2004 |
| JP | 2004-145077 | A | 5/2004 |
| JP | 2005-239381 | A * | 9/2005 |

OTHER PUBLICATIONS

Communication pursuant to Article 94(3) EPC, dated Sep. 22, 2011, in European Application No. 08168482.1-2209.

* cited by examiner

IMAGE FORMING APPARATUS WITH IMAGE BEARING MEMBER ADJUSTMENT

FIELD OF THE INVENTION AND RELATED ART

The present invention relates to an image forming apparatus for forming a mixed color image by superposing a second color toner image on a first color toner image. Specifically, the present invention relates to control for enhancing accuracy of superposition between the first color toner image and the second color toner image.

A tandem-type image forming apparatus for forming a full-color image by disposing a plurality of image bearing members (photosensitive drums, photosensitive belts, etc.) different in development color along a conveying member (an intermediary transfer belt, a recording material conveying belt, etc.) has been put into practical use. In the tandem-type image forming apparatus, toner images are formed by the plurality of image bearing members in parallel with each other with shifted timings and are transferred in a superposition matter, so that the number of sheets subjected to image formation is large. As a result, it is possible to realize high productivity.

However, in the tandem-type image forming apparatus, an amount of deviation among the toner images due to an error in toner image forming timing in the plurality of image bearing members is liable to increase, so that color deviation or color non-uniformity is conspicuous at a minute portion of a high-definition full-color image in some cases.

Japanese Laid-Open Patent Application (JP-A) Sho 64-6981 discloses an image forming apparatus in which toner images for control (registration indices) transferred from a plurality of photosensitive drums to an intermediary transfer belt are detected on the intermediary transfer belt and exposure start timing for each of the plurality of photosensitive drums is adjusted. Each of the toner images for control is formed in a shape of a cross by crossing a line with respect to a movement direction of the intermediary transfer belt and a line with respect to a width direction of the intermediary transfer belt, at right angles. Then, on the basis of a detection result of the width direction line, writing start timing of an electrostatic image with respect to a rotational direction of an image bearing member is adjusted, and on the basis of direction results of the movement direction line, writing start timing of the electrostatic image with respect to a rotational axis direction of the image bearing member is adjusted.

JP-A Hei 5-241457 discloses an image forming apparatus in which a toner image for control (registration index) transferred from an upstream-side photosensitive drum to an intermediary transfer belt is detected on the intermediary transfer belt to adjust exposure start timing for a downstream-side photosensitive drum. With timing such that a leading end of a first color toner image transferred to the intermediary transfer belt reaches a secondary transfer portion of the downstream-side photosensitive drum, the downstream-side photosensitive drum rotates substantially halfway around its rotational axis, so that a leading end of a second color toner image on the downstream-side photosensitive drum reaches the secondary transfer portion.

JP-A 2004-145077 discloses a constitution in which position indices are written on each of a photosensitive member and an intermediary transfer member and are detected to detect a speed difference between the photosensitive member and the intermediary transfer member and then on the basis of information on this speed difference, deviation between an image on the photosensitive member and an image on the intermediary transfer belt is corrected. Further, in order to correct the deviation, a constitution for changing a rotational speed of the photosensitive member is described.

In the tandem-type image forming apparatus, when there is a speed difference between the intermediary transfer member and the image bearing member, a superposition error of a second color toner image formed on a second image bearing member with respect to a first color toner image transferred from a first image bearing member to the intermediary transfer member occurs. The second color toner image is one of toner images for second color, third color, fourth color, fifth color, and so on which are to be positioned on or over the first color toner image first transferred onto the intermediary transfer member.

In JP-A Sho 64-6981 and JP-A Hei 5-241457, exposure timing can be adjusted so as to cancel a superposition error, between the first color toner image and the second color toner image, which has occurred before the writing of the electrostatic image is started. However, a superposition error, between the first color toner image and the second color toner image, which has occurred in a period from the start of the writing of the electrostatic image until the toner image reaches a transfer portion cannot be removed.

The control described in JP-A Sho 64-6981 cannot remove a superposition error, between the first color toner image and the second color toner image, which has occurred after writing start timing of the electrostatic image on the first image bearing member is adjusted by detecting the toner image for control.

The control described in JP-A Hei 5-241457 can remove a superposition error, between the first color toner image and the second color toner image, which has occurred in a period from transfer, to the intermediary transfer member at a first transfer portion, of the toner image for control which was formed on the first image bearing member until the transferred toner image for control is detected. However, the control cannot remove a superposition error, between the first color toner image and the second color toner image, which has occurred in a period from adjustment of writing start timing of the electrostatic image on the second image bearing member by detecting the toner image for control until the first color toner image and the second color toner image reach the secondary transfer portion.

Therefore, JP-A Sho 64-6981 and JP-A Hei 5-241457 cannot handle a superposition error, between the first color toner image and the second color toner image, due to rotation non-uniformity or speed fluctuation in a period equal to or shorter than a rotation period of the image bearing member.

However, with respect to the image bearing member, short-period speed fluctuation due to eccentricity or load variation of the image bearing member always occurs, and with respect to the intermediary transfer member, short-period speed fluctuation due to thickness variation of the intermediary transfer member and eccentricity or load variation of a driving roller always occurs with an amplitude more than that in the case of the image bearing member. Further, the speed fluctuation of the image bearing member and the speed fluctuation of the intermediary transfer member periodically provide opposite phases (phase advance and phase delay), so that there is a possibility of a periodical occurrence of speed difference at a significant level.

In other words, if a large-size image forming apparatus in which the amplitude of the speed fluctuation is suppressed by and the period of the speed fluctuation is prolonged by using an image bearing member and a driving roller which are increased in diameter and weight is used, the control described in JP-A Sho 64-6981 and the control described in JP-A Hei 5-241457 function effectively.

However, when an image forming apparatus is intended to be downsized by using an image bearing member and a driving roller which are reduced in diameter and weight, the short period speed fluctuation is liable to occur with respect to both of the image bearing member and the driving roller, so that the superposition error between the first toner image and the second toner image is not allowable.

When an experiment was conducted by using a downsized trial model, it was found that such a superposition error reaches a level corresponding to 5 scanning lines (200 μm) at the worst.

In the case of the constitution of JP-A 2004-145077, the information on the positional deviation in the neighborhood of the transfer portion is detected and corrected, so that the above-described problems can be solved. However, in the constitution of JP-A 2004-145077, a speed of the photosensitive member is changed when the positional deviation is prevented, so that the following problem was caused to occur in some cases. When the speed of the photosensitive member is changed for correcting the positional deviation, a position index and a spacing between images with respect to a sub-scan direction at the time of the change are changed. For example, in the case where the speed of the photosensitive member is increased, the spacing is increased, and in the case where the speed of the photosensitive member is decreased, the spacing is decreased. Therefore, there is a possibility that the deviation correcting operation once performed adversely affects subsequent deviation correcting operations. Accordingly, it was found that there is no problem when the increase in photosensitive member speed and the decrease in photosensitive member speed occur randomly but a correction amount is only increased continuously in some cases to exceed a maximum value of a positional correction amount to result in a possibility of failure in sufficient correction control.

SUMMARY OF THE INVENTION

A principal object of the present invention is to provide an image forming apparatus, in which stable correction control is effected, capable of accurately superposing toner images at a transfer portion while following even a short-period speed fluctuation of each of an image bearing member and an intermediary transfer member.

According to an aspect of the present invention, there is provided an image forming apparatus comprising:

- a first image bearing member on which a toner image is to be formed;
- a second image bearing member on which a toner image is to be formed;
- a conveying member for carrying and conveying the toner images;
- a first transferring device for transferring the toner image on the first image bearing member onto the conveying member at a first transfer portion;
- a second transferring device for transferring the toner image on the second image bearing member onto the conveying member at a second transfer portion located downstream of the first transfer portion with respect to a movement direction of the conveying member;
- a conveying member position index provided on the conveying member along the movement direction of the conveying member;
- image bearing member position indices provided on the second image bearing member along a rotational direction of the second image bearing member;
- a conveying member position index detecting device for detecting the conveying member position index;
- an image bearing member position index detecting device for detecting the image bearing member position indices;
- an adjusting device for adjusting a rotational speed of the second image bearing member or a position of the second image bearing member with respect to the movement direction of the conveying member;
- a controller for controlling the adjusting device so as to adjust a position of an image bearing member position index correspondingly to the conveying member position index which is going to reach the second transfer portion, on the basis of detection results of the conveying member position index detecting device and the image bearing member position index detecting device; and
- an initializing portion for performing an initializing operation of the adjusting device when an amount of deviation between the conveying member position index and the corresponding image bearing member position index exceeds a predetermined value in terms of an absolute value.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
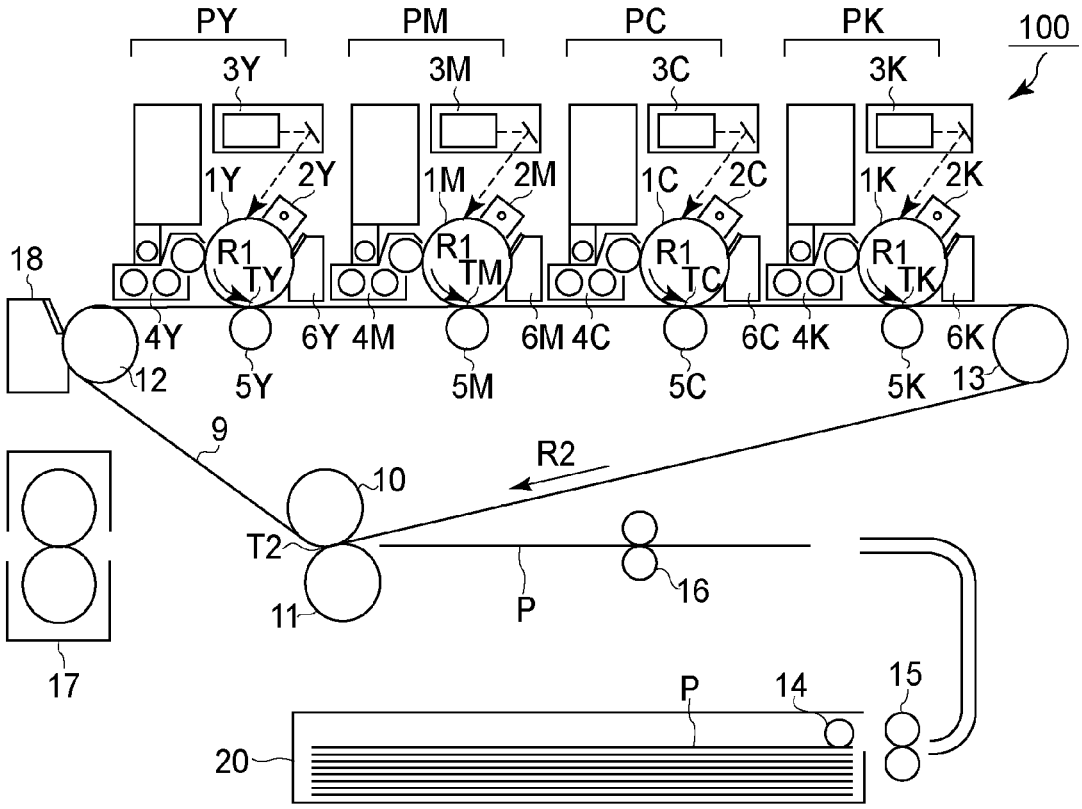
FIG. 1 is a schematic view for illustrating a constitution of an image forming apparatus of First Embodiment.

Hereinbelow, embodiments of the present invention will be described in detail with a reference to the drawings. The present invention is also applicable to other embodiments in which a part or all of constitutions of the respective embodiments are replaced with alternative constitutions so long as a formed first toner image and a formed second toner image are moved relative to each other in a movement direction to be disposed in a superposition manner.

Therefore, the present invention can also be carried out in not only an image forming apparatus using an intermediary transfer member but also an image forming apparatus for transferring a toner image onto a recording material carried on a recording material conveying member. Further, it is also possible to carry out the present invention in not only a tandem type image forming apparatus in which a plurality of image bearing members are arranged along the intermediary transfer member or the recording material conveying member but also a drum type image forming apparatus for forming toner images of plural colors on a single image bearing member.

In this embodiment, only principal portion regarding formation/transfer of the toner images will be described but the present invention can be carried out in various uses such as a printer, various printing machines, a copying machine, a facsimile machine, and a multi-function machine by adding necessary device, equipment and housing structure.

Incidentally, a general matter of the image forming apparatus described in JP-A Sho 64-6981 and JP-A Hei 5-241457 will be omitted from illustration and redundant explanation. In the following description, constituent members recited in the claims are merely shown in parentheses for the purpose of understanding the present invention and therefore it should be understood that the members are not intended to be limited to corresponding specific members or the like followed by reference numerals or symbols in the respective embodiments.

In the respective embodiments, a first position index 221, a second position index 222 and a conveying member position index 251 are different in pattern shape, forming position, material, recording/regeneration method in some cases but these position indices are represented by common reference numerals and omitted from redundant explanation.

Similarly, writing devices 31Y and 34 and readers (reading devices) 32Y, 32M, 32C, 32K, 35M, 35C and 35K are different in detecting constitution but these devices are represented by common reference symbols and omitted from redundant explanation.

First Embodiment

Figure 2:
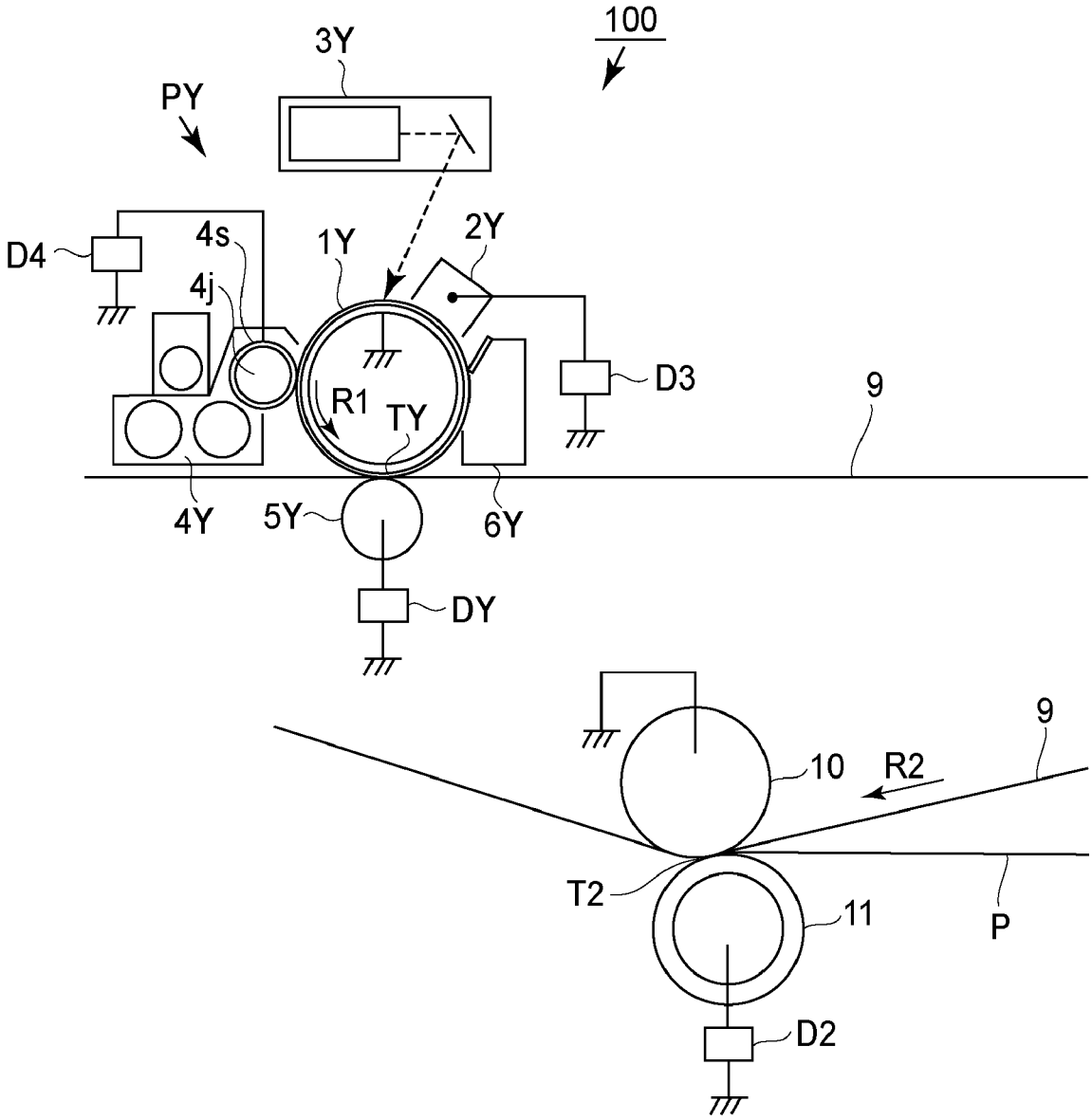
FIG. 2 is a schematic view for illustrating a constitution of a primary transfer portion and a secondary transfer portion.

FIG. 1 is a schematic view for illustrating a constitution of an image forming apparatus of First Embodiment and FIG. 2 is a schematic view for illustrating a constitution of a primary transfer portion and a secondary transfer portion.

As shown in FIG. 1, an image forming apparatus 100 of First Embodiment is a full-color laser beam printer in which image forming stations PY, PM, PC and PK for yellow, cyan, magenta and black are disposed along an intermediary transfer belt 9.

At the image forming station PY, a yellow toner image is formed on a photosensitive drum 1Y (first image bearing member) and is carried and conveyed by the photosensitive drum 1Y and thereafter at a first transfer portion TY, the yellow toner image is primary-transferred onto the intermediary transfer belt (conveying member) 9 by a first transfer device 5Y. At the image forming station PM, a magenta toner image is formed on a photosensitive drum 1M (second image bearing member) and is carried and conveyed by the photosensitive drum 1M and thereafter at a second transfer portion TM, the magenta toner image is primary-transferred onto the intermediary transfer belt 9 by a second transfer device 5M. The second transfer portion TM is located downstream of the first transfer portion TY with respect to a movement direction of the intermediary transfer member (conveying member). At image forming stations PC and PK, a cyan toner image and a black toner image are formed on a photosensitive drum 1C and a photosensitive drum 1K, respectively, and are similarly transferred onto the intermediary transfer belt 9 in a superposition manner.

The intermediary transfer belt 9 as an example of the conveying member is extended around and supported by a driving roller 13, a tension roller 12 and a back-up roller 10 and is rotated in a direction of an arrow R2.

The four color toner images carried on the intermediary transfer belt 9 are conveyed to a secondary transfer portion T2, at which the toner images are secondary-transferred collectively onto a recording material P. The recording material P is drawn from a sheet feeding cassette 20 by a sheet feeding roller 14 and separated one by one by a separating device 15 to be fed to registration rollers 16.

The registration rollers 16 feeds the recording material P to the secondary transfer portion T2 so that a leading end of the recording material P coincides with the toner images on the intermediary transfer belt 9.

The recording material P onto which the four color toner images are secondary-transferred is delivered to a fixing device 17 and is subjected to heat pressing, so that a full-color image is fixed on a surface of the recording material P.

An intermediary transfer belt cleaning device 18 removes transfer residual toner which passed through a secondary transfer portion T2 and remains on the intermediary transfer belt 9.

The image forming stations PY, PM, PC and PK are constituted similar to each other except that the colors of toners used in developing devices 4Y, 4M, 4C and 4K provided in the image forming stations are yellow, magenta, cyan and black, i.e., different from each other.

Therefore, in the following, only the image forming station PY for yellow will be described and other image forming stations PM, PC and PK should be understood that constituent members thereof are collectively described by replacing the suffix Y of reference numerals for associated constituent members with C, M and K.

As shown in FIG. 2, at the image forming station PY, a charging device 2Y, an exposure device 3Y, a developing device 4Y, a primary transfer roller 5Y and a cleaning device 6Y are disposed around the photosensitive drum 1Y. Correspondingly, the remaining image forming stations PM, PC and PK include respective charging devices 2M, 2C and 2K, exposure devices 3M, 3C and 3K, developing devices 4M, 4C and 4K, primary transfer rollers 5M, 5C and 5K, and cleaning devices 6M, 6C and 6K, as shown in FIG. 1.

The photosensitive drum 1Y as an example of the first image bearing member is constituted by applying an organic photoconductor (OPC) layer having a negative charge polarity onto an outer peripheral surface of an aluminum cylinder and is rotated in a direction of an arrow R1.

The charging device 2Y electrically charges the surface of the photosensitive drum 1Y to a uniform negative potential by being supplied with a negative voltage from a power source D3 to emit charging particles to the surface of the photosensitive drum 1Y.

The exposure device 3Y as an example of first electrostatic image forming means scans the surface of the photosensitive drum 1Y, through a rotatable mirror, with a laser beam obtained by ON-OFF modulation of scanning line image data expanded from a color-separated yellow component image. By this scanning, an electrostatic image is written (formed) on the surface of the charged photosensitive drum 1Y with a resolution of 600 dpi (dot/inch).

The developing device 4Y as an example of first developing means electrically charges toner to a negative polarity by stirring two component developer comprising a mixture of the toner and a magnetic carrier. The charged toner is carried in an erected chain state on a developing sleeve 4*s* rotating around a fixed magnetic pole 4*j* in a direction counter to the rotation of the photosensitive drum 1Y, thus rubbing the photosensitive drum 1Y.

A power source D4 applies a developing voltage in the form of a negative DC voltage biased with an AC to the developing sleeve 4*s*, so that the toner is deposited on the electrostatic image, on the photosensitive drum 1Y, which is positive in polarity relative to the developing sleeve 4*s* to reversely develop the electrostatic image.

The primary transfer roller 5Y nips the intermediary transfer belt 9 between it and the photosensitive drum 1Y to form a primary transfer portion TY as an example of the first transfer portion between the photosensitive drum 1Y and the intermediary transfer belt 9.

A power source DY applies a positive DC voltage to the primary transfer roller 5 to transfer the negatively charged toner carried on the photosensitive drum 1Y onto the intermediary transfer belt 9 passing through the primary transfer portion TY.

The cleaning device 6Y rubs the photosensitive drum lY with a cleaning blade to remove the transfer residual toner which passed through the primary transfer portion TY and remains on the surface of the photosensitive drum 1Y.

A secondary transfer roller 11 presses the intermediary transfer belt 9 against the back-up roller 10 to form the secondary transfer portion T2 between the intermediary transfer belt 9 and the secondary transfer roller 11.

At the secondary transfer portion T2, the toner images are secondary-transferred from the intermediary transfer belt 9 onto the recording material P in a process in which the recording material P is nipped and conveyed in superposition with the toner images on the intermediary transfer belt 9 and passes through the secondary transfer portion T2.

A power source D2 applies a positive DC voltage to the secondary transfer roller 11 to pass a transfer current through a series circuit formed by the back-up roller 10, the intermediary transfer belt 9, the recording material P, and the secondary transfer roller 11. A part of the transfer current passes through a toner coverage portion of the intermediary transfer belt 9 to take part in movement of the toner from the intermediary transfer belt 9 to the recording material P.

Embodiment 1

Figure 3:
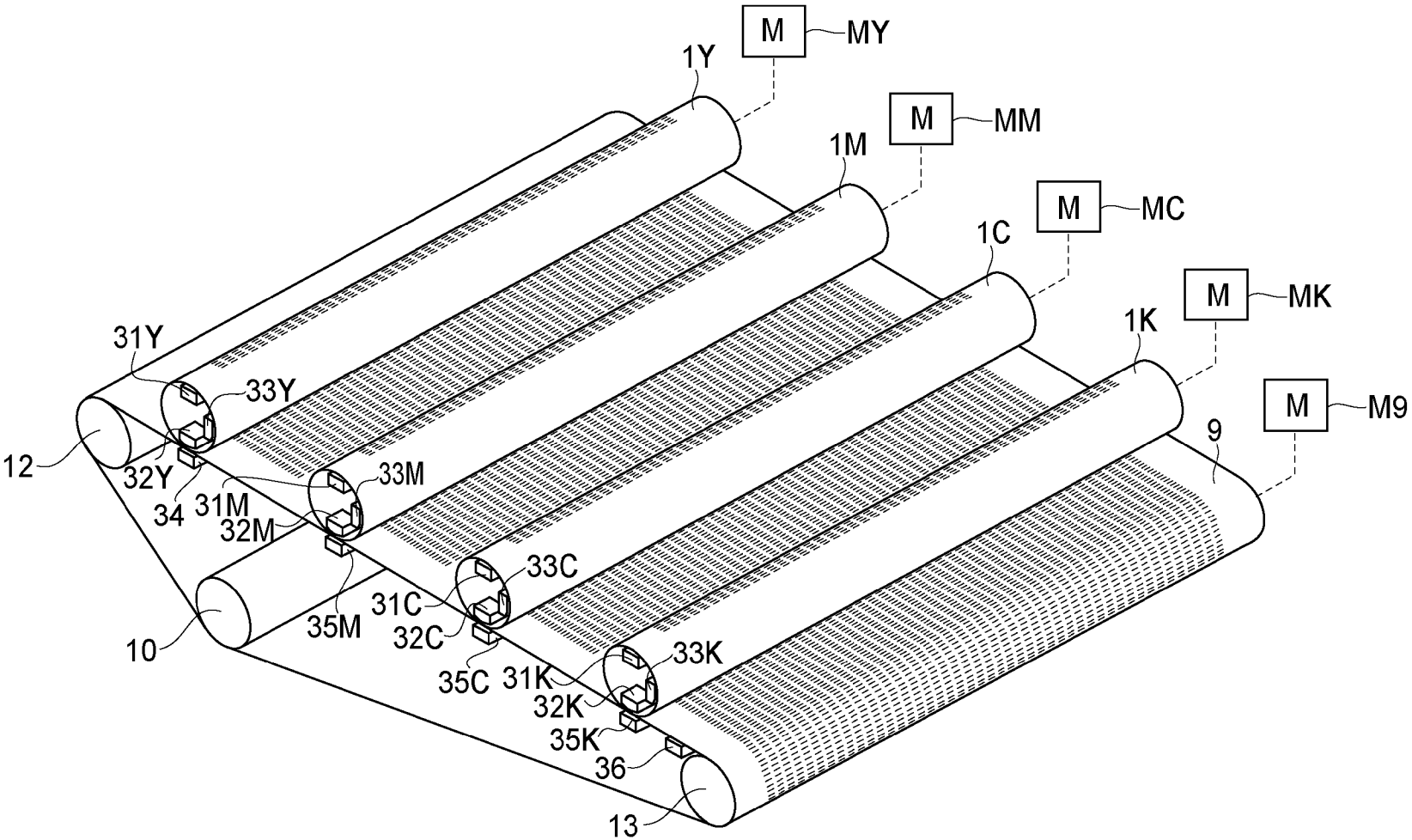
FIG. 3 is a schematic view of an image forming apparatus of Embodiment 1.
Figure 4:
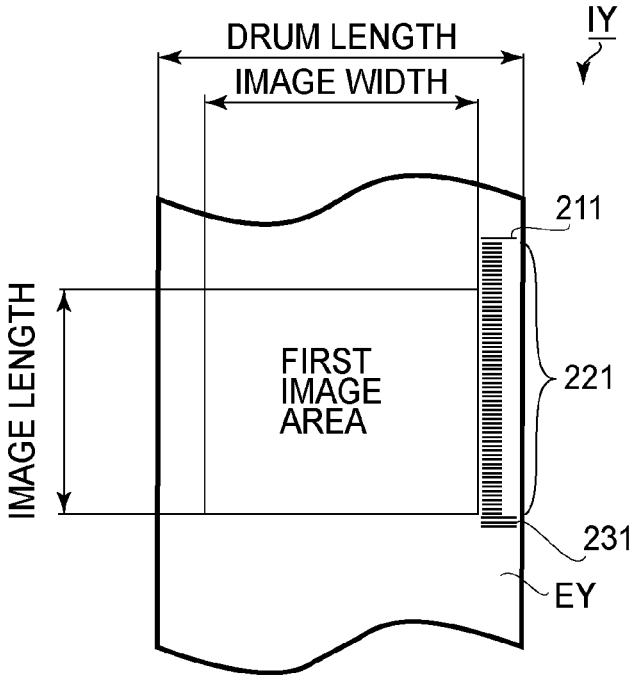
FIG. 4 is a schematic view for illustrating a first position index formed on a first image bearing member.
Figure 5:
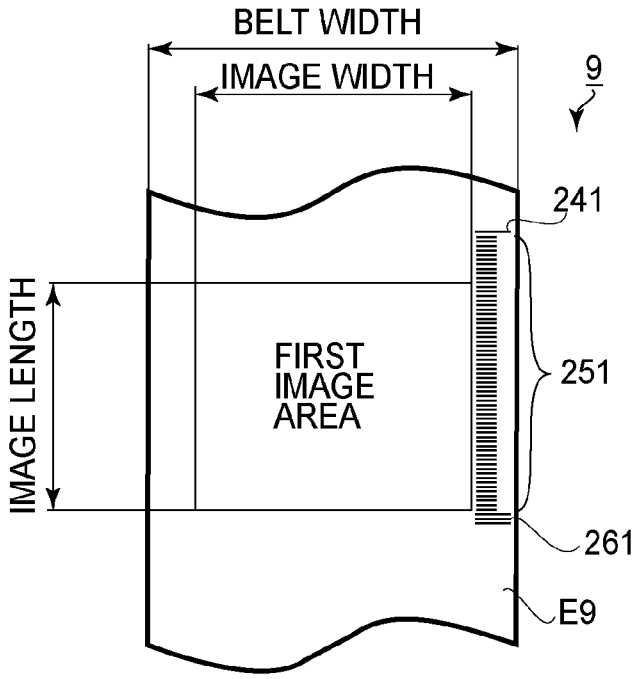
FIG. 5 is a schematic view for illustrating a conveying member position index formed on a conveying member.
Figure 6:
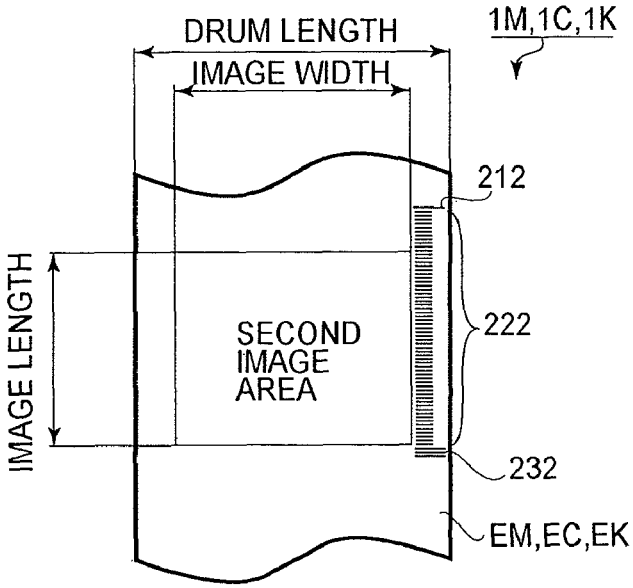
FIG. 6 is a schematic view for illustrating a second position index formed on a second image bearing member.

FIG. 3 is a partial perspective view of an image forming apparatus of Embodiment 1, FIG. 4 is a schematic view for illustrating a first position index formed on a first image bearing member, FIG. 5 is a schematic view for illustrating a conveying member position index formed on a conveying member, and FIG. 6 is a schematic view for illustrating a second position index formed on a second image bearing member.

Figure 7:
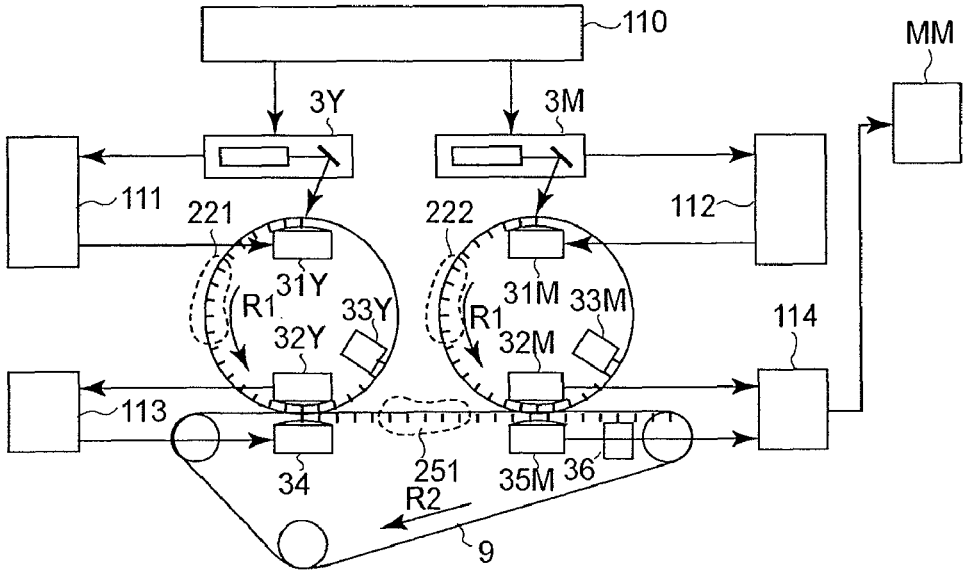
FIG. 7 is a schematic view for illustrating a constitution used in control in Embodiment 1.
Figure 8:
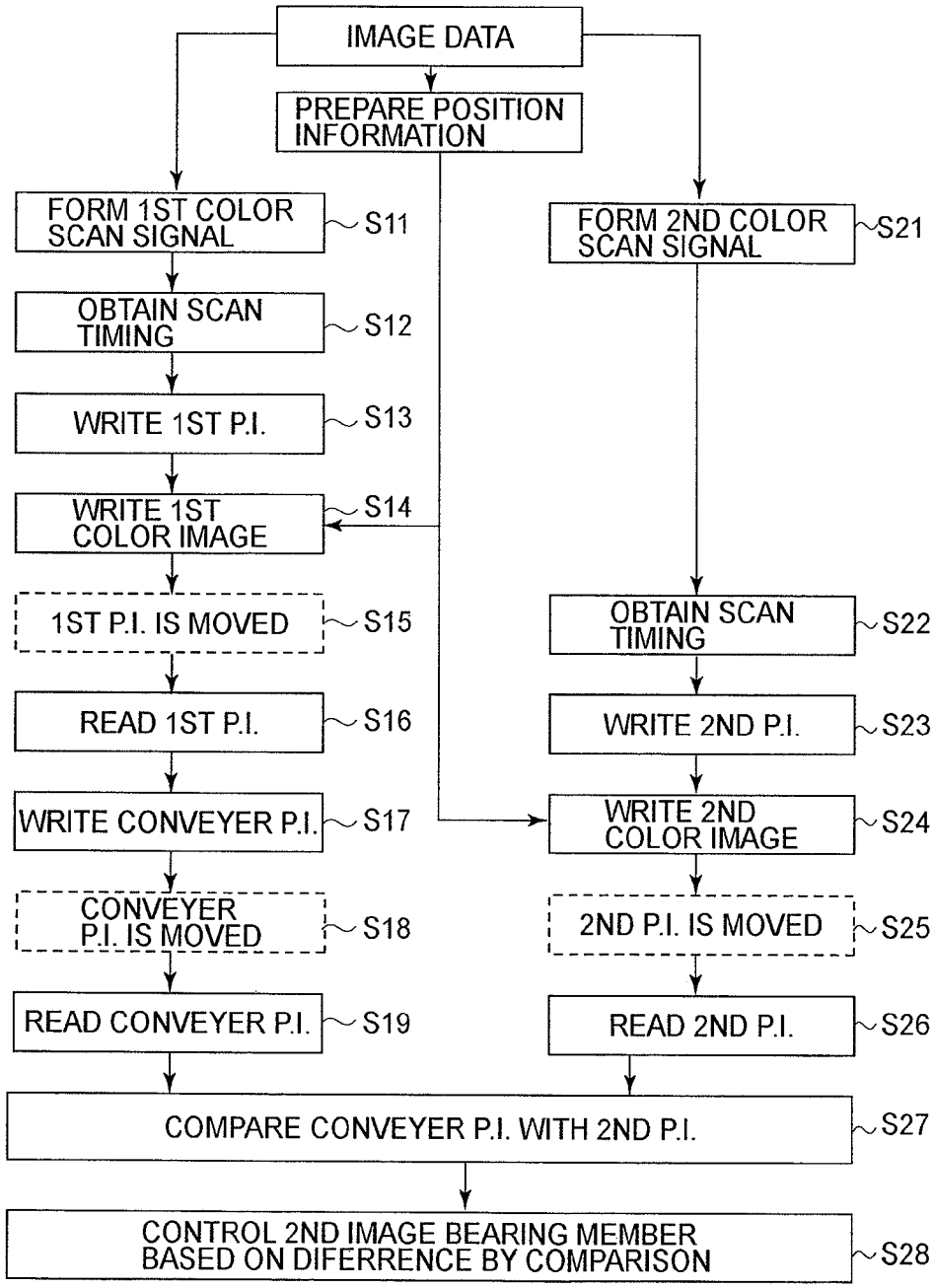
FIG. 8 is a block diagram for illustrating an outline of the control in Embodiment 1.
Figure 9:
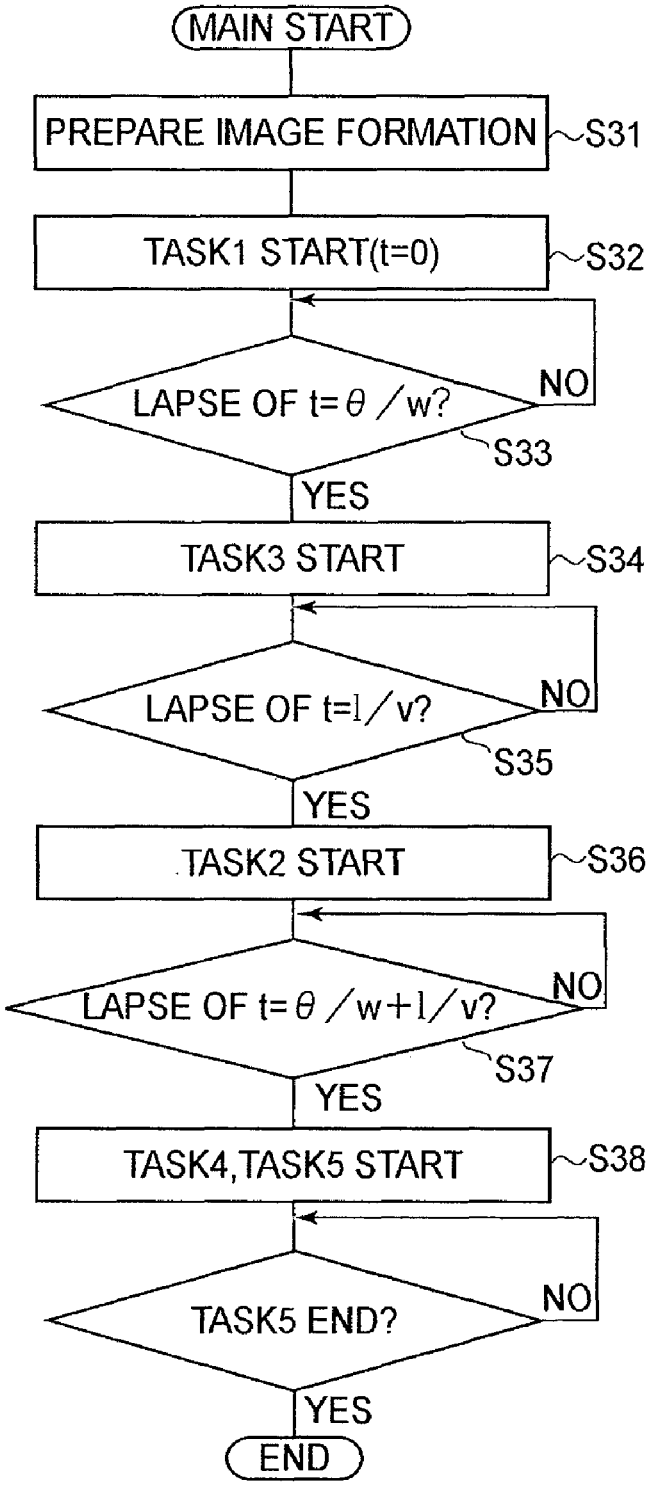
FIG. 9 is a flow chart of the control in Embodiment 1.

FIG. 7 is a schematic view for illustrating a constitution used in control in FIG. 1, FIG. 8 is a block diagram for illustrating an outline of the control in Embodiment 1, FIG. 9 is a flow chart of the control in Embodiment 1, and FIGS. 10 to 14 are flow charts of control of tasks 1 to 5, respectively.

As shown in FIG. 3, in Embodiment 1, a position index (221) for each of scanning lines is magnetically recorded at an inner surface of an image bearing member (1Y, 1M, 1C, 1K). In synchronism with the first position index (221) of the image bearing member (1Y), a conveying member position index (251) for each of the scanning lines is formed on the conveying member (9) side at the first transfer portion (TY). Then, a rotational speed of a second image bearing member (1M, 1C, 1K) is adjusted. As a result, an image bearing member position index (222) carried by the second image bearing member (1M, 1C, 1K) is superposed on the conveying member position index (251) formed on the intermediary transfer belt 9 at a second transfer portion (TM, TC, TK).

The photosensitive drum 1Y is driven by a driving motor MY to rotate at a substantially constant rotational speed and the intermediary transfer belt 9 is driven by a driving motor M9 to rotate at a substantially constant rotational speed.

The photosensitive drums 1M, 1C and 1K as an example of the second image bearing member are driven by driving motors MM, MC and MK, respectively, to rotate at a substantially constant rotational speed and rotational speeds thereof are adjustable independently. These driving motors function as an adjusting device when positional deviation is corrected.

At the surface of the photosensitive drum 1Y as an example of the first image bearing member, scanning lines for an electrostatic image are written with a pitch of 42 μm (600 dpi) in a rotational direction of the photosensitive drum 1Y by the exposure device (3Y: FIG. 2).

As shown in FIG. 4, a magnetic recording layer EY is formed at the inner surface of the photosensitive drum 1Y and as shown in FIG. 3, a writing device 31Y is disposed correspondingly to a writing position of the scanning lines. The writing device 31Y magnetically records the first position index in the magnetic recording layer EY for each writing of the scanning line on the photosensitive drum 1Y.

A single long start index 211 preceding a first image area for yellow by a predetermined distance is magnetically recorded and three long end indices 231 are disposed correspondingly to a rear end of the first image area. That is, in an area outside the image area with respect to a rotational axis direction of the image bearing members, image bearing member position indices corresponding to images are provided. These image bearing member position indices are provided along an image bearing member rotational direction. In an area downstream of the outside area with respect to the image bearing member rotational direction, the start index is provided. In an area upstream of the outside area with respect to the image bearing member rotational direction, the end indices are provided.

As shown in FIG. 5, at an inner surface of the intermediary transfer belt 9, a magnetic recording layer E9 is formed. As shown in FIG. 3, at an inner position of the intermediary transfer belt 9 corresponding to a reader 32Y as an example of a first conveying member position index detecting device, a writing device 34 is disposed. The writing device 34 magnetically records a conveying member position index 251 in the magnetic recording layer E9 of the intermediary transfer belt 9 for each reading of the first position index 221 by the reader 32Y.

A single long start index 241 preceding a first image area for yellow by a predetermined distance is magnetically recorded and three long end indices 261 are disposed correspondingly to a rear end of the first image area.

As shown in FIG. 6, at inner surfaces of the photosensitive drums 1M, 1C and 1K, magnetic recording layers EM, EC and EK are formed and writing devices 31M, 31C and 31K are disposed correspondingly to writing positions of respective scanning lines. The writing devices 31M, 31C and 31K magnetically record a second position index 222 in the magnetic recording layers EM, EC and EK for each writing of scanning line on the photosensitive drums 1M, 1C and 1K. In the photosensitive drum 1M (second image bearing member), the image bearing member position index 222 is provided along a second image bearing member rotational direction. This is true for other photosensitive drums.

A single long start index 212 preceding a second image area for magenta, cyan or black by a predetermined distance is magnetically recorded and three long end indices 232 are disposed correspondingly to a rear end of the second image area.

The magnetic recording layers EY, EM, EC and EK may desirably be formed by applying an information recording medium such as a magnetic material at a position outside the image area of the photosensitive drums 1Y, 1M, 1C and 1K. The position may also be, in addition to the inner surfaces of the photosensitive drums 1Y, 1M, 1C and 1K, a non-image forming portion at an outer surface end portion, a detect end surface, and the like.

In the neighborhood of the primary transfer portion (TM, TC, TK: FIG. 1) as the example of the second transfer portion, the readers 32M, 32C and 32K and the readers 35M, 35C and 35K are disposed in pairs, respectively.

When the reader 35M (conveying member position index detecting device) reads the conveying member position index 251 and at the same time the reader 32M (image bearing member position index detecting device) reads the second position index, the scanning lines formed on the photosensitive drum 1M are superposed on the scanning lines carried on the intermediary transfer belt 9.

When the reader 35C reads the conveying member position index 251 and at the same time the reader 32C reads the second position index, the scanning lines formed on the photosensitive drum 1C are superposed on the scanning lines carried on the intermediary transfer belt 9.

When the reader 35K reads the conveying member position index 251 and at the same time the reader 32K reads the second position index, the scanning lines formed on the photosensitive drum 1K are superposed on the scanning lines carried on the intermediary transfer belt 9.

However, actually, deviation in timing between both of the reading of the conveying member position index and the reading of the second position index occurs. For this reason, surfaces speeds of the photosensitive drums 1M, 1C and 1K are changed by controlling the driving motors MM, MC and MK so as not to cause the deviation in timing.

As a result, a variation in writing pitch of the scanning lines due to rotation non-uniformity of the photosensitive drum 1Y is eliminated by internal rotation control of the photosensitive drums 1M, 1C and 1K to positionally align the scanning lines, so that a deviation in scanning line is eliminated.

Further, a variation in timing of the scanning lines reaching the primary transfer portions (TM, TC, TK: FIG. 1) due to rotation non-uniformity of the intermediary transfer belt 9 is also eliminated by intentional rotation control of the photosensitive drums 1M, 1C and 1K to positionally align the scanning lines, so that the deviation in scanning line is eliminated.

An erasing device 33Y as an example of first position index erasing means is disposed downstream of the reader 32Y at the inner surface of the photosensitive drum 1Y. The erasing device 33Y erases the first position index (221: FIG. 4) magnetically recorded at the inner surface of the photosensitive drum 1Y.

An erasing device 36 as an example of conveying member position index erasing means is disposed downstream of the photosensitive drum 1K at an inner surface of the intermediary transfer belt 9. The erasing device 36 erases the conveying member position index (251: FIG. 5) magnetically recorded at the inner surface of the intermediary transfer belt 9.

Erasing devices 33M, 33C and 33K as an example of second position index erasing means are disposed downstream of the reader 32M, 32C and 32K at the inner surfaces of the photosensitive drums 1M, 1C and 1K. The erasing devices 33M, 33C and 33K erase the second position index (222: FIG. 6) magnetically recorded at the inner surfaces of the photosensitive drums 1M, 1C and 1K.

Hereinafter, superposition control of a yellow toner image as the first color toner image and a magenta toner image as the second color toner image will be described, thus omitting redundant explanation of a cyan toner image and a black toner image as other examples of the second color toner image.

As shown in FIG. 8 with reference to FIG. 7, the second position index 222 is positioned on the conveying member position index 251 formed by being transcribed from the first position index 221, so that a deviation in scanning line between the yellow toner image and the magenta toner image is eliminated.

A control portion 110 forms respective color images of yellow, cyan, magenta and black from image information and prepares scanning line data by expanding the respective color images (S11, S21).

A first position index recording portion 111 controls the writing device 31Y in synchronism with scanning timing of the exposure device 3Y (S12), thus forming the first position index 221 on the photosensitive drum 1Y (S13).

The exposure device 3Y as an example of first electrostatic image forming means writes an electrostatic image on the photosensitive drum 1Y by using the scanning line data for the yellow image (S14). The electrostatic image is developed into the yellow toner image as the example of the first color toner image by the developing device 4Y as the example of the first developing means.

A second position index recording portion 112 controls the writing device 31M in synchronism with scanning timing of the exposure device 3M (S22), thus forming the second position index 222 on the photosensitive drum 1M (S23).

The exposure device 3M as an example of second electrostatic image forming means writes an electrostatic image on the photosensitive drum 1M by using the scanning line data for the magenta image (S24). The electrostatic image is developed into the magenta toner image as the example of the second color toner image by the developing device 4M as the example of the second developing means.

The scanning lines for the yellow image are moved by the rotation of the photosensitive drum 1Y (S15), so that the first position index 221 is detected by the reader 32Y as the example of the first position index detecting means (S16).

A conveying member position index recording portion 113 controls the writing device 34 as the example of the conveying member position index detecting means in synchronism with detection timing of the first position index 221 (S17), thus forming the conveying member position index 251 on the intermediary transfer belt 9.

At the same time, at the primary transfer portion TY as the example of the first transfer portion, the scanning lines for the yellow image are primary-transferred onto the intermediary transfer belt 9.

The scanning lines for the yellow image are moved by the rotation of the intermediary transfer belt 9 (S18), so that the conveying member position index 251 is detected by the reader 35M as the example of the conveying member position index detecting means (S19).

The scanning lines for the magenta image are moved by the rotation of the photosensitive drum 1M (S25), so that the second position index 222 is detected by the reader 32M as the example of the second position index detecting means (S26).

A speed control portion 114 compares detect timing (S26) of the second position index 222 by the reader 32M with detect timing (S19) of the conveying member position index 251 by the reader 35M (S27).

The speed control portion 114 starts time counting of the conveying member position index 251 when the reader 35M detects the start index 241 shown in FIG. 5.

The speed control portion 114 counts a detected time of each of the conveying member position indices 251 formed correspondingly to associated ones of the scanning lines in the first image area.

The speed control portion 114 terminates the time counting of the conveying member position index 251 when the reader 35M detects the end index 261.

The speed control portion 114 starts time counting of the second position index 222 when the reader 32M detects the start index 212 shown in FIG. 6.

The speed control portion 114 counts a detected time of each of the second position indices 222 formed correspondingly to associated ones of the scanning lines in the second image area.

The speed control portion 114 terminates the time counting of the second position index 222 when the reader 32M detects the end index 232.

The speed control portion 114 controls the rotation of the photosensitive drum 1M so that a difference in counted value between the conveying member position index 251 and the second position index 222 is zero, thus accurately superposing the scanning lines for the magenta toner image on the scanning lines for the yellow toner image (S28).

The speed control portion 114 as an example of control means obtains an amount of delay (lead) of the detected time of the second position index 222 with respect to a corresponding conveying member position index 251 and increases (decreases) a speed of a driving motor MM on the basis of the amount of delay (lead). As a result, the rotational speed of the photosensitive drum 1M is increased (decreased), so that the second position index 222 and the conveying member position index 251 are caused to reach the primary transfer portion (TM: FIG. 1) simultaneously.

FIG. 9 is a flow chart for executing a control process shown in FIG. 8.

As shown in FIG. 9 with reference to FIG. 7, the entire control process is described by being divided into 5 tasks shown in FIG. 10 to 14.

The control portion 110 prepares for image formation by pre-rotating the intermediary transfer belt 9 when it receives an image forming job (S31).

The first position index recording portion 111 starts task 1 at a time t=0 before the exposure device 3Y starts the writing of the electrostatic image (S32). The task 1 is a task for recording the first position index 221 in the photosensitive drum 1Y (S32).

The exposure device 3Y generates a timing signal synchronized with raster scanning with respect to the photosensitive drum 1Y. The first position index recording portion 111 controls the writing device 31Y depending on raster scanning timing so as to record the first position index 221 for the yellow image.

The conveying member position index recording portion 113 starts a task 3 when a time $\theta/w$ elapses from the start (t=0) of the task 1 (YES of S33) (S34). Here, "$\theta$" represents an angle from the exposure position of the photosensitive drum 1Y to the primary transfer portion TY and "w" represents an angular speed of rotation of the photosensitive drum 1Y.

The task 3 is a task for transcribing a position index from the first position index 221 formed on the photosensitive drum 1Y into the conveying member position index 251 on the intermediary transfer belt 9 (S34).

The conveying member position index recording portion 113 actuates the writing device 34 for each reading of the first position index 221 by the reader 32M to form the conveying member position index 251.

The second position index recording portion 112 starts a task 2 when a time l/v elapses from the start (t=0) of the task 1 (YES of S35) (S36). Here, "l" represents a distance from the primary transfer portion TY to the primary transfer portion TM and "v" represents a peripheral speed of the intermediary transfer belt 9. The task 2 is a task for recording the second position index 222 on the photosensitive drum 1M (S36).

The exposure device 3M generates a timing signal synchronized with raster scanning with respect to the photosensitive drum 1M. The second position index recording portion 112 controls the writing device 31M depending on raster scanning timing so as to record the second position index 222 for the magenta image.

The speed control portion 114 starts a task 4 and a task 5 when the time (θ/w) elapses from the start (t=l/v) of the task 2 (YES of S37) (S38).

The task 4 is a task for reading the second position index, 222 formed on the photosensitive drum 1M, by the reader 32M (S38). As positional information of the scanning lines for the magenta toner image, a scale number and a detected time of the second position index 222 are stored in a register.

The task 5 is a task for controlling the rotational speed of the photosensitive drum 1M depending on a result of comparison between the conveying member position index 251 and the second position index 222.

The speed control portion 114 reads the conveying member position index 251 formed on the intermediary transfer belt 9 by the reader 35M and compares the read conveying member position index 251 with the second position index 222 read in the task 4.

Figure 10:
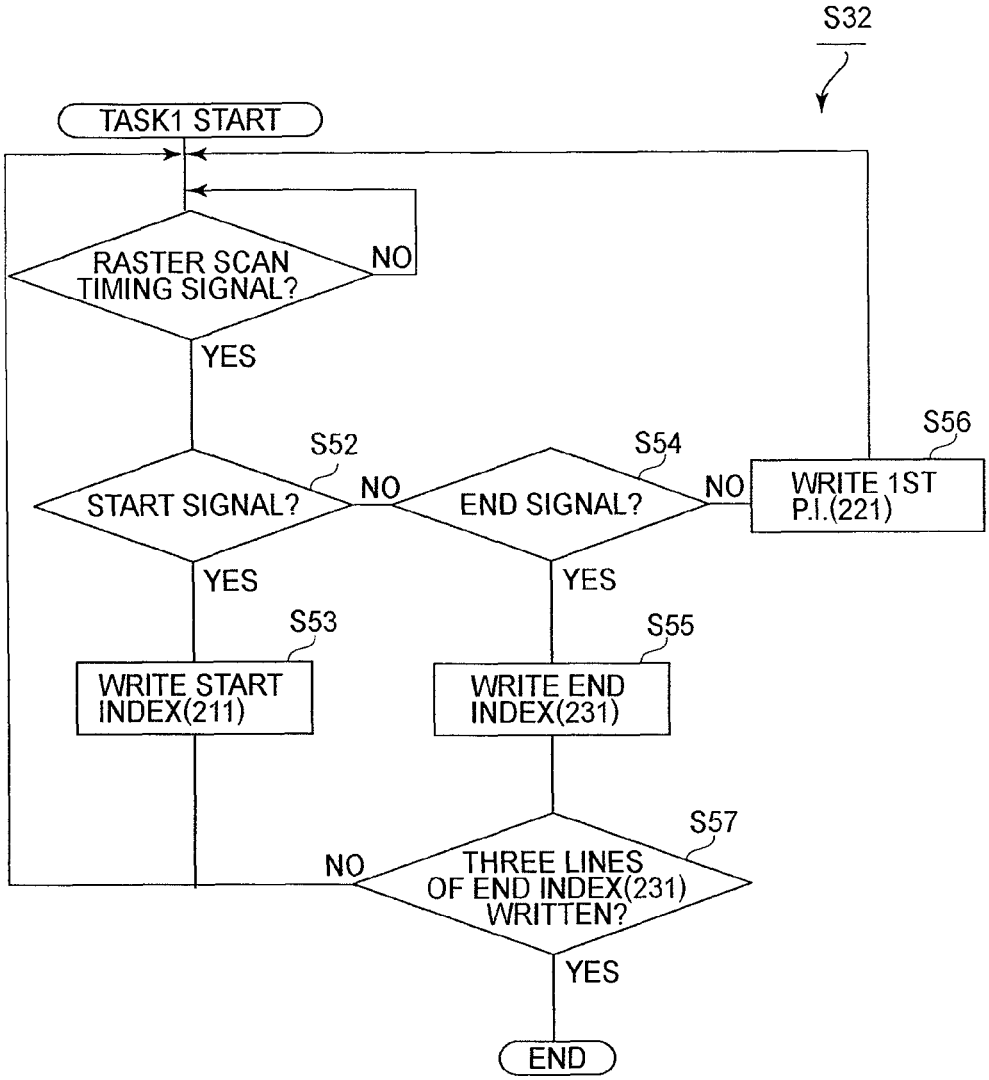
FIGS. 10 to 14 are flow charts of control of tasks 1 to 5, respectively.

As shown in FIG. 10 with reference to FIGS. 4 and 7, the first position index recording portion 111 controls the writing device 31Y to execute the task 1. The raster scanning timing signal includes a start signal sent earlier than the raster scanning start by a predetermined time, a raster signal synchronized with the raster scanning of the exposure device 3Y, and an end signal sent immediately after completion of the raster scanning.

The first position index recording portion 111 forms the start index 211 with timing of the start signal (YES of S52) (S53) and forms the end indices 231 with timing of the end signal (YES of S54) (S55, S57). With timing of the raster signal (NO of S54), the first image bearing member position index 221 is formed (S56).

Figure 11:
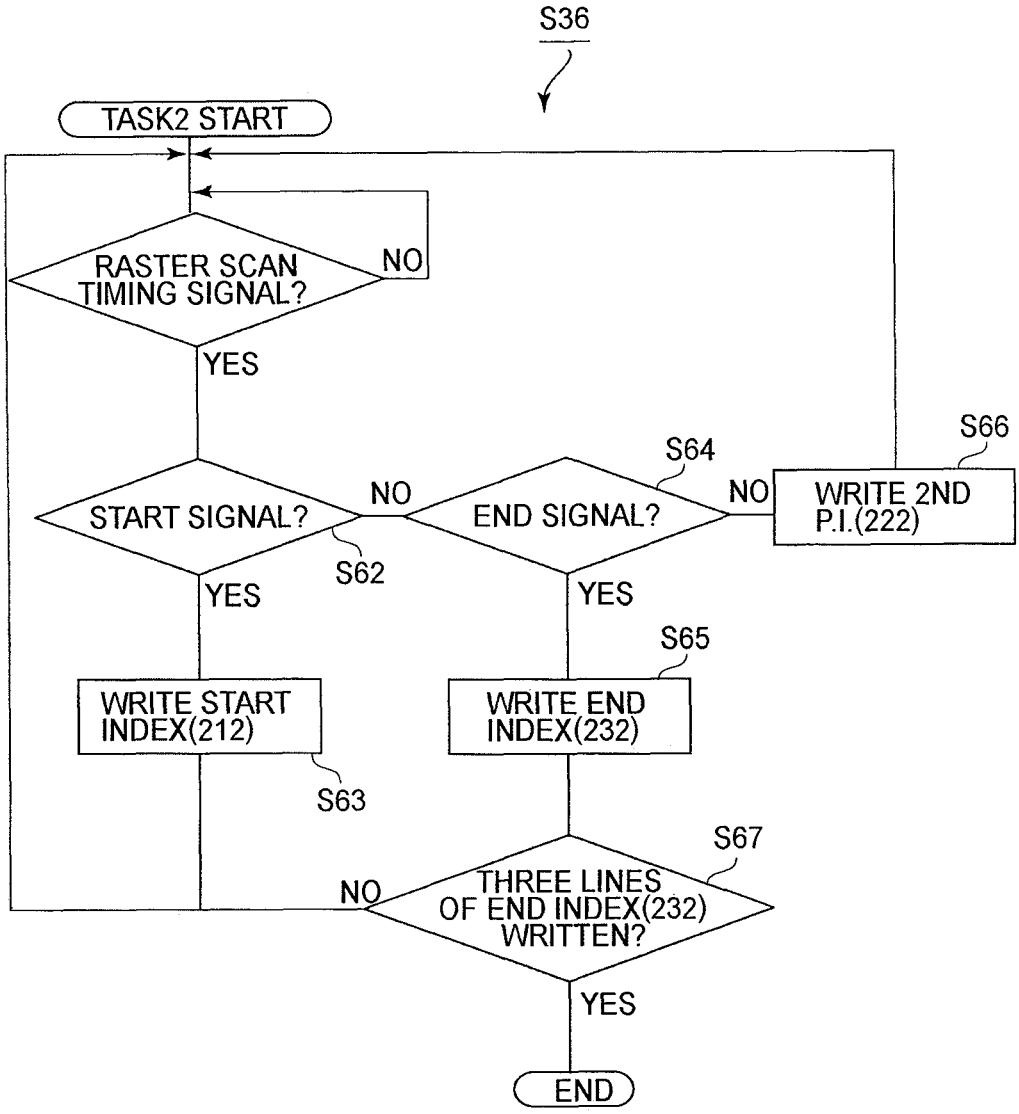

As shown in FIG. 11 with reference to FIGS. 6 and 7, the second position index recording portion 112 executes the task 2 by controlling the writing device 31M. The raster scanning timing signal includes a start signal sent earlier than the raster scanning start by a predetermined time, a raster signal synchronized with the raster scanning of the exposure device 3M, and an end signal sent immediately after completion of the raster scanning.

The second position index recording portion 112 forms the start index 212 with timing of the start signal (YES of S62) (S63) and forms the end indices 232 with timing of the end signal (YES of S64) (S65, S67). With timing of the raster signal (NO of S64), the second image bearing member position index 222 is formed (S66).

Figure 12:
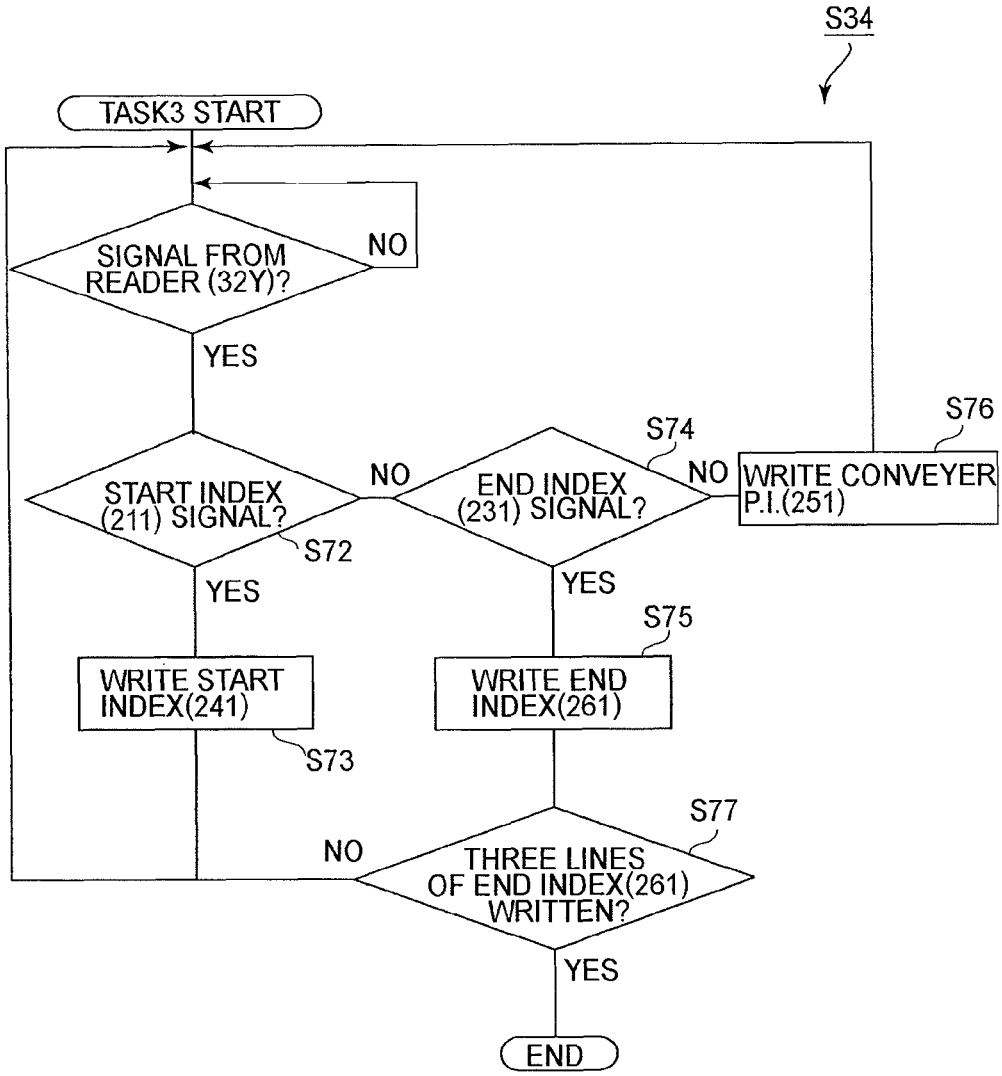

As shown in FIG. 12 with reference to FIGS. 5 and 7, the conveying member position index recording portion 113 executes the task 3 by controlling the reader 32Y.

The conveying member position index recording portion 113 forms the start index 241 with detected timing of the start index 211 (FIG. 4) (YES of S72) (S73) and forms the end indices 261 with detected timing of the end indices 231 (YES of S74) (S75, S77). With detected timing of the start index 211 (NO of S74), the conveying member position index 251 is formed (S76).

Figure 13:
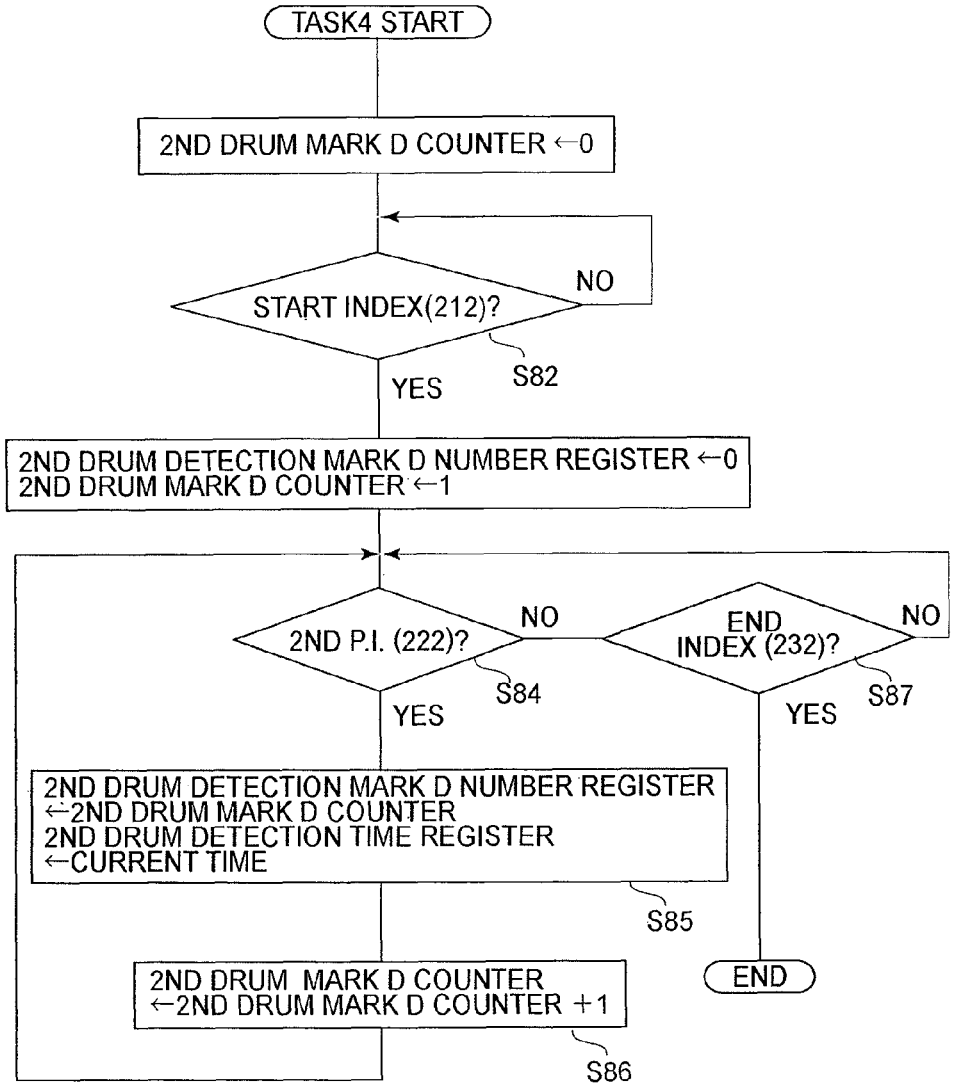

As shown in FIG. 13 with reference to FIGS. 6 and 7, the speed control portion 114 executes the task 4 by controlling the reader 32M.

The speed control portion 114 detects the start index 212 (YES of S82) and starts detection of the second position index 222 and then executes recording of a detected time (S85) and counting (S86) for each detection of the second position index 222 (YES of S84). When the end indices 232 are detected (YES of S87), the detection of the second position index 222 is completed.

Figure 14:
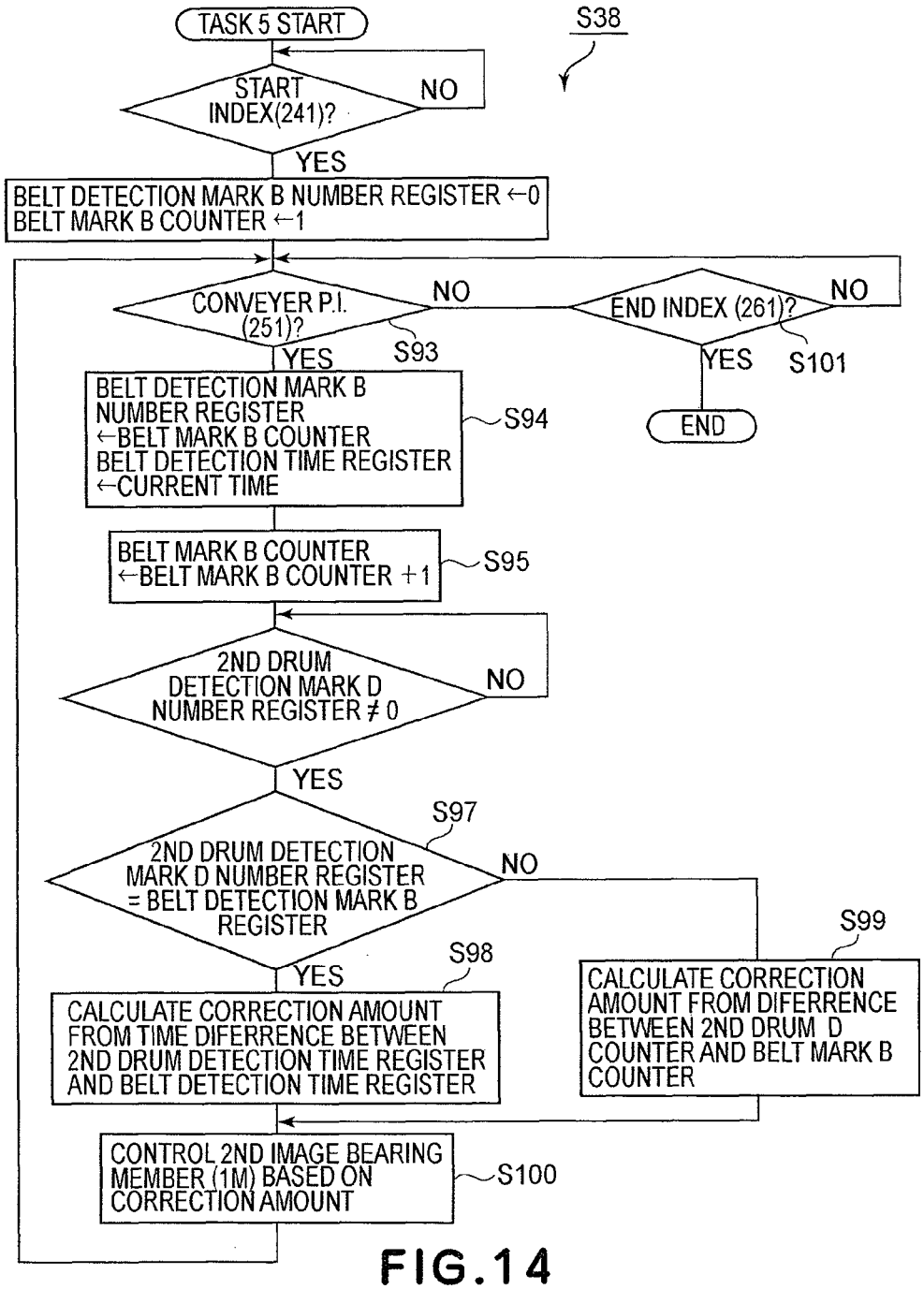

As shown in FIG. 14 with reference to FIGS. 5 and 7, the speed control portion 114 executes the task 5 on the basis of the reader 35M by controlling the driving motor MM.

The speed control portion 114 stores the (position) number of the conveying member position index 251 from the first conveying member position index 251 and a detected time thereof in the register for each detection of the conveying member position index 251 on the intermediary transfer belt 9 by the reader 35M (YES of S93) (S94, S95).

The speed control portion 114 computes a difference in detected time between the second position index 222 and the conveying member position index 251 (S98) in the case where the detection timing of the second position index 222 and the detection timing of the conveying member position index 251 are close to each other (YES of S97).

The speed control portion 114 computes a difference in the number between the second position index 222 and the conveying member position index 251 (S99) in the case where the detection timing of the second position index 222 and the detection timing of the conveying member position index are deviated from each other (NO of S97).

The speed control portion 114 changes the rotational speed of the driving motor MM so as to cancel the difference in detected time or the difference in the (position) number (S100).

The speed control portion 114 completes the control of the driving motor MM when the end index 261 is detected by the reader 35M (YES of S101).

Incidentally, in the case where a superposition error (color deviation tolerance limit) of scanning lines with a pitch of 42 μm is 10μ, it is desirable that resolving power of each of the first position index 221, the conveying member position index 251, and the second position index 222 is about 1 μm.

In Embodiment 1, sine wave-like magnetic recording is carried out with a period of 42 μm for each of the scanning lines and an analog signal is detected from a recording pattern by each of two readers shifted from each other by 10.5 μm in the rotational direction. By signal processing of the two detected analog signals, one period is divided into 64 sub-periods to realize desired resolving power.

Further, by detecting a magnetically recorded scale with a pitch of 100 μm through two readers shifted from each other by ¼ signal period in the rotational direction, it is possible to realize desired resolving power by dividing one period into 128 sub-periods through signal processing.

Further, in the case where 4 μm-horizontal magnetic recording in a ferrite magnetic recording layer is effected by using a 1 μm-gap ring head, it is possible to realize desired resolving power by interpolation using four divided sub-periods of one period of a read analog signal itself.

A writing position by the writing device 31Y (31M) may desirably coincide with a laser light scanning position with respect to the angular direction of rotation of the photosensitive drum 1Y (1M). Further, it is desirable that there is no delay time from writing start timing of the scanning lines on the photosensitive drum 1Y (1M) to recording of the first position index 221 (the second position index 222) by the writing device 31Y (31M).

However, actually, some delay time occurs. For example, in the case of a process speed of 300 mm/sec, when the delay time is 30 μsec, a superposition error (color deviation) of about 10 μm occurs. In the case where a target value of a color deviation limit at the process speed of 300 mm/sec is 10 μm or less, a delay time of 30 μsec or less is tolerable.

In the case where the delay time is problematic, an error can be eliminated by locating the writing position by the writing device 31Y (31M) downstream of the laser light scanning position on the photosensitive drum 1Y (1M) with respect to the rotational direction of the photosensitive drum 1Y (1M) by a distance corresponding to the delay time. The first position index 221 (the second position index 222) is recorded with the delay time at a position opposite from a position of scanning lines for a previously written electrostatic image.

Further, the writing position by the writing device 34 may desirably establish close superposition positional relationship with the reading position by the reader 32Y at the primary transfer portion TY by the rotation of the photosensitive drum 1Y. It is desirable that there is no delay time from the detection timing of the first position index 221 on the photosensitive drum 1Y to recording of the conveying member position index 251 by the writing device 34.

However, actually, some delay time occurs.

For this reason, it is desirable that the writing position by the writing device 34 is located downstream of the reading position by the reader 32Y with respect to the rotational direction of the photosensitive drum 1Y by a distance corresponding to the delay time. The conveying member position index 251 is recorded at a position opposite from a position of the previously read first position index 221 with the delay time.

Further, the reading position by the reader 35M may desirably establish close superposition positional relationship with the reading position by the reader 32M at the primary transfer portion TM by the rotation of the photosensitive drum 1M. It is desirable that there is no delay time from the detection timing of the second position index 222 on the photosensitive drum 1M to increase (decrease) in rotational speed of the photosensitive drum 1M by the speed control portion 114.

However, actually, some delay time occurs.

For this reason, it is desirable that the reading positions by the readers 35M and 32M are located upstream of the reading position by the reader 32Y with respect to the rotational direction of the primary transfer portion TM by a distance corresponding to the delay time.

Further, in Embodiment 1, the first position index 221, the conveying member position index 251, and the second position index 222 are formed on the surface opposite from the toner image-carried surface, so that these position indices may also be formed at a position in which the position indices two-dimensionally overlap with the toner images. However, in the case where the first position index 221, the conveying member position index 251, and the second position index 222 are formed on the toner image-carried surface, it is desirable that these position indices are formed outside the image areas with respect to a widthwise direction of the intermediary transfer belt 9 and a lengthwise direction of the photosensitive drums 1Y and 1M.

According to the control in Embodiment 1, in the so-called tandem-type image forming apparatus in which the plurality of the image forming stations PY, PM, PC and PK are provided and the toner images of different colors are primary-transferred successively onto the intermediary transfer belt 9, it is possible to sufficiently correct color registration deviation with respect to a sub-scanning direction.

Embodiment 2

Figure 15:
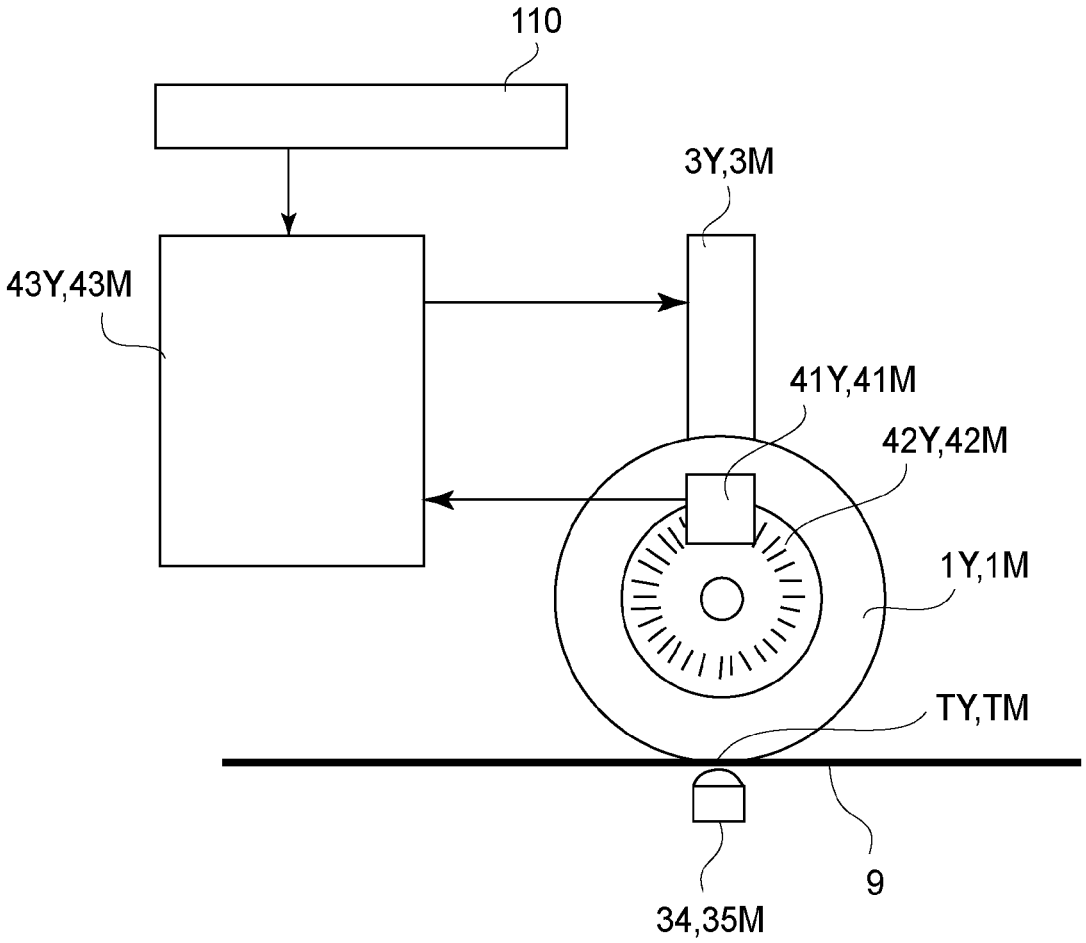
FIG. 15 is a schematic view for illustrating exposure control in Embodiment 2.
Figure 16:
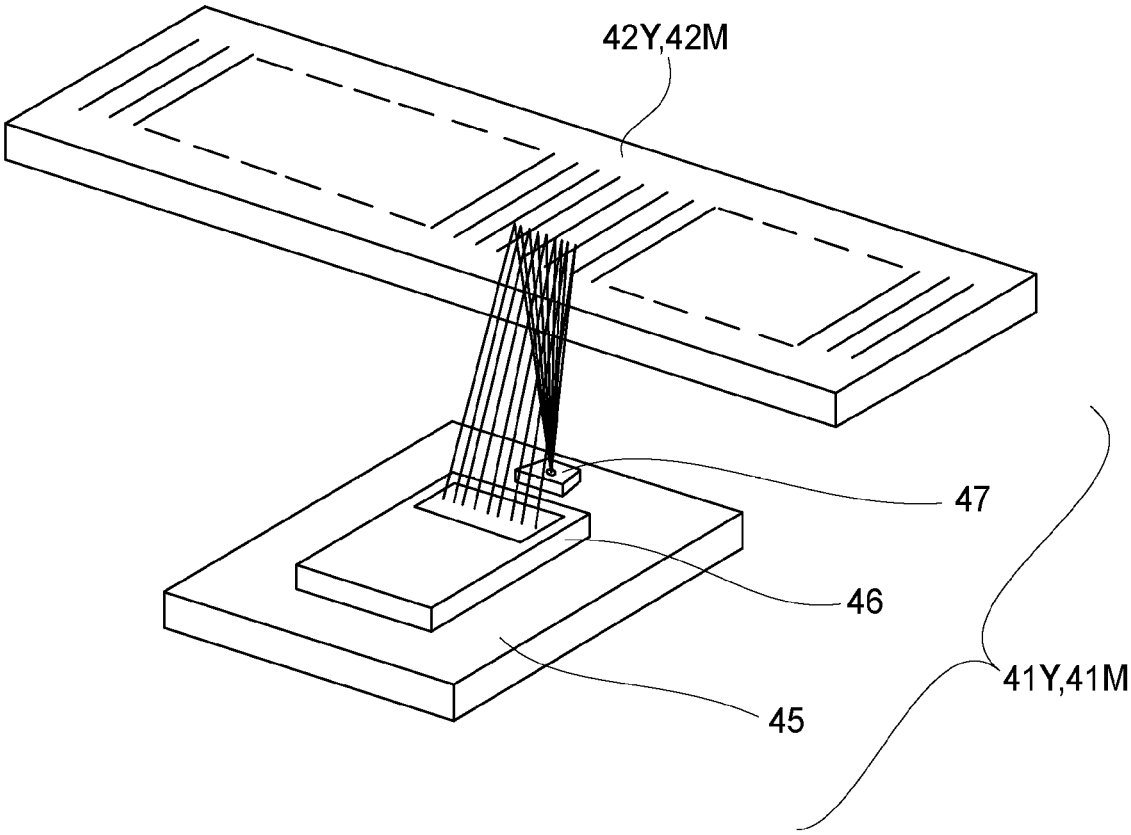
FIG. 16 is a schematic view for illustrating an angular scale reader.

FIG. 15 is a schematic view for illustrating exposure control in Embodiment 2 and FIG. 16 is a schematic view for illustrating an angular scale reader.

In Embodiment 2, a fixed optical scale is formed on the first image bearing member (1Y) (the second image bearing member (1M)) and an electrostatic image is formed on the first image bearing member (1Y) (the second image bearing member (1M)) in synchronism with detection of reading timing of the optical scale. The first electrostatic image forming means (3Y) (the second electrostatic image forming means (3M)) does not write a scanning line on the first image bearing member (1Y) (the second image bearing member (1M)) through scanning writing but writes one scanning line collectively by using a large number of luminous members (LED array) with regular intervals (equal pitch). Other constitutions are common to Embodiment 1, thus being omitted from illustration and redundant explanation.

To the photosensitive drum 1Y, an angular scale 42Y (first position index) of an optical pattern which is integrally rotated with the photosensitive drum 1Y is attached. To the photosensitive drum 1M, an angular scale 42M (second position index) of an optical pattern which is integrally rotated with the photosensitive drum 1M is attached.

The reader 41Y (41M) as an example of the first conveying member position index detecting means and as an example of the timing detecting means reads the angular scale 42Y (42M) and sends a read signal to the exposure control portion 43Y (43M) as an example of the writing control means.

The exposure devices 3Y and 3M are disposed at exposure positions of the photosensitive drums 1Y and 1M shown in FIG. 3 and cause each of the large number of LED elements arranged on the scanning line with a pixel pitch to emit light in combinations of different duties and luminances.

The exposure control portions 43Y and 43M generate timing of a scanning line pitch on the basis of the read signals from the readers 41Y and 41M.

With each timing generated by the exposure control portions 43Y and 43M, the LED array is actuated at an exposure amount corresponding to scanning line image data obtained from the control portion 110 to collectively write the scanning line on the surface of each of the photosensitive drums 1Y and 1K.

In Embodiment 2, positions of the scanning lines written on the photosensitive drums 1Y and 1M are fixed to the angular scales 42Y and 42M, so that the scanning line positions are discriminated by the scale count numbers of the readers 41Y and 41M.

As shown in FIG. 9 with reference to FIG. 15, after start of the task 1, a time reaches θ/w at a count value of the angular scale 42Y corresponding to θ (YES of S33), so that the task 3 is started by using the writing device 34 (S34).

Further, the time reaches l/v at a count value of the angular scale 42Y corresponding to the distance l between the primary transfer portions TY and TM (YES of S35), so that the task 2 using the exposure device 3M is started (S36).

The time reaches (θ/w+l/v) at a count value corresponding to the sum of a peripheral length for the angle θ of the photosensitive drum 1Y and the distance l (YES OF S37). Then, control of the tasks 4 and 5 using the readers 41M and 35M and the driving motor MM is started (S38).

As shown in FIG. 16, as the angular scales 42Y and 42M, an incremental optical scale consisting of 100 μm-period reflection/black pattern is formed.

The readers 41Y and 41M include a sensor substrate 45 on which a light-emitting diode (LED) 47 as a light source and a photo-sensor array 46 as a reading element are disposed. Light emitted from the LED 47 is reflected by the angular scales 42Y and 42M to enter the photosensor array 46.

The reflected light entering the photosensor array 46 provides a light and dark pattern corresponding to the pitch of each of the angular scales 42Y and 42M and is moved by the rotation of each of the photosensitive drums 1Y and 1M. From the photosensor array 46 arranged with a pitch corresponding to the light and dark pattern, an analog sine-wave voltage signal depending on the pitch of each of the angular scale 42Y and 42M is outputted.

As described in Embodiment 1, the photosensor array 46 is disposed in a pair correspondingly to ¼ period of the 100 μm-period reflection/black pattern. The angle sine-wave voltage signal of the pair of photosensor array portions 46 is subjected to signal processing to be dividing the 100 μm-period into 128 sub-periods, so that resolving power of 1 μm or less is realized.

In the case where the exposure devices 3Y and 3M are the laser beam scanning exposure device as described in Embodiment 1, the writing timing of the scanning lines can only be selected at limited phase positions of the rotatable mirror used for the scanning. However, in the case of the exposure devices 3Y and 3M for writing the scanning line by collective exposure with the LED array as described in Embodiment 2, the scanning line writing timing can be changed continuously and arbitrarily.

Embodiment 3

Figure 17:
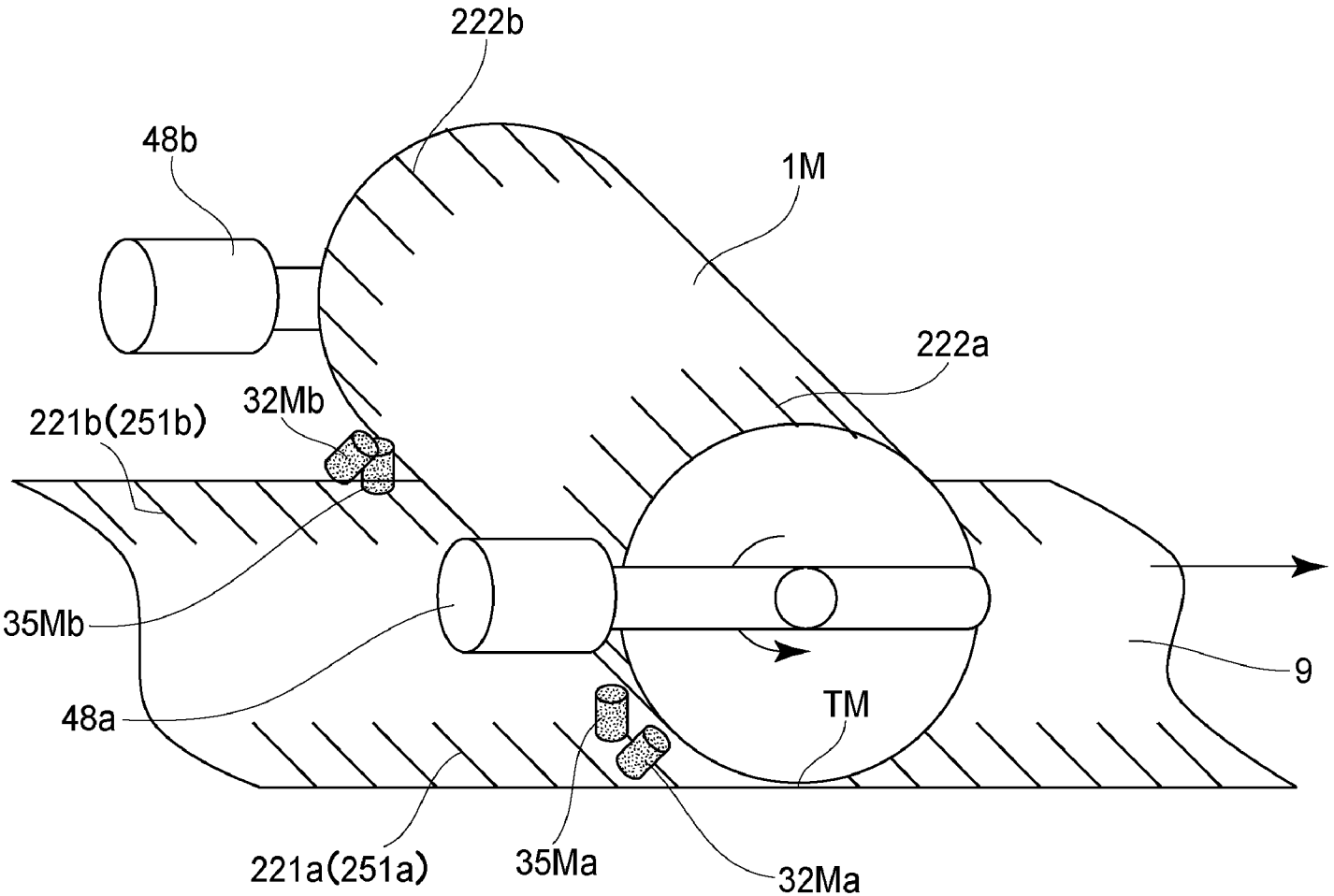
FIG. 17 is a schematic view for illustrating inclination control of a photosensitive drum in Embodiment 3.
Figure 18:
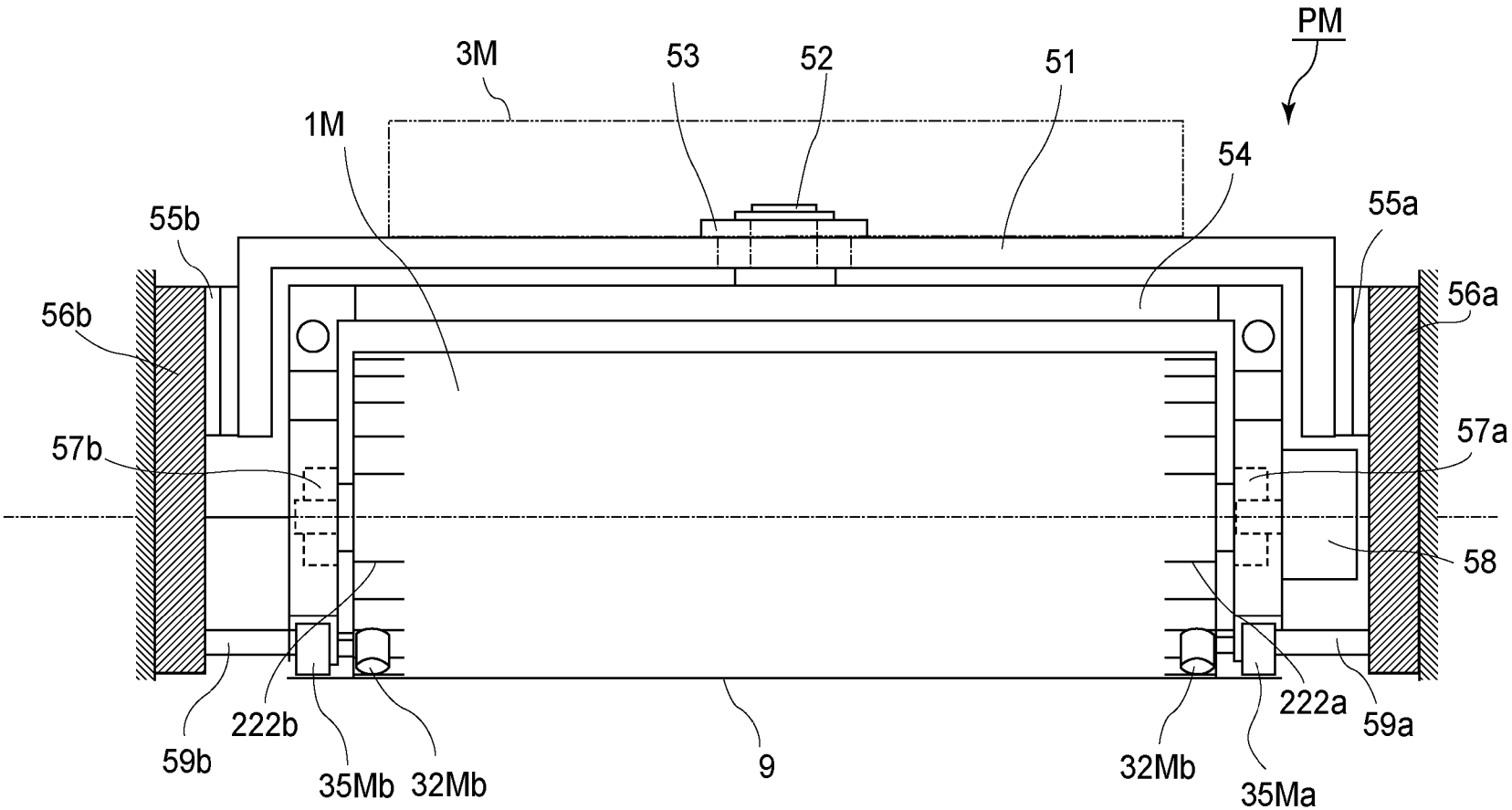
FIGS. 18 to 20 are a side view, a front view, and a plan view, respectively, of an inclination adjusting mechanism for the photosensitive drum.
Figure 19:
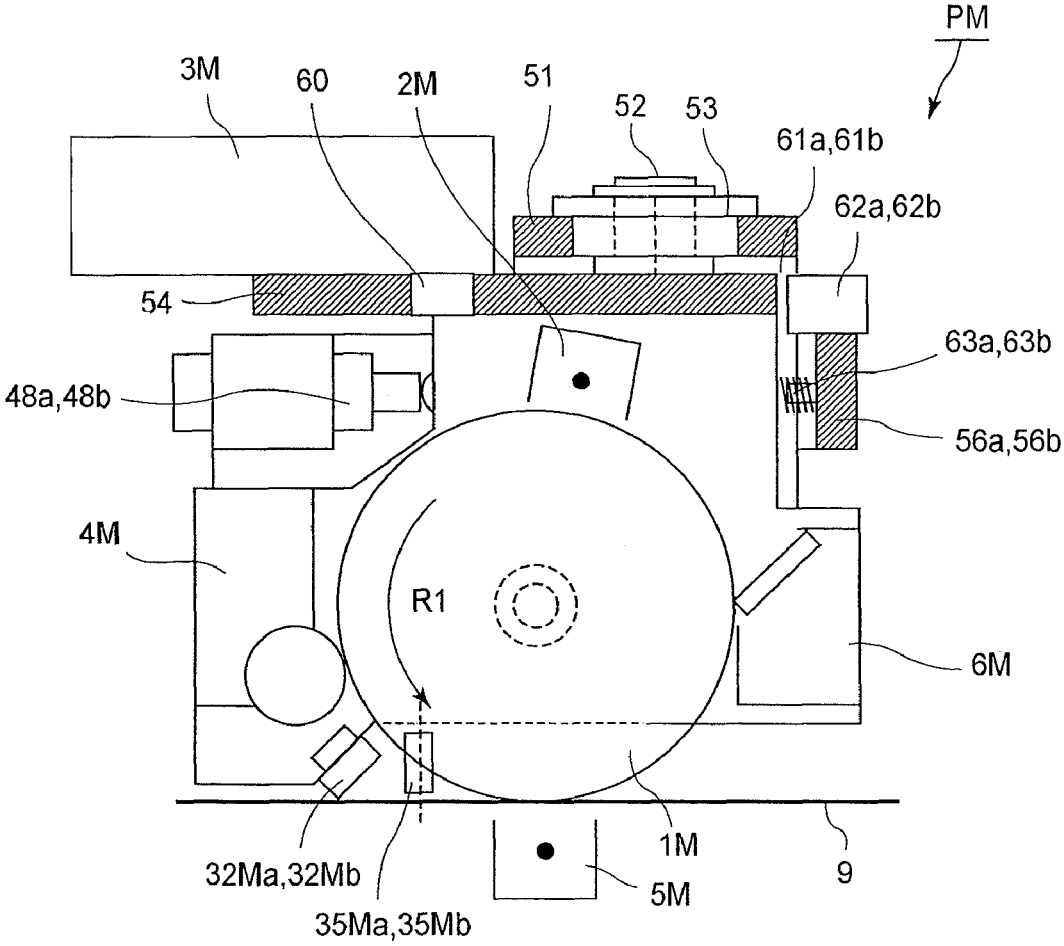
Figure 20:
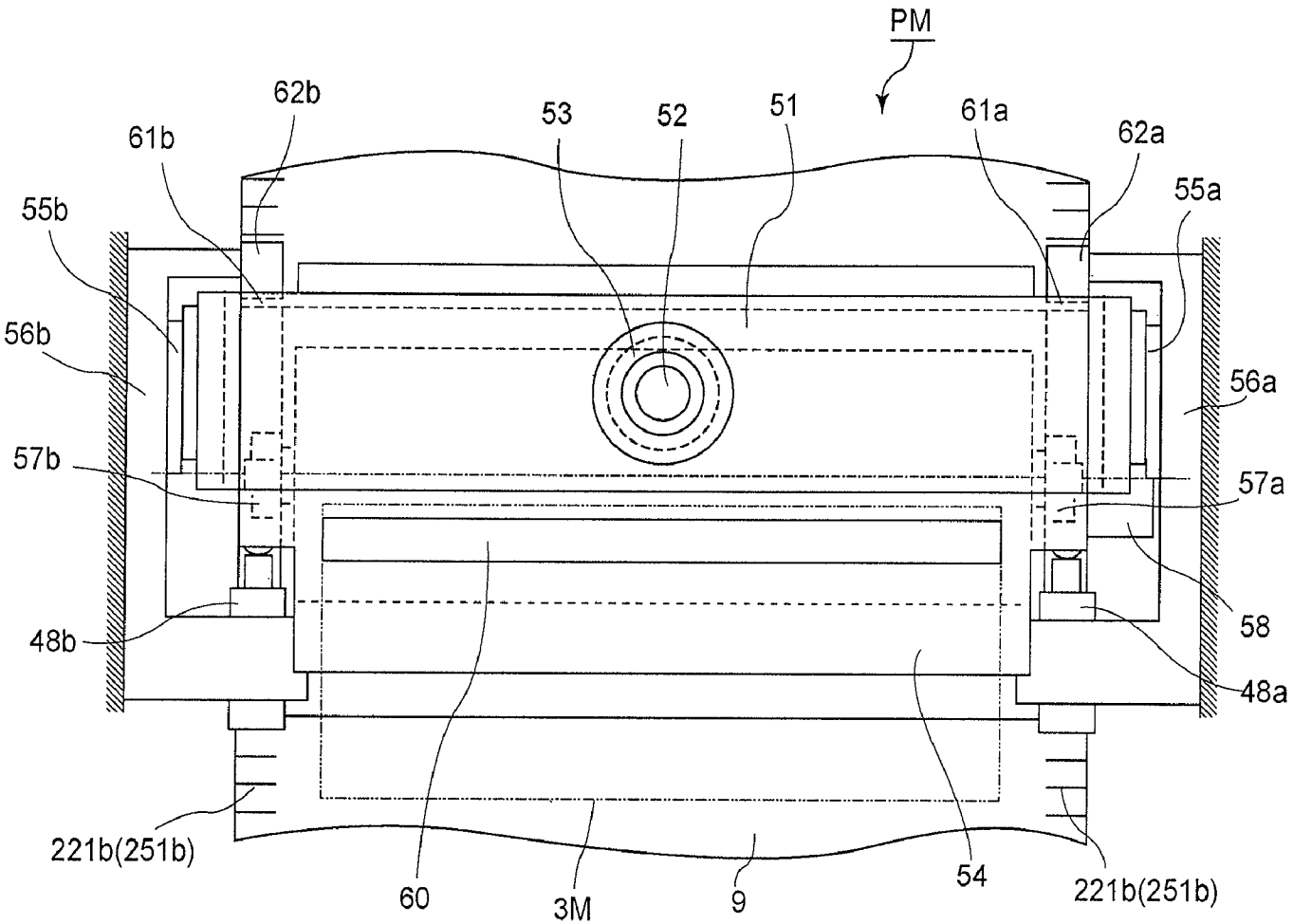

FIG. 17 is a schematic view for illustrating inclination control of a photosensitive drum in Embodiment 3. FIGS. 18 to 20 are a side view, a front view, and a plan view, respectively, of an inclination adjusting mechanism for the photosensitive drum.

In Embodiment 1, the rotational speed of the photosensitive drum 1M is controlled so that the difference in count value between the conveying member position index (251: FIG. 5) and the second position index (222: FIG. 6) is zero. Further, the first position index and the second position index are magnetically recorded at the inner surfaces of the first image bearing member and the second image bearing member and the conveying member position index is magnetically recorded at the inner surface of the conveying member by being transcribed from the first position index.

Compared with this, in Embodiment 3, the inclination of the photosensitive drum 1M is controlled so that the difference in count value between the conveying member position index of the conveying member and the second position index of the second image bearing member is zero by moving a shaft of the photosensitive drum 1M in the rotational direction of the intermediary transfer belt by a minute distance. The second image bearing member is rotationally moved in a plane of the conveying member to eliminate inclination between the scanning line carried on the second image bearing member and the scanning line carried on the conveying member. Further, the first position index and the second position index constitute both side end portions of scanning lines for an electrostatic image on the first image bearing member and the electrostatic image is written and developed with toner to be formed on the first image bearing member.

The conveying member position index is provided in a pair at both end positions with respect to a widthwise direction perpendicular to the movement direction of the conveying member by transferring a pair of first position indices onto the conveying member at the primary transfer portion TY as the example of the first transfer portion.

In Embodiment 3, other constitutions are basically identical to those in Embodiment 1, thus being omitted from illustration and redundant explanation. Further, with respect to the members used in Embodiment 1, those disposed on a front side are represented by reference numerals or symbols with a suffix a and those disposed on a rear side are represented by reference numerals or symbols with a suffix b.

As shown in FIG. 17, on the front side of the intermediary transfer belt 9, a first position index 221*a* formed on the photosensitive drum 1Y is transferred, so that a conveying member position index 251*a* is formed. On the rear side of the intermediary transfer belt 9, a first position index 221*b* formed on the photosensitive drum 1Y is transferred, so that a conveying member position index 251*b* is formed.

The first position indices 221*a* and 221*b* are written in the photosensitive drum (1Y: FIG. 3) as the front and rear end portions of the scanning line to be written outside a maximum size image by the exposure device (3Y: FIG. 2) and are developed by the developing device 4Y. However, when the first position indices 221*a* and 221*b* are formed with respect to all the scanning lines, a solid image is formed, so that the scanning lines cannot be discriminated. For this reason, the first position indices 221*a* and 221*b* are formed at a rate of a first position index per three scanning lines.

The first position indices 221*a* and 221*b* are disposed with a spacing of 84 μm in which a toner image of 42 μm is arranged. Further, as shown in FIG. 4, long start indices 211*a* and 211*b* and end indices 231*a* and 231*b* are formed correspondingly to the image area. The start indices 211*a* and 211*b* and2K, exposure devices 3M, 3C and 3K the end indices 231*a* and 231*b* are primary-transferred onto the intermediary transfer belt 9 to provide start indices 241*a* and 241*b* and end indices 261*a* and 261*b*, respectively, as shown in FIG. 5.

As shown in FIG. 1, after completion of control, the conveying member position indices 251*a* and 251*b* are superposed with second position indices 222*a* and 222*b* transferred at the primary transfer portion TM and are conveyed to the secondary transfer portion T2. Then, the conveying member position indices 251*a* and 251*b* are secondary-transferred from the intermediary transfer belt 9 onto the secondary transfer roller 11 and then are removed by an unshown secondary transfer roller cleaning device provided to the secondary transfer roller.

Readers 32Ma and 32Mb for detecting the second position indices 222*a* and 222*b* are equidistantly disposed from the primary transfer portion TM at positions between the developing device (4M: FIG. 2) disposed along the photosensitive drum 1M and the primary transfer portion TM.

A distance from the primary transfer portion TM to a reader 35Ma (35Mb) along the intermediary transfer belt 9 is equal to a distance from the primary transfer portion TM to the reader 32Ma (32Mb) along the photosensitive drum 1M. As a result, the second position index 222*a* (222*b*) and a corresponding conveying member position index 251*a* (251*b*) detected simultaneously by the reader 32Ma (32Mb) and the reader 35Ma (35Mb) are superposed with each other at the primary transfer portion TM.

Therefore, a drum shifting actuator 48*a* is controlled in shift amount so that a difference between a count value of the second position index 222*a* detected by the reader 32Ma and a count value of the conveying member position index 251*a* detected by the reader 35Ma is zero. Further, a drum shifting actuator 48*b* is controlled in shift amount so that a difference between a count value of the second position index 222*b* detected by the reader 32Mb and a count value of the conveying member position index 251*b* detected by the reader 35Mb is zero. In this embodiment, the drum shifting actuator 48*a* constitutes an detecting device for adjusting a position of the photosensitive drum with respect to the intermediary transfer belt movement direction (the conveying member movement direction) in order to prevent the color deviation.

As a result, differences in diameter of the photosensitive drum 1Y, diameter of the photosensitive drum 1M, travelling (moving) speed of the intermediary transfer belt 9, amount of expansion and contraction, and the like between the front side and the rear side are accurately corrected to precisely superpose the second color toner image on the first color toner image.

As shown in FIG. 18, the photosensitive drum 1M is supported at both end portions of an U-shaped process unit chassis 54 through bearings 57*a* and 57*b* for both end shafts of the photosensitive drum 1M.

One of the shafts of the photosensitive drum 1M is connected to a drum driving unit 58 supported by the process unit chassis 54, so that the photosensitive drum 1M is rotationally driven by the drum driving unit 58.

The reader 35Ma (35Mb) for detecting the conveying member position index 251*a* (251*b*) and the reader 32Ma (32Mb) for detecting the second position index 222*a* (222*b*) are fixed to one end of a supporting member 59*a* (59*b*). The other end of the supporting member 59*a* (59*b*) is fixed to a side chassis 56*a* (56*b*).

In Embodiment 3, the reader 35Ma (35Mb) and the reader 32Ma (32Mb) are disposed upstream of the primary transfer portion TM but may also be disposed beside the transfer device 5M correspondingly to the primary transfer portion TM.

As shown in FIG. 19, laser light emitted from the exposure device 3M passes through an opening 60 of the process unit chassis 54 and scans the surface of the photosensitive drum 1M. The process unit chassis 54 is moved by being driven by the drum shifting actuators 48*a* and 48*b*.

To the process unit chassis 54, around the photosensitive drum 1M, the charging device 2M, the exposure device 3M, the developing device 4M, the primary transfer device 5M, and the cleaning device 6M are provided with a fixed positional relationship. For this reason, the charging device 2M, the exposure device 3M, the developing device 4M, the primary transfer device (roller) 5M, and the cleaning device 6M are driven by the drum shifting actuators 48*a* and 48*b* to be moved together with the photosensitive drum 1M. By keeping a positional relationship between these devices and the photosensitive drum 1M at a constant level, an image forming condition is not changed, so that stable image formation can be carried out.

The image forming station PM is rotatably supported by an U-shaped intermediary movable chassis 51 through a bearing 53. At an upper central portion of the process unit chassis 54, a bearing shaft 52 is provided.

At portions of side chassis 56*a* and 56*b* located opposite to the drum shifting actuators 48*a* and 48*b*, compression springs 63*a* and 63*b* for urging the process unit chassis 54 toward the drum shifting actuators 48*a* and 48*b* are provided.

As shown in FIG. 20, the intermediary movable chassis 51 is supported at its both end portions by the side chassis 56*a* and 56*b*, respectively, through linear guides 55*a* and 55*b* movable only in the rotational direction of the intermediary transfer belt 9.

The side chassis 56*a* and 56*b* are fixed to an unshown apparatus main assembly chassis, so that the intermediary movable chassis 51 is movable in parallel to the rotational direction of the intermediary transfer belt 9.

Both ends of the image forming station PM including the photosensitive drum 1M are independently movable in the rotational direction of the intermediary transfer belt 9, so that the photosensitive drum 1M is not only translatable in the rotational direction of the intermediary transfer belt 9 but also changeable in inclination angle in a plane of the intermediary transfer belt 9.

Above the side chassis 56*a* and 56*b*, displacement sensors 62*a* and 62*b* for measuring displacement of displacement measuring surfaces 61*a* and 61*b* of the process unit chassis 54 are provided. The displacement sensors are provided at both ends of the image forming station PM and outputs are fed back to the drum shifting actuators 48*a* and 48*b*, so that high-precision positional control of the image forming station PM is performed.

In the case where the rotational shaft of the photosensitive drum 1M is shift-controlled along the intermediary transfer belt 9, the exposure position of the photosensitive drum 1M by the exposure device 3M is influenced. However, a change due to this influence is also recorded in the photosensitive drum 1M as the second position index, so that even when the influenced magenta toner image reaches the primary transfer portion TM, the magenta toner image can be accurately superposed on the yellow toner image.

Embodiment 4

Figure 21:
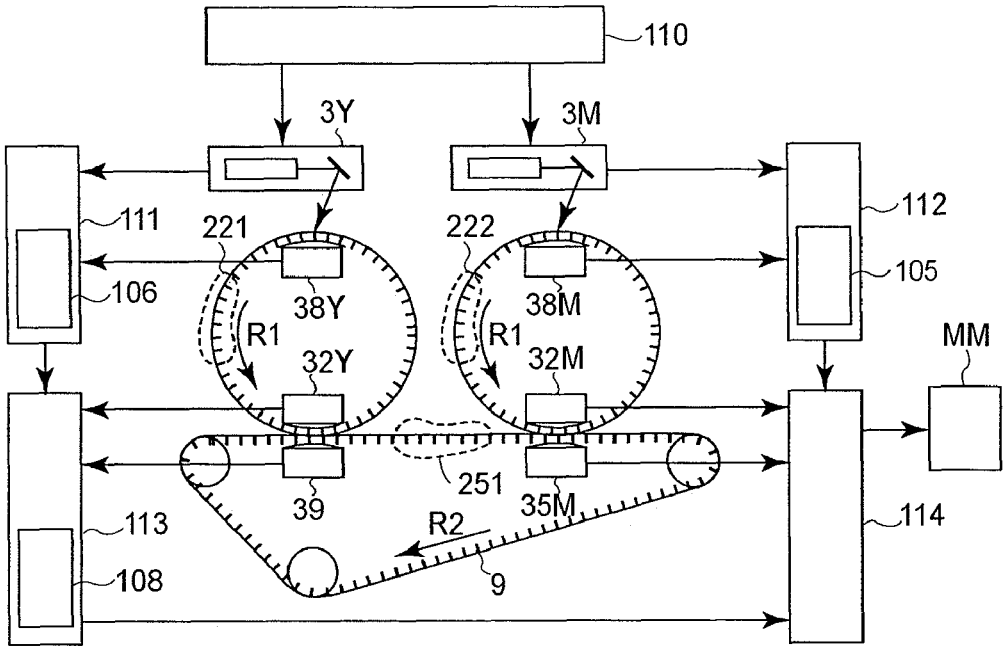
FIG. 21 is a schematic view for illustrating a constitution used in control in Embodiment 4.
Figure 22:
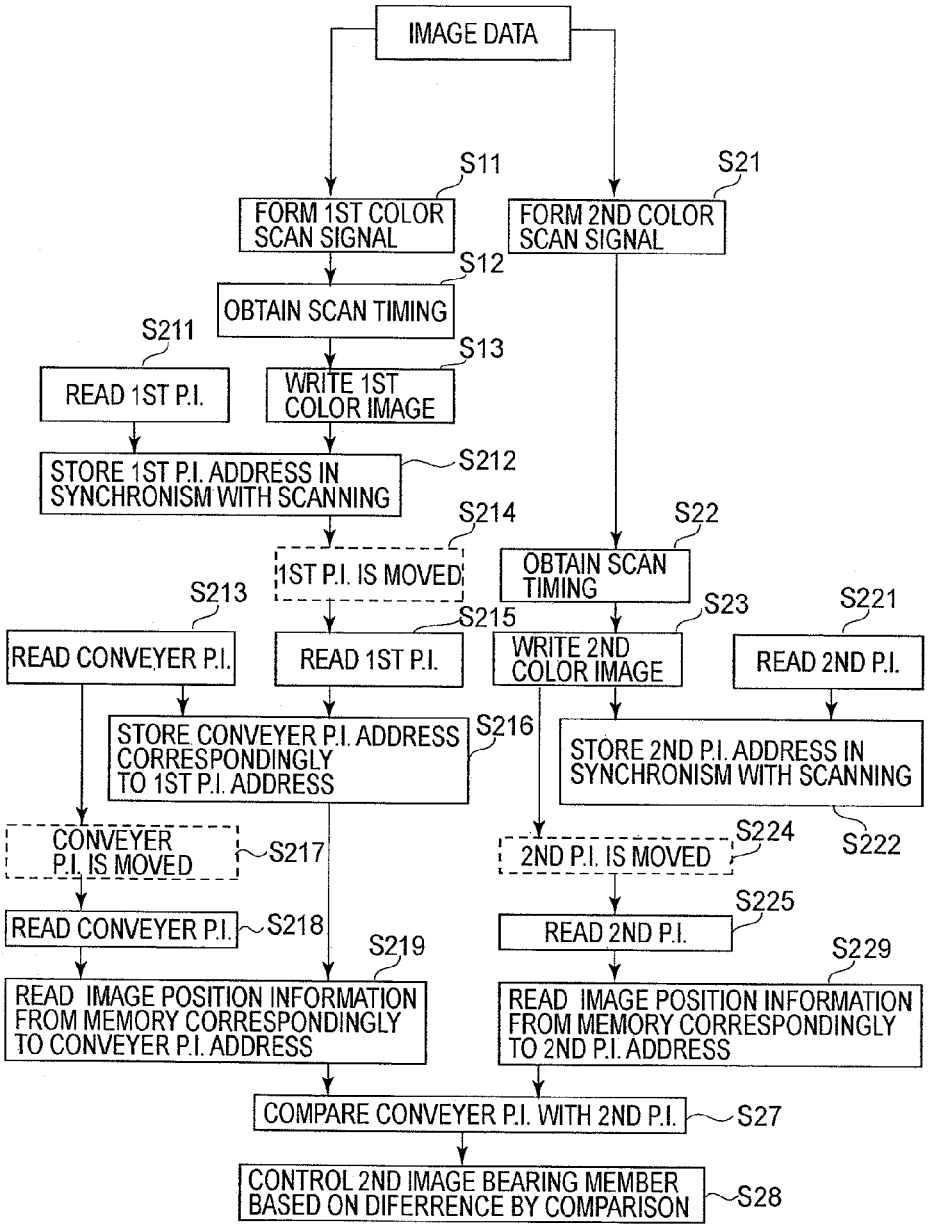
FIG. 22 is a block diagram for illustrating an outline of the control in Embodiment 4.

FIG. 21 is a schematic view for illustrating a constitution used in control in Embodiment 4 and FIG. 22 is a block diagram for illustrating an outline of the control in Embodiment 4.

In Embodiment 1, for each writing of the scanning line, the first position index, the second position index, and the conveying member position index are newly formed correspondingly to the position of the scanning line and after use, the first position index and the second position index are erased.

In Embodiment 4, the first position index is prepared in advance with respect to the first image bearing member as a fixed scale arranged in the rotational direction of the first image bearing member and fixed scale detecting means detects the fixed scale of the first position index for each formation of the scanning line. An address of the first position index using the fixed scale is stored in storing means.

Further, the second position index is prepared in advance with respect to the second image bearing member as a fixed scale arranged in the rotational direction of the second image bearing member and fixed scale detecting means detects the fixed scale of the second position index for each formation of the scanning line. An address of the second position index using the fixed scale is stored in storing means.

Further, the conveying member position index is prepared in advance with respect to the conveying member as a fixed scale arranged in the movement direction of the conveying member and fixed scale detecting means detects the fixed scale of the conveying member position index in synchronism with the fixed scale of the first position index. An address of the first position index using the fixed scale is stored in storing means correspondingly to an address of the conveying member position index using the fixed scale. As described above, any of the position indices is fixedly disposed.

In Embodiment 5, other constitutions are basically identical to those in Embodiment 1, thus being omitted from illustration and redundant explanation.

As shown in FIG. 21, fixed first position indices 221 are attached to or engraved on the photosensitive drum 1Y with one full circumference. Similarly, fixed second position indices 222 are attached to or engraved on the photosensitive drum 1M with one full circumference. Similarly, fixed conveying member position indices 251 are attached to or engraved on the intermediary transfer belt 9 with one full circumference.

The first position indices 221, the second position indices 222 and the conveying member position indices 251 are formed by a method such as affixation of a tape-like scale, printing of a scale, or engraving.

In the control in Embodiment 4, in order to recognize the positions of the photosensitive drums 1Y and 1M and the intermediary transfer belt 9 with respect to the surface rotational direction, the scale is an absolute encoder pattern or an incremental encoder pattern having an origin index. In the case of the absolute encoder pattern, the reader 38Y reads a scale of the first position index 221 fixed on the photosensitive drum 1Y and outputs an absolute address. In the case of the incremental encoder pattern with the origin index, the reader 38Y reads the scale of the first position index 221 fixed on the photosensitive drum 1Y and outputs a scale count value from the origin.

In the case where these patterns have a track of an incremental optical pattern, the track can be constituted by the angular scales 42Y and 42M shown in FIG. 16, thus being readable by the readers 41Y and 41M.

Therefore, it is possible to output positional information divided into 64 pieces or 128 pieces by signal-processing two analog signals read from a 100 μm-period (pitch) optical pattern at positions shifted by ¼ period.

As shown in FIG. 22 with reference to FIG. 21, an address of the first position index 221 is converted into an address of the conveying member position index 251 and is positionally aligned with an address of the second position index 222, so that a scanning line deviation between the yellow toner image and the magenta toner image is eliminated.

The control portion 110 prepares scanning line data by expanding respective color images (S11, S21).

The exposure device 3Y writes an electrostatic image on the photosensitive drum 1Y by using scanning line data for a yellow image (S12, S13).

The exposure device 3M writes an electrostatic image on the photosensitive drum 1M by using scanning line data for a magenta image (S22, S23).

The first position index recording portion 111 controls the reader 38Y to read the first position index 221, thus forming an address of the photosensitive drum 1Y moment by moment (S211).

The first position index recording portion 111 stores the address of the photosensitive drum lY using the first position index 221 in a memory 106 in synchronism with scanning timing of the exposure device 3Y (S212). Addresses of the photosensitive drum lY foamed from the fixed first position index and the position numbers of the scanning lines for the yellow toner image formed by counting a raster scanning timing signal from the exposure device 3Y are stored in the memory 106 in a one-to-one relationship.

TABLE 1

| 1ST DRUM ADDRESS | 1ST IMAGE POSITION INFORMATION |
|---|---|
| 99 | 1 |
| 1010 | 2 |
| 1020 | 3 |
| 1029 | 4 |
| 1039 | 5 |
| 1051 | 6 |
| 1060 | 7 |
| 1069 | 8 |
| 1081 | 9 |
| 1091 | 10 |
| 2000 | 11 |
| 2010 | 12 |
| 2019 | 13 |
| 2031 | 14 |
| 2040 | 15 |
| 2049 | 16 |
| 2061 | 17 |
| 2071 | 18 |
| . | . |
| . | . |
| . | . |

The second position index recording portion 112 controls the reader 38M to read the second position index 222, thus forming an address of the photosensitive drum 1M moment by moment (S221).

The second position index recording portion 112 stores the address of the photosensitive drum 1M using the second position index 222 in a memory 105 in synchronism with scanning timing of the exposure device 3M (S222). Addresses of the photosensitive drum 1M formed from the fixed second position index and the position numbers of the scanning lines for the magenta toner image formed by counting a raster scanning timing signal from the exposure device 3M are stored in the memory 105 in a one-to-one relationship.

TABLE 2

| 2ND DRUM ADDRESS | 2ND IMAGE POSITION INFORMATION |
|---|---|
| 1056 | 1 |
| 1066 | 2 |
| 1075 | 3 |
| 1086 | 4 |
| 1097 | 5 |
| 1106 | 6 |
| 1115 | 7 |
| 1124 | 8 |
| 1136 | 9 |
| 1145 | 10 |
| 1154 | 11 |
| 1164 | 12 |
| 1175 | 13 |
| 1187 | 14 |
| 1195 | 15 |
| 2004 | 16 |
| 2014 | 17 |
| 2025 | 18 |
| . | . |
| . | . |
| . | . |

Incidentally, in the case where times of a scale reading signal and the raster scanning signal from the readers 38Y and 38M do not coincide with each other, an address for a scale reading signal immediately before or immediately after the raster scanning signal is stored correspondingly to the position number for the raster scanning signal. It is also possible to selectively store an address for a scale reading signal, immediately before or immediately after the raster scanning signal, closer to the raster scanning signal.

Further, similarly as in Embodiment 1, in the case where there is time delay (error) of the reading by the readers 38Y and 38M, the error can be eliminated by shifting and disposing the readers 38Y and 38M toward a downstream side by a distance corresponding to the error. Alternatively, the error can also be eliminated by using a method in which the position number is stored correspondingly to an address read at a time before the time delay by the delayed time.

By the rotation of the photosensitive drum 1Y, the first position index 221 is moved together with the yellow image scanning line (S214) and is detected by the reader 32Y (S215).

The conveying member position index recording portion 113 controls the reader 39 to read the conveying member position index 251, thus forming an address of the intermediary transfer belt 9 moment by moment (S213).

At the primary transfer portion (TY: FIG. 1) at which the photosensitive drum 1Y contacts the intermediary transfer belt 9, the reader 32Y reads the first position index 221 and the reader 39 reads the conveying member position index 251.

The conveying member position index recording portion 113 processes a reading signal from the reader 32Y and outputs an absolute address when the first position index 221 is the absolute encoder pattern or outputs a scale count value from the origin when the first position index 221 is the incremental encoder pattern with the origin.

The conveying member position index recording portion 113 processes a reading signal from the reader 39 and outputs an absolute address when the conveying member position index 251 is the absolute encoder pattern or outputs a scale count value from the origin when the conveying member position index 251 is the incremental encoder pattern with the origin.

The conveying member position index recording portion 113 stores an address of the intermediary transfer belt 9 using the conveying member position index 251 in a memory 108 in synchronism with detection timing of the first position index 221 (S216). As a result, addresses of the photosensitive drum 1Y formed from the first position index 221 and addresses of the intermediary transfer belt 9 formed from the conveying member position index 251 are stored in the memory 108 in a one-to-one relationship.

TABLE 3

| 1ST DRUM ADDRESS | BELT ADDRESS |
|---|---|
| 999 | 12528 |
| 1010 | 12538 |
| 1020 | 12547 |
| 1029 | 12558 |
| 1039 | 12569 |
| 1051 | 12580 |
| 1060 | 12589 |
| 1069 | 12600 |
| 1081 | 12609 |
| 1091 | 12621 |
| 2000 | 12630 |
| 2010 | 12640 |
| 2019 | 12651 |
| 2031 | 12661 |
| 2040 | 12670 |
| 2049 | 12679 |

TABLE 3-continued

| 1ST DRUM ADDRESS | BELT ADDRESS |
|---|---|
| 2061 | 12688 |
| 2071 | 12699 |
| . | . |
| . | . |
| . | . |

The conveying member position index recording portion 113 associates the yellow toner image (the scanning line (position) number) with the address of the intermediary transfer belt 9 by making reference to the memory 106 in the first position index recording portion 111 (S216).

Data of Table 1 are retrieved from the memory and then the pieces of the position information of the yellow toner image and the addresses of the intermediary transfer belt 9 are brought into correspondence with each other.

TABLE 4

| BELT ADDRESS | 1ST IMAGE POSITION INFORMATION |
|---|---|
| 12528 | 1 |
| 12538 | 2 |
| 12547 | 3 |
| 12558 | 4 |
| 12569 | 5 |
| 12580 | 6 |
| 12589 | 7 |
| 12600 | 8 |
| 12609 | 9 |
| 12621 | 10 |
| 12630 | 11 |
| 12640 | 12 |
| 12651 | 13 |
| 12661 | 14 |
| 12670 | 15 |
| 12679 | 16 |
| 12688 | 17 |
| 12699 | 18 |
| . | . |
| . | . |
| . | . |

By the rotation of the intermediary transfer belt 9, the conveying member position index 251 is moved together with the scanning line for the yellow image (S217) and detected by the reader 35M (S218). By the rotation of the photosensitive drum 1M, the second position index 222 is moved together with the scanning line for the magenta image (S224) and detected by the reader 32M (S225).

At the primary transfer portion (TM: FIG. 1) at which the photosensitive drum 1M contacts the intermediary transfer belt 9, the reader 32M reads the second position index 222 and the reader 35M reads the conveying member position index 251.

The speed control portion 114 compares detection timing of the second position index 222 detected (S229) by the reader 32M with detection timing of the conveying member position index 251 (S219) detected by the reader (S27).

The speed control portion 114 retrieves data of Table 2 from the memory 105 in the second position index recording portion 112 and retrieves data of Table 4 from the memory 108 in the conveying member position index recording portion 113. Then, with each timing of detection of the conveying member position index 251 by the reader 35M, the speed control portion 114 compares the position information of the yellow toner image with the position information of the magenta toner image and controls the driving motor MM by a control signal corresponding to an amount of positional deviation.

The speed control portion 114 controls the rotation of the photosensitive drum 1M so that the position information of the yellow toner image and the position information of the magenta toner image coincide with each other, thus accurately superposing the magenta toner image on the yellow toner image.

The data stored in the memory 106 is erased immediately after being read by the conveying member position index recording portion 113. Therefore, in the memory 106, only the data for the scanning lines from the exposure position of the photosensitive drum 1Y to the primary transfer portion TY are retained.

The data stored in the memory 105 is erased immediately after being read by the speed control portion 114. Therefore, in the memory 105, only the data for the scanning lines from the exposure position of the photosensitive drum 1M to the primary transfer portion TM are retained.

The data stored in the memory 108 is erased immediately after being read by the speed control portion 114. Therefore, in the memory 108, only the data for the scanning lines from the exposure position of the photosensitive drum 1Y to the primary transfer portion TM through the primary transfer portion TY are retained.

The control in Embodiment 4 using the first position index, the second position index, and the conveying member position index which are fixed patterns can also be carried out by the control in Embodiment 3 in which the photosensitive drum 1M is moved along the intermediary transfer belt 9.

Further, only the first position index and the second position index are subjected to the control in Embodiment 4 as the fixed patterns, while the conveying member position index may be subjected to the control in Embodiment 1 in which the conveying member position index is recorded every detection of the first position index and is erased after use.

Further, only the first position index and the conveying member position index are subjected to the control in Embodiment 4 as the fixed patterns, while the second position index may be subjected to the control in Embodiment 3 in which the second position index is recorded as the toner image outside the image area of the photosensitive drum 1M.

On the other hand, it is also possible to use the first position index and the conveying member position index as a pattern to be recorded and erased and to use the second position index as the fixed pattern.

Thus, the fixed pattern and the recording/erasing pattern can be various combinations, so that a system can be designed in an optimum combination in consideration of a performance, cost, and the like of the image forming apparatus.

Embodiment 5

Figure 43:
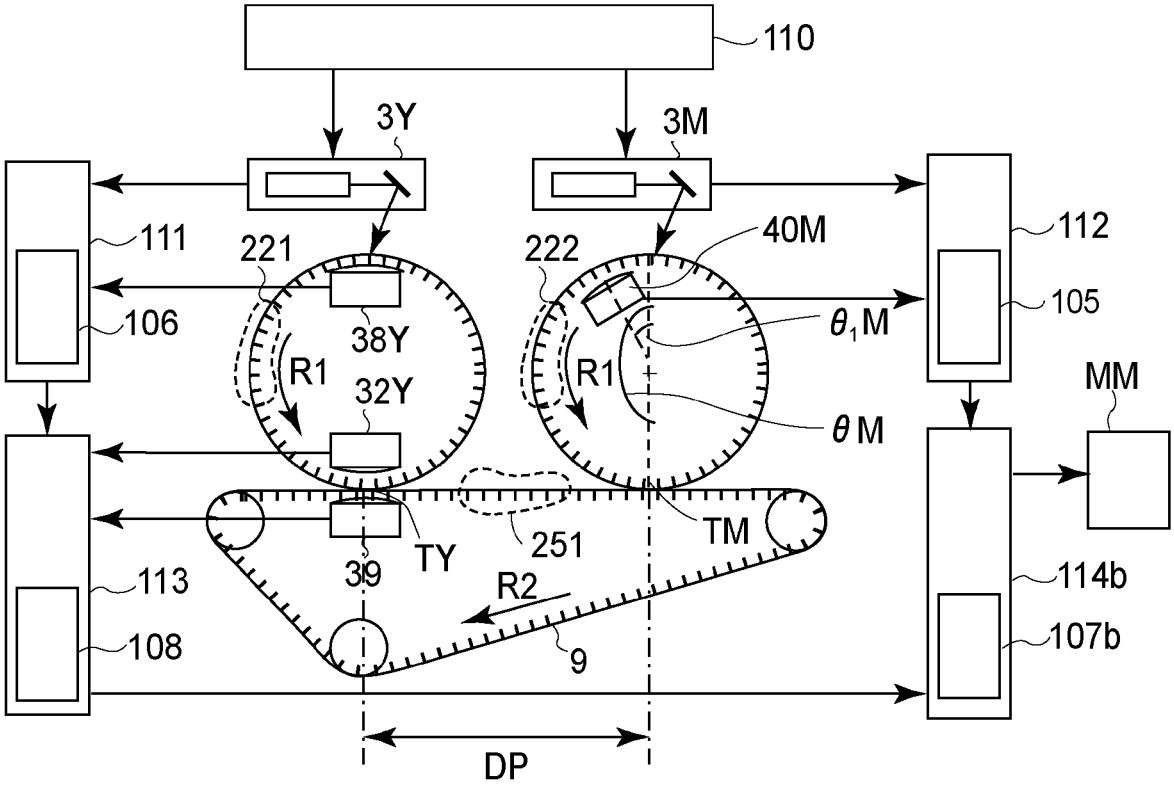
FIG. 43 is a schematic view for illustrating a constitution used in control in Embodiment 5.

FIG. 43 is a schematic view for illustrating a constitution used in control in Embodiment 5.

In Embodiment 4, the reader for the second position index is provided each of the portion close to the electrostatic image writing position on the photosensitive drum by the exposure device and the portion close to the primary transfer portion, thus being provided at two portions in total with respect to the photosensitive drum.

In Embodiment 5, the reader for the second position index is a single reader provided at a predetermined position with respect to the photosensitive drum.

In Embodiment 5, other constitutions are basically identical to those in Embodiment 4, thus being omitted from illustration and redundant explanation.

As shown in FIG. 43, to the photosensitive drum 1M, a reader 40M is provided at a position with an angle $\theta_1$M from the electrostatic image writing position on the photosensitive drum 1M by the exposure device 3M. Incidentally, an angle from the electrostatic image writing position on the photosensitive drum 1M by the exposure device 3M to the primary transfer portion (TM) at which the photosensitive drum 1M contacts the intermediary transfer belt 9 is θM.

Further, the primary transfer portion (TY) at which the photosensitive drum 1Y contacts the intermediary transfer belt 9 and the primary transfer portion (TM) at which the photosensitive drum 1M contacts the intermediary transfer belt 9 are spaced with a predetermined distance DP.

The second position index recording portion 112 controls the reader 40M to read the second position index 222, thus forming an address of the photosensitive drum 1M moment by moment (S121).

The second position index recording portion 112 stores the address of the photosensitive drum 1M using the second position index 222 in a memory 105 in synchronism with scanning timing of the exposure device 3M (S122). At this time, the angle $\theta_1$M has already been specified, so that the second position index located at the electrostatic image writing position is calculated. Addresses of the photosensitive drum 1M formed from the second position index and the position numbers of the scanning lines for the magenta toner image formed by counting a raster scanning timing signal from the exposure device 3M are stored in the memory 105 in a one-to-one relationship (Table 2).

Incidentally, similarly as in Embodiment 4, in the case where times of a scale reading signal and the raster scanning signal from the reader 40M do not coincide with each other, an address for a scale reading signal immediately before or immediately after the raster scanning signal is stored correspondingly to the position number for the raster scanning signal. It is also possible to selectively store an address for a scale reading signal, immediately before or immediately after the raster scanning signal, closer to the raster scanning signal.

Further, in the case where there is time delay (error) of the reading by the reader 40M, the error can be eliminated by calculating the second position index located at the electrostatic image writing position in consideration of only a distance corresponding to the error. Alternatively, the error can also be eliminated by using a method in which the position number is stored by calculating the second position index located at the electrostatic image writing position correspondingly to an address read at a time before the time delay by the delayed time.

Similarly as in Embodiment 4, the conveying member position index recording portion 113 associates the yellow toner image (the scanning line (position) number) with the address of the intermediary transfer belt 9 by making reference to the memory 106 in the first position index recording portion 111.

Data of Table 1 are retrieved from the memory and then the pieces of the position information of the yellow toner image and the addresses of the intermediary transfer belt 9 are brought into correspondence with each other (Table 4).

With respect to the second drum addresses and the belt addresses to be stored during preparation of Tables 2 and 4, target addresses to be controlled for eliminating scanning line deviation between the yellow toner image and the magenta toner image are set for each predetermined scanning timing. That is, of the second drum addresses stored every moment corresponding to the second image position information and the belt addresses corresponding to the first image position information, addresses to be stored for each predetermined scanning timing are stored in the memory 105 and the memory 108 as target addresses TGM and TGI (Tables 5 and 6).

TABLE 5

| 2ND DRUM TARGET ADDRESS | 2ND DRUM ADDRESS | 2ND IMAGE POSITION INFORMATION |
|---|---|---|
| TGM1 (=1056) | 1056 | 1 |
| — | 1066 | 2 |
| — | 1075 | 3 |
| — | 1086 | 4 |
| — | 1097 | 5 |
| TGM2 (=1106) | 1106 | 6 |
| — | 1115 | 7 |
| — | 1124 | 8 |
| — | 1136 | 9 |
| — | 1145 | 10 |
| TGM3 (=1154) | 1154 | 11 |
| — | 1164 | 12 |
| — | 1175 | 13 |
| — | 1187 | 14 |
| — | 1195 | 15 |
| TGM4 (=2004) | 2004 | 16 |
| — | 2014 | 17 |
| — | 2025 | 18 |
| . | . | . |
| . | . | . |
| . | . | . |

TABLE 6

| BELT TARGET ADDRESS | BELT ADDRESS | 1ST IMAGE POSITION INFORMATION |
|---|---|---|
| TGI1 (=12528) | 12528 | 1 |
| — | 12538 | 2 |
| — | 12547 | 3 |
| — | 12558 | 4 |
| — | 12569 | 5 |
| TGI2 (=12580) | 12580 | 6 |
| — | 12589 | 7 |
| — | 12600 | 8 |
| — | 12609 | 9 |
| — | 12621 | 10 |
| TGI3 (=12630) | 12630 | 11 |
| — | 12640 | 12 |
| — | 12651 | 13 |
| — | 12661 | 14 |
| — | 12670 | 15 |
| TGI4 (=12679) | 12679 | 16 |
| — | 12688 | 17 |
| — | 12699 | 18 |
| . | . | . |
| . | . | . |
| . | . | . |

By the rotation of the intermediary transfer belt 9, the conveying member position index 251 is moved together with the scanning line for the yellow image. At this time, from the information of Table 6, the distance DP between the primary transfer portions, and the absolute addresses detected by the reader 39, it is possible to obtain where the target address TGI is located between the primary transfer portion (TY) and the primary transfer portion (TM). As a result, the position of the target address TGI is calculated as a distance LI from the primary transfer portion (TM).

Further, by the rotation of the photosensitive drum 1M, the second position index 222 is moved together with the scanning line for the magenta image. At this time, from the information of Table 5, the angle θM from the electrostatic image writing position on the photosensitive drum 1M by the exposure device 3M, and the absolute addresses detected by the reader 40M, it is possible to obtain where the target address TGM is located between the electrostatic image writing position on the photosensitive drum 1M by the exposure device 3M and the primary transfer portion (TM). As a result, the target address TGM can be calculated as an angle θg from the primary transfer portion (TM).

Figure 44:
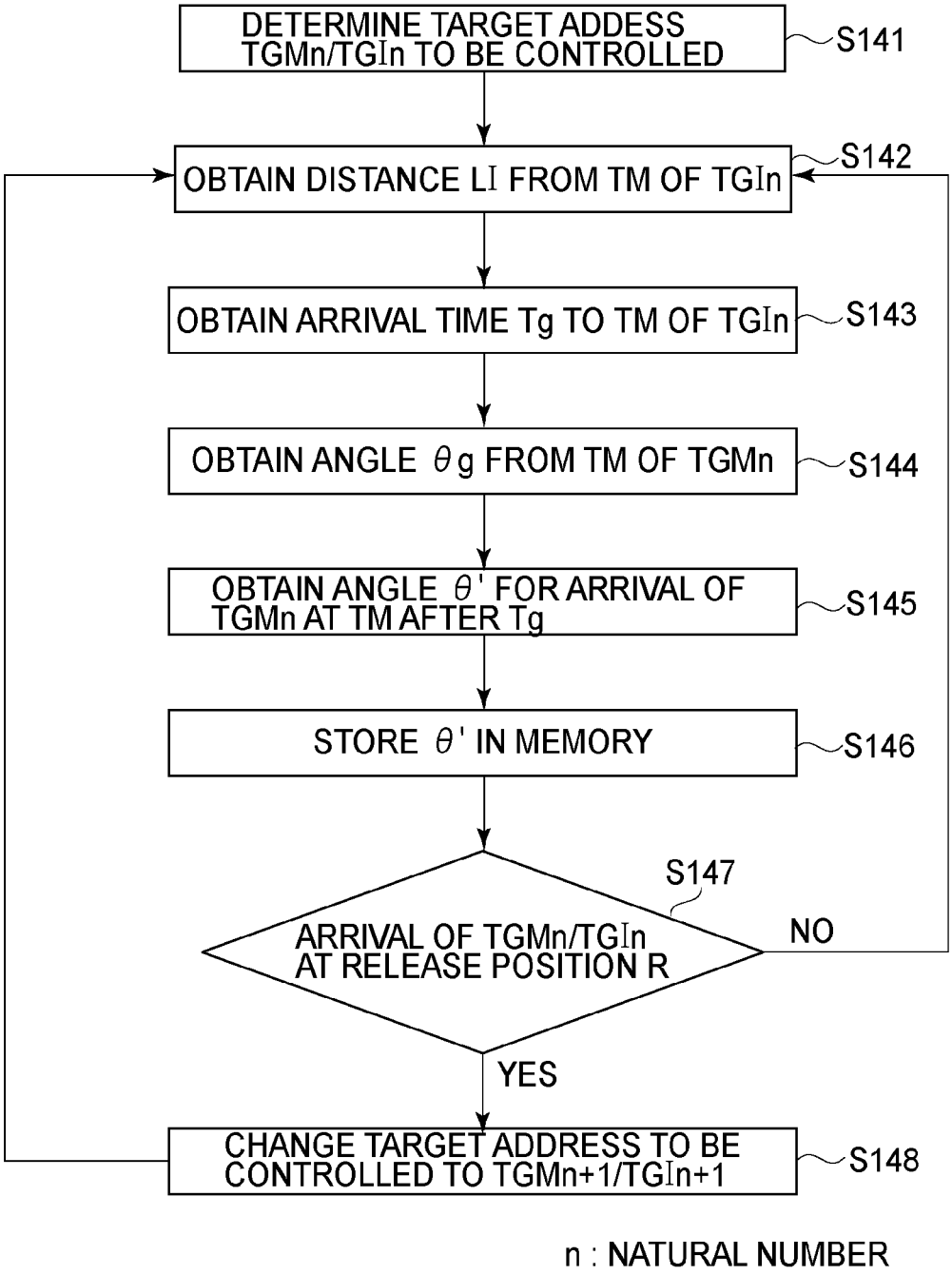
FIG. 44 is a flow chart showing an outline of the control in Embodiment 5.
Figure 45:
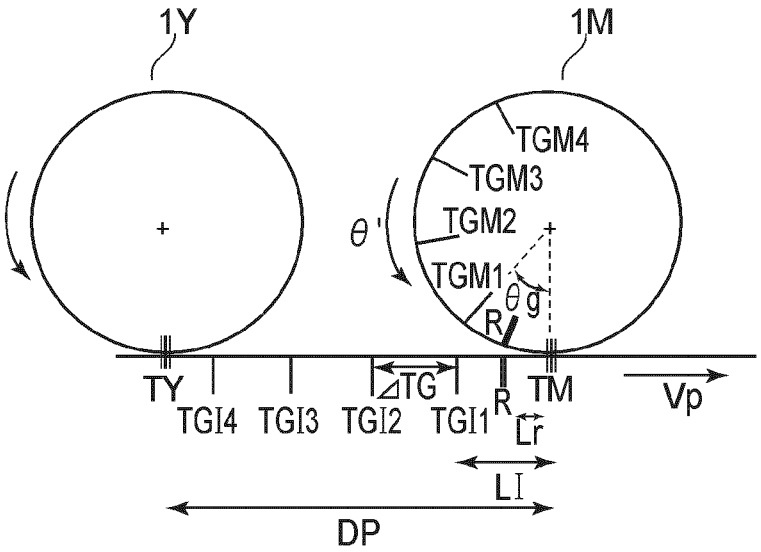
FIG. 45 is a schematic view for illustrating the outline of the control in Embodiment 5.

FIG. 44 is a block diagram for illustrating an outline of the control in Embodiment 5 and FIG. 45 is a schematic view for illustrating the outline of the control in Embodiment 5.

In the control in this embodiment, the following process is performed every determined sampling time.

First, each of starting target addresses TGM1 and TGI1 is recognized as a first address to be controlled (S141).

A distance LI of the target address TGI1 from the current primary transfer portion (TM) on the intermediary transfer belt 9 is obtained (S142).

From the distance LI and an average moving speed Vp of the intermediary transfer belt 9 (a process speed of the image forming apparatus), a time Tg at which the target address TGI1 reaches the primary transfer portion (TM) is obtained (S143).

Further, the angle θg of the target address TGM1 from the current primary transfer portion (TM) on the intermediary transfer belt 9 is obtained (S144).

From the time Tg obtained in the step S143, an angular speed of rotation θ' of the photosensitive drum 1M for causing the target address TGM1 to reach the primary transfer portion (TM) after lapse of the time Tg (S145).

The data is recorded in a memory 107*b* in a driving motor control portion 114*b* (S146).

The driving motor control portion 114*b* controls the driving motor MM so as to provide the angular angle of rotation θ' to the photosensitive drum 1M.

The process from the step S142 to the step S146 is performed every sampling time until either one or both of the target address TGM1 and TGI1 reach a release position R provided in advance at a position spaced apart from the primary transfer portion (TM) by a distance Lr (or an angle θr corresponding to the distance Lr). Then, the angular angle of rotation θ' of the photosensitive drum 1M is adjusted each time (NO of S147). That is, the release position (predetermined position) R on the conveying member is located upstream of the second transfer portion TM with respect to the conveying member movement direction. Further, the release position (predetermined position) R on the second image bearing member is located upstream of the second transfer portion TM with respect to the second image bearing member rotational direction.

When either one or both of the target addresses TGM1 and TGI1 reach the release position R (YES of S147), the target addresses TGM and TGI to be controlled are changed to second target addresses TGM2 and TGI2 (S148).

With respect to the target addresses TGM2 and TGI2, the control from the step S142 to the step S147 is carried out.

Further, when either one or both of the target addresses TGM2 and TGI2 reach the release position R, the target and addresses TGM and TGI to be controlled are changed to third target addresses TGM3 and TGI3. Thus, the target addresses TGM and TGI are switched every moment to adjust the angular speed of rotation θ', so that the scanning line deviation between the yellow toner image and the magenta toner image is eliminated.

Figure 46:
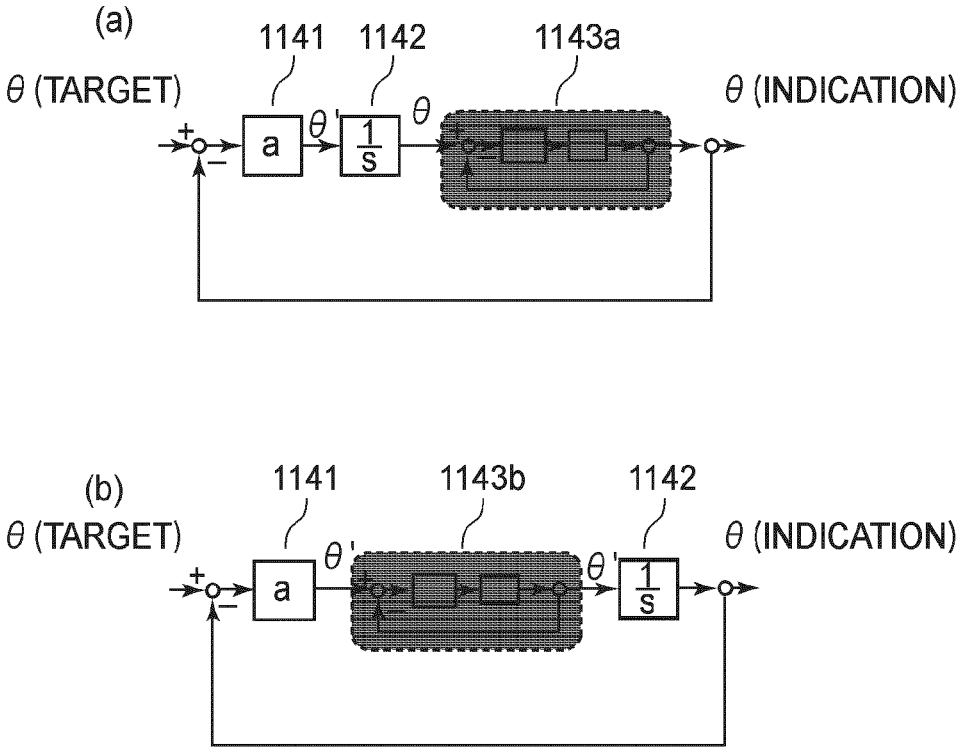
FIGS. 46(*a*) and 46(*b*) are schematic views for illustrating an outline of a driving motor control portion in Embodiment 5.

FIGS. 46(*a*) and 46(*b*) are block diagrams for illustrating an outline of the driving motor control portion in Embodiment 5.

The driving motor control portion 114*b* is, as shown in FIG. 46(*a*), constituted by using a control loop 1143*a* of a position control system. Scale information of the second position index 222, fixedly disposed on the photosensitive drum 1M, read by the reader 40 and an integral value of the angular speed of rotation θ' of the photosensitive drum 1M determined by the above-described process (a block 1141 shown in FIG. 46(*a*)) are sent to the control loop of the position control system. Then, based on comparison with a current position of the photosensitive drum 1M, the rotation of the photosensitive drum 1M is controlled by sending an instruction value for rotating the position of the photosensitive drum 1M in a desired amount to the driving motor MM.

Further, as shown in FIG. 46(*b*), the driving motor control portion 114*b* may also be constituted by using a control loop 1143*b* of a speed control system. An instruction value of an angular speed of rotation obtained by comparison between the determined angular speed of rotation θ' and a current angular speed of rotation is integrated. Then, from this integral value and scale information obtained by reading the fixed second position index 222 by the reader 40, an instruction value for rotating the position of the photosensitive drum 1M in a desired amount is obtained and sent to the driving motor MM to control the rotation of the photosensitive drum 1M.

Incidentally, the control system may also be, e.g., such that an encoder or the like for obtaining position information of the photosensitive drum 1M is prepared separately to control the angular speed of rotation θ' of the photosensitive drum 1M.

Here, when a servo bandwidth of the control loop 1143*a* of the position control system (or the control loop 1143*b* of the speed control system) of the driving motor control portion 114*b* is ωc, a distance of the release position R from the primary transfer portion (TM) is Lr, a set interval between the target addresses TGM and TGI (an interval between adjacent targets) is ΔTG, and an average moving speed of the intermediary transfer belt 9 is Vp, the following relationship is satisfied.

$$Vp/(Lr+\Delta TG)<\omega c$$

The left side is substantially equal to a value of the reciprocal of a first value for the time Tg in the case where the angular speed of rotation θ' of the photosensitive drum 1M at which target addresses TGMn+1 and TGIn+1 coincide with each other at the primary transfer portion (TM) when the target addresses to be controlled are switched from TGMn and TGIn to TGMn+1 and TGIn+1 is obtained.

In this embodiment, when the target addresses TGM and TGI are intended to coincide with each other at the primary transfer portion (TM), as shown in FIGS. 46(*a*) and 46(*b*), the angular speed of rotation θ' of the photosensitive drum 1M is controlled by being integrated by an integrator 1142. Therefore, when the reciprocal of the first value for the time Tg in the case of obtaining the angular speed of rotation θ' of the photosensitive drum 1M is started from a value not less than the servo bandwidth ωc of the control loop 1143*a* of the position control system (or the control loop 1143*b* of the speed control system), the system is dispersed, thus resulting in an uncontrollable state. Therefore, the reciprocal of the first value for the time Tg at least in the case of obtaining the angular speed of rotation θ' of the photosensitive drum 1M is determined so as to be smaller than the servo bandwidth ωc.

Embodiment 6

Figure 23:
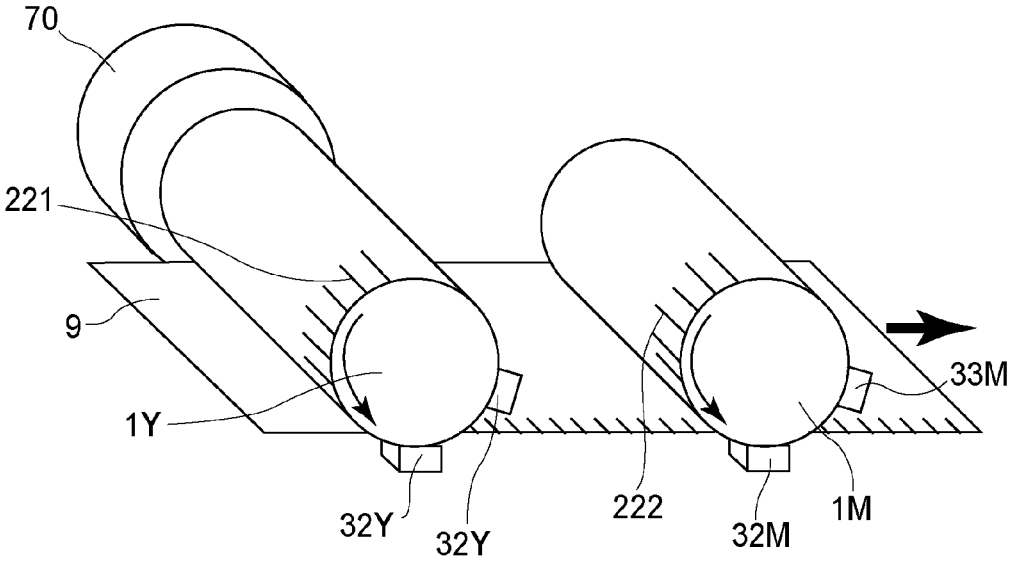
FIG. 23 is a schematic view for illustrating a constitution of an image forming apparatus of Embodiment 6.

FIG. 23 is a schematic view for illustrating a constitution of an image forming apparatus in Embodiment 6.

In Embodiment 6, inertial mass of the first image bearing member around its rotation shaft is larger than that of the second image bearing member. With respect to other constitutions, portions common to Embodiment 1 are represented by the same reference numerals or symbols and are omitted from redundant explanation.

In Embodiment 1 to Embodiment 5, with respect to the respective scanning lines for the first color toner image which is formed on the first image bearing member and is transferred onto the conveying member, a plurality of rotational speeds or abutting positions of the second image bearing member is changed and the respective scanning lines for the second color toner image are positioned and superposed. For this reason, it is desirable that rotation non-uniformity and peripheral speed fluctuation are less to result in stable rotation in the order of the first image bearing member, the conveying member, and the second image bearing member.

Further, in Embodiment 1, the peripheral speed of the second image bearing member varies depending on the detection timing of the conveying member position index of the conveying member but the rotational speed of the image bearing member may always be a constant peripheral speed.

As shown in FIG. 23, the photosensitive drum 1Y and the photosensitive drum 1M are formed in a cylindrical shape with the same outer diameter and are rotated on a rotational shaft disposed along a cylinder center line but the photosensitive drum 1Y is provided with a fixed flywheel 70 as additional inertial mass at an end thereof. For this reason, the photosensitive drum 1Y has moment of inertia larger than that of the photosensitive drum 1M during rotation, so that rotation control of the photosensitive drum 1Y is easily performed at a steadily constant rotational speed, i.e., a constant angular speed.

Further, the interval between scanning lines is changed when the peripheral speed is changed even at the constant angular speed of rotation, so that the photosensitive drum Y is precisely finished so that an amount of eccentricity of the rotation shaft is smaller than that of the photosensitive drum 1M.

On the other hand, the photosensitive drum 1M is not provided with the flywheel 70, thus having small moment of inertia and small inertial mass, so that the rotational speed of the photosensitive drum 1M can be quickly controlled depending on the change in rotational speed of the intermediary transfer belt 9. Further, the mass is small and therefore it is easy to control movement of the photosensitive drum 1M along the intermediary transfer belt 9.

Incidentally, a method of increasing the inertial mass of the photosensitive drum 1Y compared with the photosensitive drum 1M is not limited to a method in which the flywheel is connected to the photosensitive drum 1Y. It is also possible to achieve a similar effect by, e.g., increasing a diameter of the photosensitive drum 1Y compared with the photosensitive drum 1M or increasing a thickness of the photosensitive drum 1Y compared with the photosensitive drum 1M.

Embodiment 7

Figure 24:
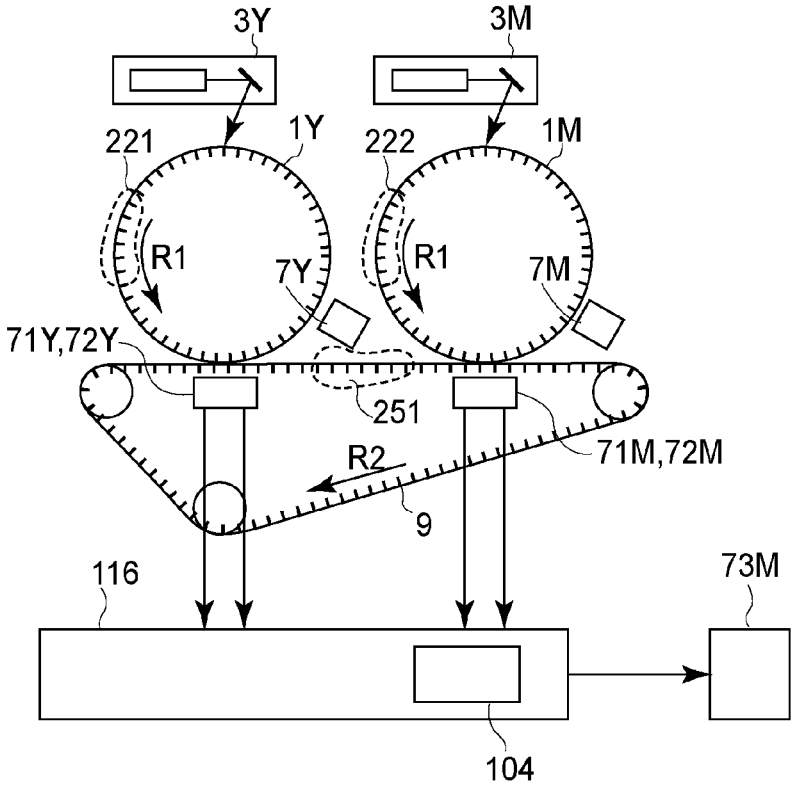
FIG. 24 is a schematic view for illustrating a constitution used in control in Embodiment 7.
Figure 25:
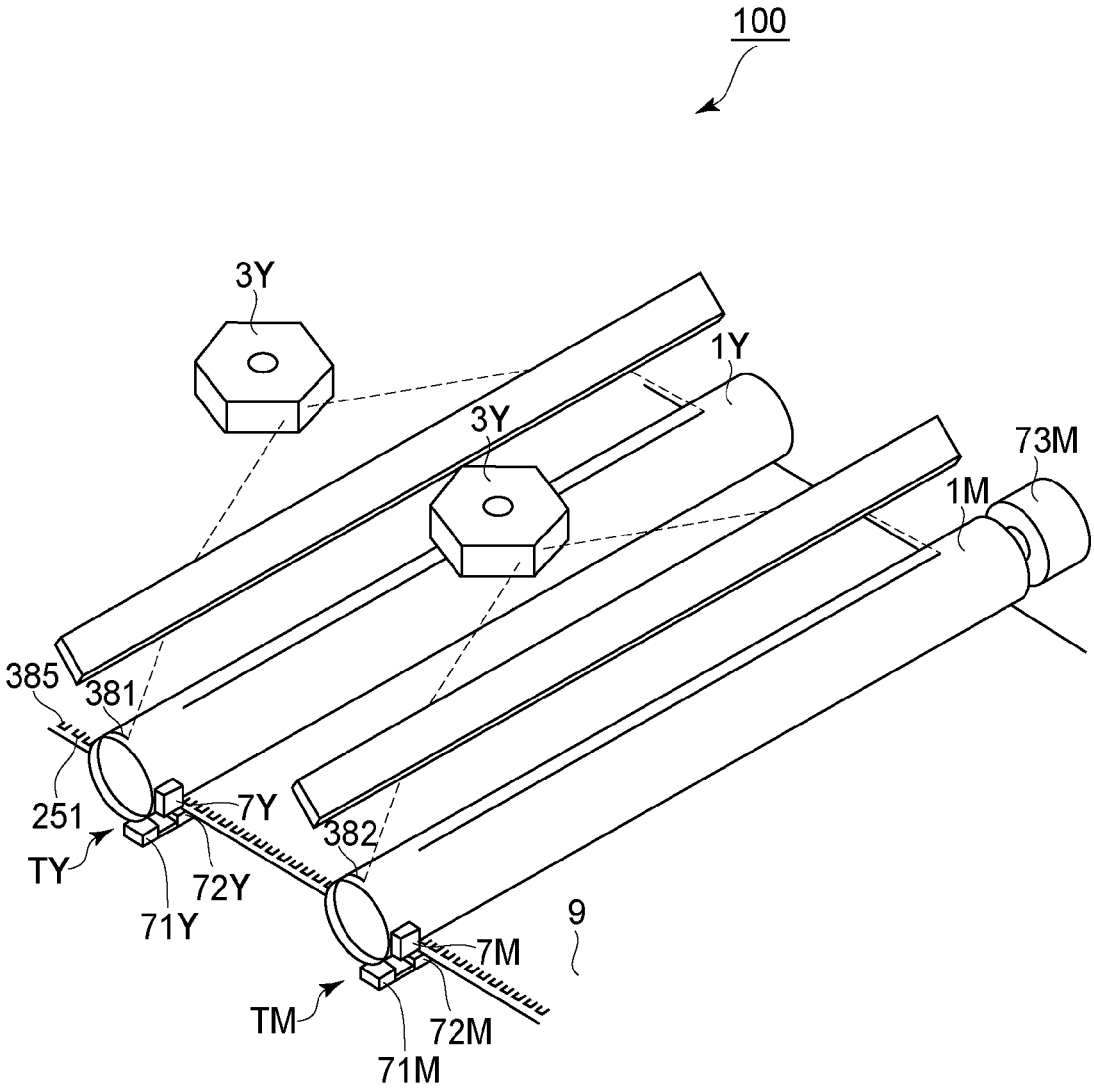
FIG. 25 is a schematic view for illustrating detection of an amount of movement of a photosensitive drum in an axial direction of the photosensitive drum.
Figure 26:
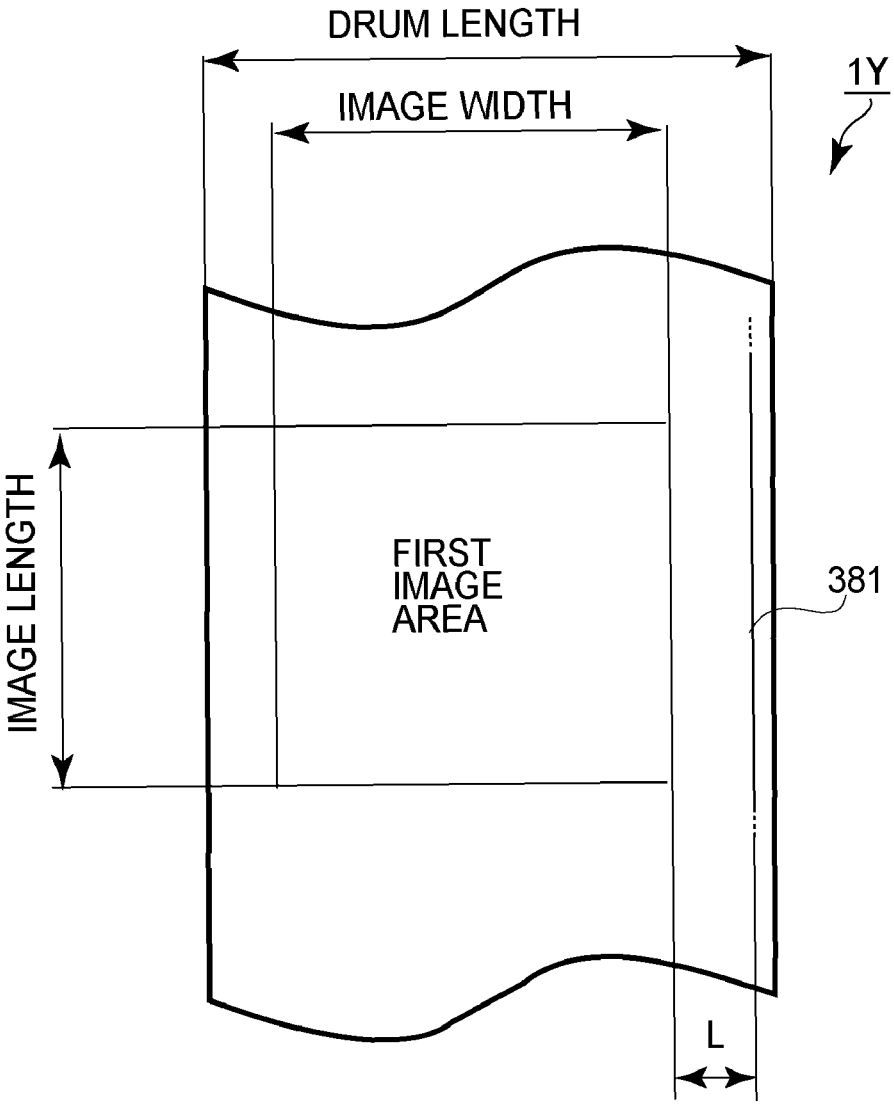
FIG. 26 is a schematic view for illustrating a first width direction position index formed on a first image bearing member.
Figure 27:
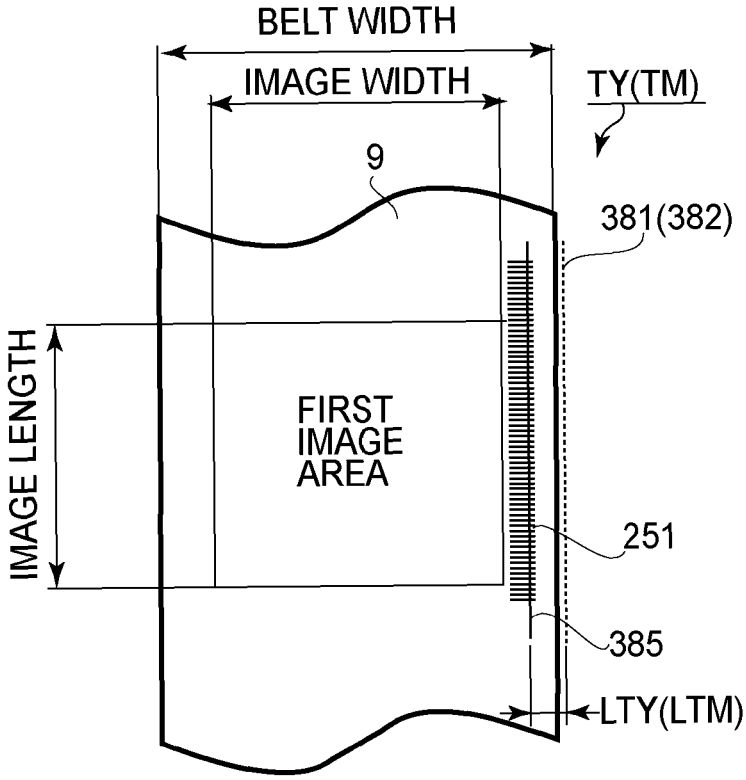
FIG. 27 is a schematic view for illustrating a conveying member width direction position index formed on a conveying member.
Figure 28:
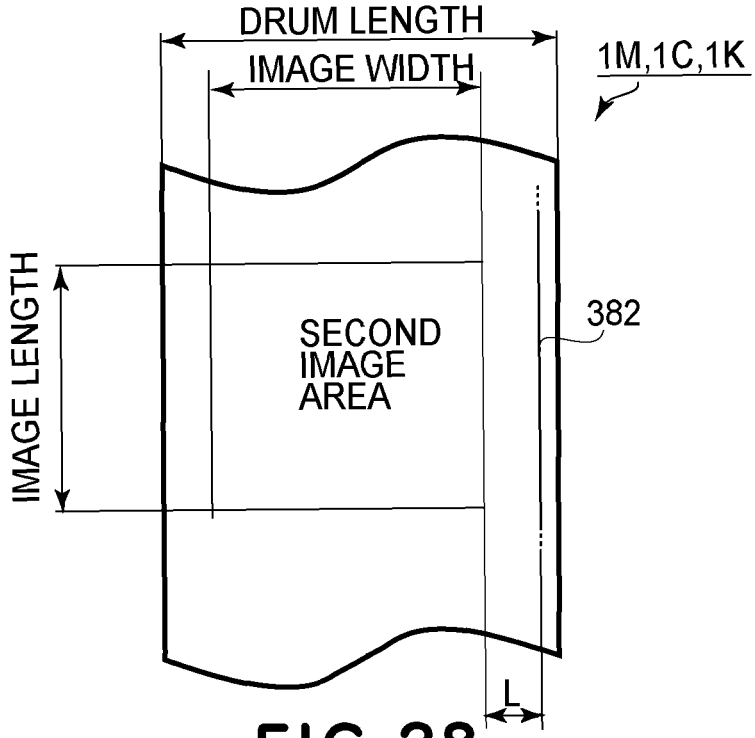
FIG. 28 is a schematic view for illustrating a second width direction position index formed on a second image bearing member.
Figure 29:
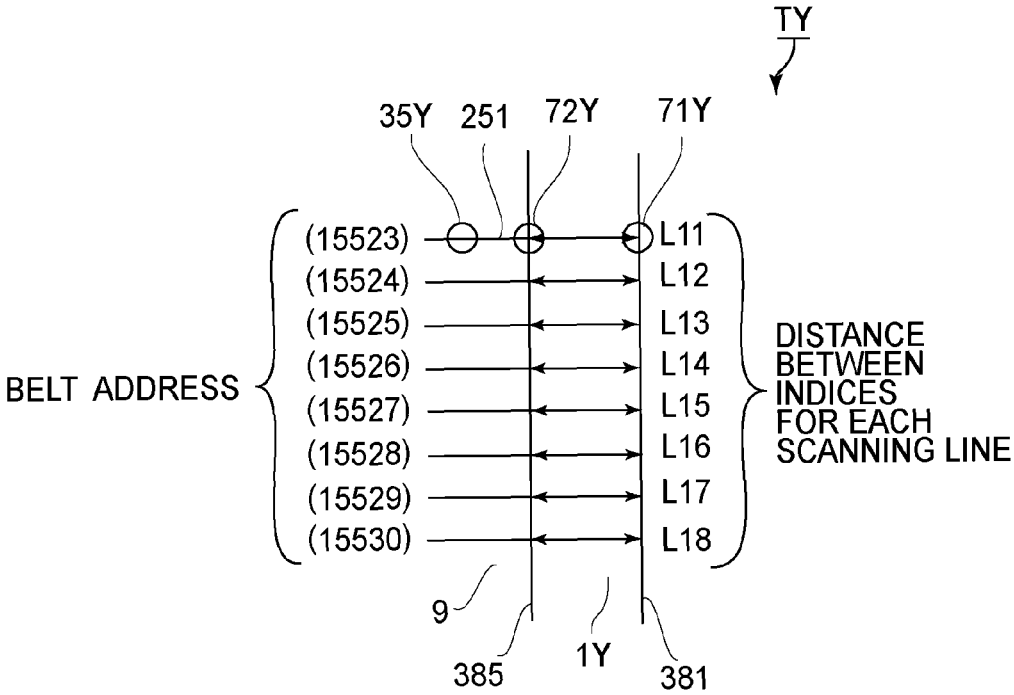
FIG. 29 is a schematic view for illustrating a distance between the first width direction position index and the conveying member width direction position index.
Figure 30:
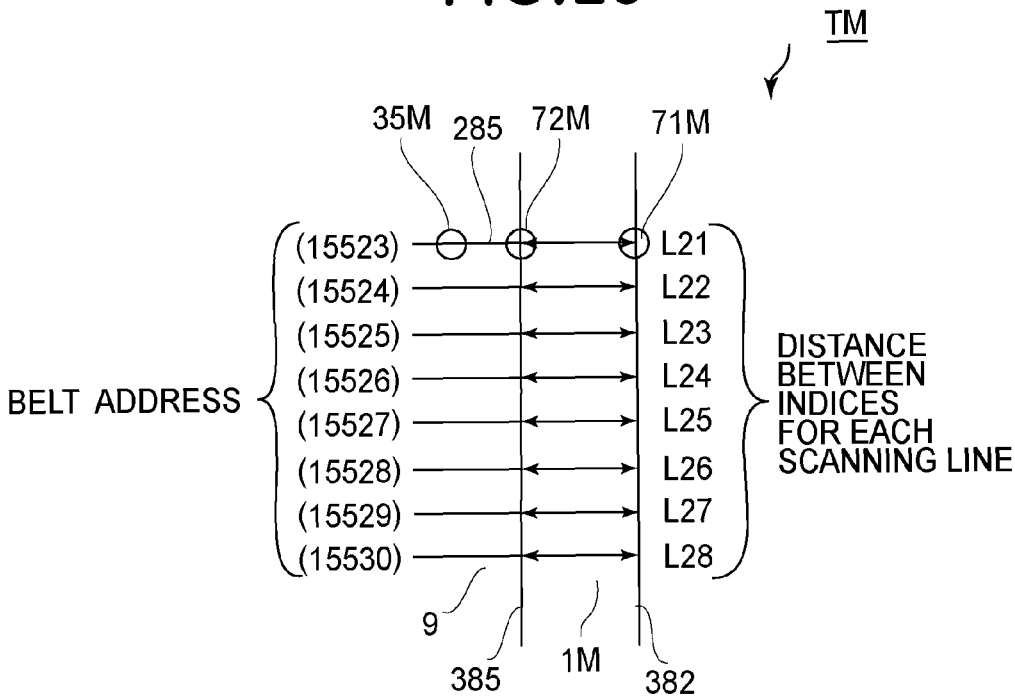
FIG. 30 is a schematic view for illustrating a distance between the conveying member width direction position index and the second width direction position index.

FIG. 24 is a schematic view for illustrating a constitution used in control in Embodiment 7, FIG. 25 is a schematic view for illustrating detection of an amount of movement of a photosensitive drum in an axial direction of the photosensitive drum, FIG. 26 is a schematic view for illustrating a first width direction position index formed on a first image bearing member, FIG. 27 is a schematic view for illustrating a conveying member width direction position index formed on a conveying member, FIG. 28 is a schematic view for illustrating a second width direction position index formed on a second image bearing member, FIG. 29 is a schematic view for illustrating a distance between the first width direction position index and the conveying member width direction position index, and FIG. 30 is a schematic view for illustrating a distance between the conveying member width direction position index and the second width direction position index.

In Embodiment 1, the adjusting means (adjusting device) is capable of adjusting the position of the second image bearing member toward the movement direction of the conveying member and positions of the scanning lines for the first color toner image and the scanning lines for the second color toner image with respect to the sub-scanning direction, thus superposing the second color toner image on the first color toner image.

In Embodiment 7, the adjusting means (adjusting device) is capable of adjusting the position of the second image bearing member toward the widthwise direction (the image bearing member rotational direction) perpendicular to the movement direction of the conveying member and positions of the scanning lines for the first color toner image and the scanning lines for the second color toner image with respect to the main-scanning direction, thus superposing the second color toner image on the first color toner image.

In Embodiment 7, similarly as in Embodiment 4, the first position index, the second position index, and the conveying member position index are prepared in advance as the fixed patterns of the first image bearing member, the second image bearing member, and the conveying member and then control for associating the fixed patterns with each other in the memories is carried out. Therefore, the constitution and control for positioning the first color toner image and the second color toner image with respect to the conveying member rotational direction by detecting the fixed patterns are omitted from illustration and redundant explanation.

In Embodiment 7, a conveying member position index disposed on a conveying member surface opposite from a conveying member surface contacting the second image bearing member and a second position index, disposed in an end portion area on an outer surface of the second image bearing member, projecting the outside of the conveying member are detected from the inside of the conveying member.

As shown in FIG. 24, the fixed first position index 221 and the fixed second position index 222 are provided to the photosensitive drum 1Y and the photosensitive drum 1M, respectively, over one full circumference. Also to the intermediary transfer belt 9, the fixed conveying member position index is provided over one full circumference.

The position of the scanning line formed on the photosensitive drum 1Y is, as described in Embodiment 4, specified by the address using the first position index 221. The address using the first position index 221 is converted into the address using the conveying member position index 251 at the primary transfer portion (TY: FIG. 1) to specify the position of the scanning line carried by the intermediary transfer belt 9.

The position of the scanning line formed on the photosensitive drum 1M is specified by the address using the second position index 222. At the primary transfer portion (TM: FIG. 1), the conveying member position index 251 and the second position index 222 are independently detected to specify corresponding scanning lines. Then, the rotational speed of the photosensitive drum 1M (or the position of the photosensitive drum 1M along the intermediary transfer belt 9) is adjusted so that the address using the second position index 222 is superposed on the corresponding address using the conveying member position index 251.

As shown in FIG. 25, lengths of the photosensitive drums 1Y and 1M are longer than a width of the intermediary transfer belt 9 and a first widthwise position index 381 is located outside a widthwise end of the intermediary transfer belt 9.

The exposure device 3Y writes an electrostatic image for the first widthwise position index 381 correspondingly to a predetermined scanning position when scanning lines for the yellow image are drawn on the photosensitive drum 1Y. The electrostatic image is developed by the developing device 4Y to provide the first widthwise position index 381 detectable by an optical sensor.

The exposure device 3M writes an electrostatic image for a second widthwise position index 382 correspondingly to a predetermined scanning position when scanning lines for the yellow image are drawn on the photosensitive drum 1M. The electrostatic image is developed by the developing device 4M to provide the first widthwise position index 381 detectable by an optical sensor.

In Embodiment 7, the first widthwise position index 381 and the second widthwise position index 382 are formed in a straight line consisting of predetermined widthwise pixels arranged in the sub-scanning direction (the rotational direction) but may also be a cross-shape index, a V-shape index, or the like.

At an inner side surface of the intermediary transfer belt 9, the conveying member position index 251 and a conveying member widthwise position index 385 which are a fixed pattern are provided so as to locate inside the positions of the first widthwise position index 381 and the second widthwise position index 382 with respect to the widthwise direction.

The first widthwise position index 381 and the conveying member widthwise position index 385 are simultaneously detected by a pair of position sensors 71Y and 72Y arranged in the widthwise direction perpendicular to the rotational direction of the conveying member while fixing a mutual positional relationship.

The second widthwise position index 382 and the conveying member widthwise position index 385 are simultaneously detected by a pair of position sensors 71M and 72M arranged in the widthwise direction perpendicular to the rotational direction of the conveying member while fixing a mutual positional relationship.

The position sensors 71Y, 71M, 72Y and 72M as an example of widthwise position index detecting means to measure an amount of displacement, of an image of each index projected onto a CCD, from a center of the CCD and output the measured amount of displacement as a digital value.

The first widthwise position index 381 and the second widthwise position index 382 are detected by the position sensors 71Y and 71M and thereafter are removed by the cleaning devices 7Y and 7M.

As shown in FIG. 26, the first widthwise position index 381 is recorded at a position spaced apart from the first image area, in which a maximum size image is to be formed, by a predetermined distance L.

As shown in FIG. 27, at an inner side surface of the intermediary transfer belt 9, the conveying member position index 251 and the conveying member widthwise position index 385 which are the fixed pattern are formed.

As shown in FIG. 28, the second widthwise position index 382 is recorded at a position spaced apart from the second image area, in which a maximum size image is to be formed, by a predetermined distance L.

As shown in FIG. 27, when the first image area is primary-transferred from the photosensitive drum 1Y onto the intermediary transfer belt 9 at the primary transfer portion TY, the first widthwise position index 381 and the conveying member widthwise position index 385 are spaced apart from each other by a distance between indices LTY. Then, the distance between indices LTY at the primary transfer portion TY is, as shown in FIG. 25, computed from the measured values of the position sensors 71Y and 72Y.

As shown in FIG. 27, when the second image area is primary-transferred from the photosensitive drum 1M onto the intermediary transfer belt 9 at the primary transfer portion TM, the second widthwise position index 382 and the conveying member widthwise position index 385 are spaced apart from each other by a distance between indices LTM. Then, the distance between indices LTM at the primary transfer portion TM is, as shown in FIG. 25, computed from the measured values of the position sensors 71M and 72M.

As shown in FIG. 29 with reference to FIG. 24, when the reader 35Y reads the conveying member position index 251, a widthwise position control portion 116 calculates a belt address describing a position of each of the scanning lines carried on the intermediary transfer belt 9. At the same time, the widthwise position control portion 116 takes in the measured values by the position sensors 71Y and 72Y and calculates distances between adjacent indices L11, L12, L13, . . . for each of the scanning lines.

The distance between the position sensors 71Y and 72Y is fixed. This distance is taken as L1. An amount of deviation of the first widthwise position index 381 measured by the position sensor 71Y is taken as ΔD1. An amount of deviation of the conveying member widthwise position index 385 measured by the position sensor 72Y is taken as ΔB1.

The widthwise position control portion 116 calculates the distances between indices L1*i* (i=1, 2, 3, . . . ) according to the following equation:

$$L1i=L1+\Delta D1i+\Delta B1i.$$

The widthwise position control portion 116 stores data of the distances between indices L11, L12, L13, . . . correspondingly to belt addresses in a memory 104 as shown in Table 7.

TABLE 7

| BELT ADDRESS | DISTANCE BETWEEN MAIN SCAN MARKS |
|---|---|
| 15523 | L11 |
| 15524 | L12 |
| 15525 | L13 |
| 15526 | L14 |
| 15527 | L15 |
| 15528 | L16 |
| 15529 | L17 |
| 15530 | L18 |
| . | . |
| . | . |
| . | . |

As shown in FIG. 30 with reference to FIG. 24, when the reader 35M reads the conveying member position index 251, the widthwise position control portion 116 specifies a belt address and reads a corresponding scanning line from the memory 104. At the same time, the widthwise position control portion 116 takes in the measured values by the position sensors 71M and 72M and calculates distances between adjacent indices L21, L22, L23, . . . for each of the scanning lines.

The distance between the position sensors 71M and 72M is fixed. This distance is taken as L1. An amount of deviation of the first widthwise position index 382 measured by the position sensor 71M is taken as ΔD2. An amount of deviation of the conveying member widthwise position index 385 measured by the position sensor 72M is taken as ΔB2.

The widthwise position control portion 116 calculates the distances between indices L2*i* (i=1, 2, 3, . . . ) according to the following equation:

$$L2i=L2+\Delta D2i+\Delta B2i.$$

The widthwise position control portion 116 controls a shift actuator 73M so that the distances between indices L11, L12, . . . at the primary transfer portion (TY: FIG. 29) are equal to the distances between indices L21, L22, . . . at the primary transfer portion TM. As a result, the photosensitive drum 1M is moved in the widthwise direction of the intermediary transfer belt 9, so that at the primary transfer portion TM, the second widthwise position index 382 formed on the photosensitive drum 1M is superposed on the first widthwise position index 381 formed on the photosensitive drum 1Y. Therefore, the color deviation between the yellow toner image and the magenta toner image with respect to the main scanning direction is eliminated.

Incidentally, a mechanism for shifting the photosensitive drum 1M in the rotation shaft direction may also be realized by a mechanism similar to that described in Embodiment 3.

Embodiment 8

Figure 31:
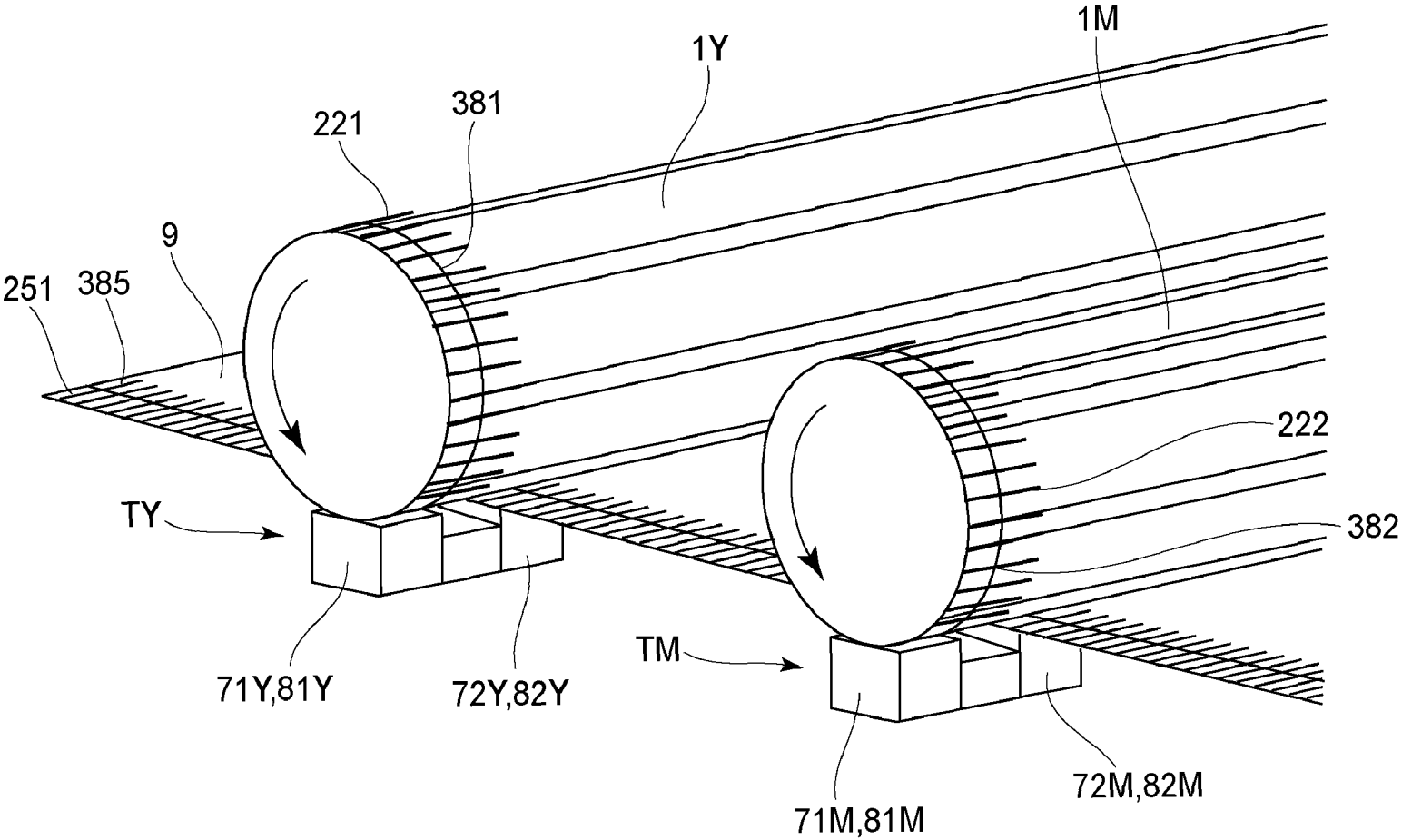
FIG. 31 is a schematic view for illustrating a constitution used in control in Embodiment 8.

FIG. 31 is a schematic view for illustrating a constitution used in control in Embodiment 8.

In Embodiment 8, by using the control in Embodiment 4 using the fixed patterns, the second color toner image carried on the second image bearing member is superposed on the first color toner image carried on the conveying member on each scanning line basis with respect to the sub-scanning direction.

In Embodiment 8, by using the control in Embodiment 7 in which the second widthwise position index is positioned on the first widthwise position index through the conveying member widthwise position index, the second color toner image carried on the second image bearing member is superposed on the first color toner image carried on the conveying member with respect to the main scanning direction.

However, in Embodiment 8, the first widthwise position index and the second widthwise position index are fixed as a fixed pattern. Other constitutions and control are similar to those in Embodiment 7, thus being omitted from redundant explanation.

As shown in FIG. 31, on the photosensitive drum 1Y, the first position index 221 used for control with respect to the sub-scanning direction and the first widthwise position index 381 used for control with respect to the main scanning direction are provided as the fixed pattern. On the photosensitive drum 1M, the second position index 222 used for control with respect to the sub-scanning direction and the second widthwise position index 382 are provided as the fixed pattern.

At the primary transfer portion TY, four sensors are disposed. These sensors are a reader 81Y for detecting the first position index 221, a position sensor 71Y for detecting the first widthwise position index 381, a reader 82Y for detecting the conveying member position index 251, and a position sensor 72Y for detecting the conveying member widthwise position index 385. However, as described in JP-A 2004-29019, the reader 81Y and the position sensor 71Y may be constituted as a single unit and the reader 82Y and the position sensor 72Y may also be constituted as a single unit.

At the primary transfer portion TM, four sensors are disposed. These sensors are a reader 81M for detecting the second position index 222, a position sensor 71M for detecting the first widthwise position index 382, a reader 82M for detecting the conveying member position index 251, and a position sensor 72M for detecting the conveying member widthwise position index 385. Similarly, the reader 81M and the position sensor 71M may be constituted as a single unit and the reader 82M and the position sensor 72M may also be constituted as a single unit.

The readers 81Y, 82Y, 81M and 82M are used for reading corresponding fixed patterns and correspond to the readers 32Y, 39, 32M and 55, respectively, shown in FIG. 21.

The position sensors 71Y, 71M, 72Y and 72M are those described in Embodiment 7.

The photosensitive drum 1M is controlled in rotational speed by the driving motor MM shown in FIG. 21 and the position of the intermediary transfer belt 9 with respect to the widthwise direction is controlled by the shift actuator 73M shown in FIG. 24. As a result, the photosensitive drum 1M is controlled with respect to the main scanning direction and the sub-scanning direction.

Then, the process described in Embodiment 4 and the process described in Embodiment 7 proceed at the same time, thus preventing color deviation with respect to both of the main scanning direction and the sub-scanning direction.

Embodiment 9

Figure 32:
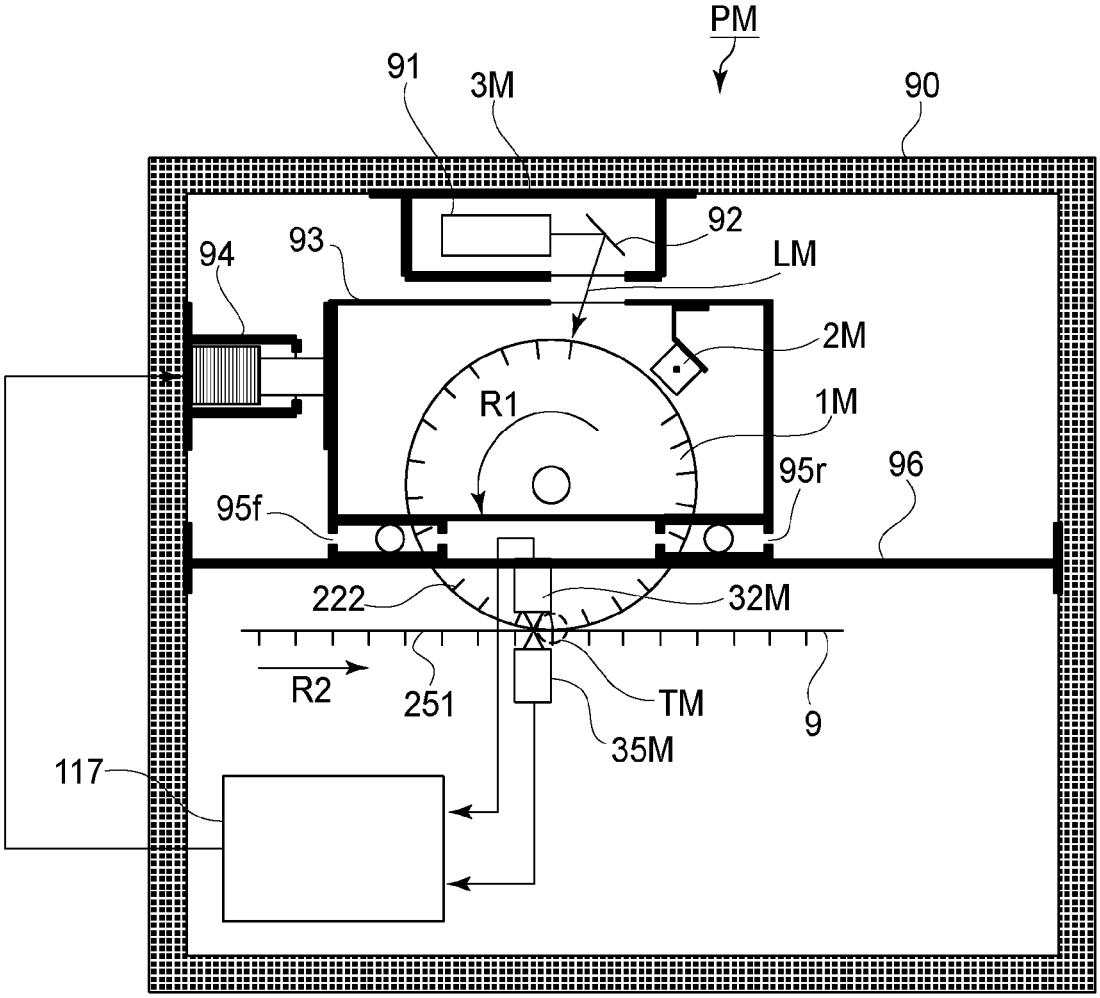
FIG. 32 is a schematic view for illustrating a second image bearing member moving mechanism used in control in Embodiment 9.
Figure 33:
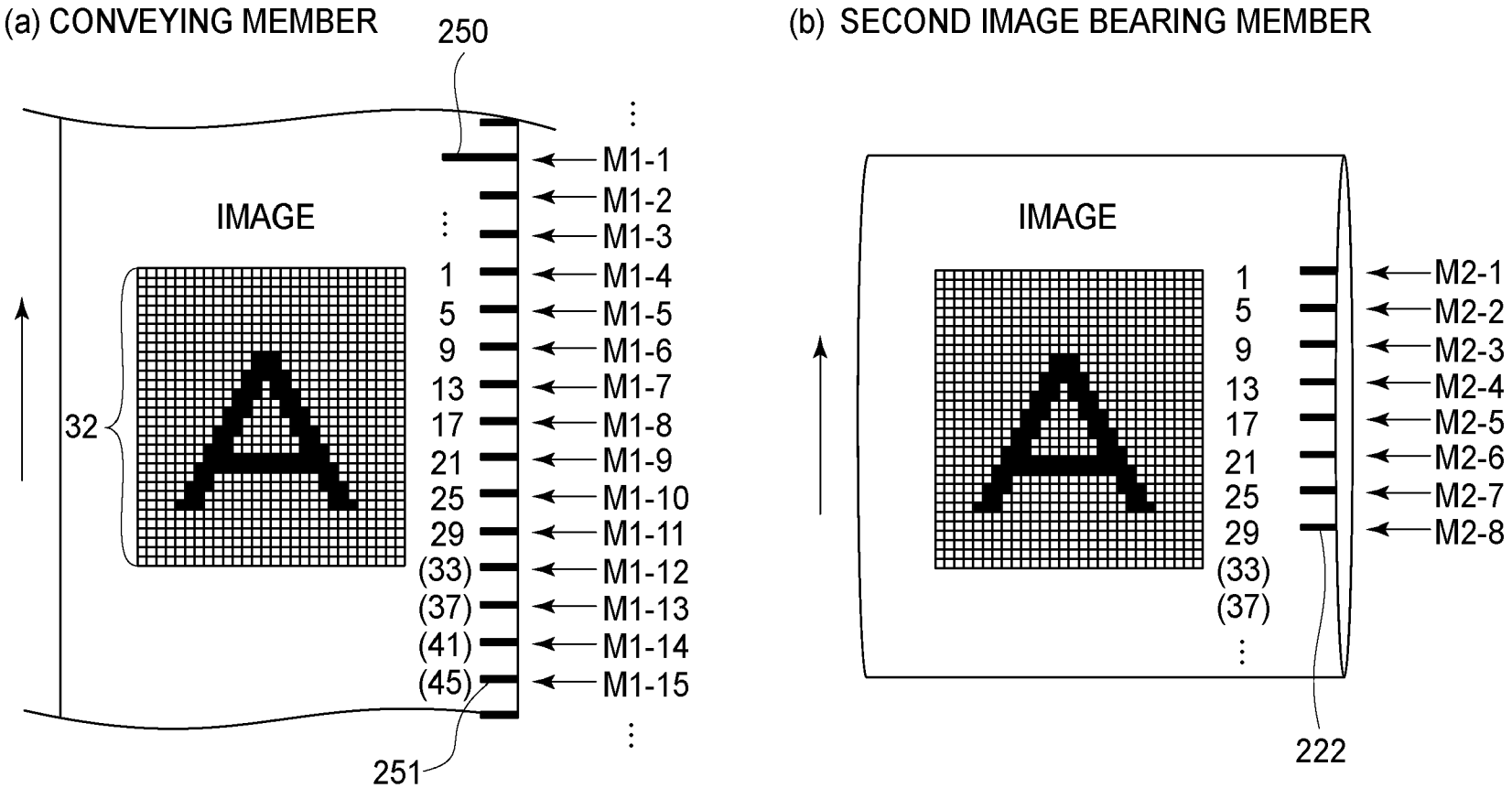
FIGS. 33(*a*) and 33(*b*) are schematic views for illustrating correspondence of images carried on a conveying member and a second image bearing member, respectively.
Figure 34:
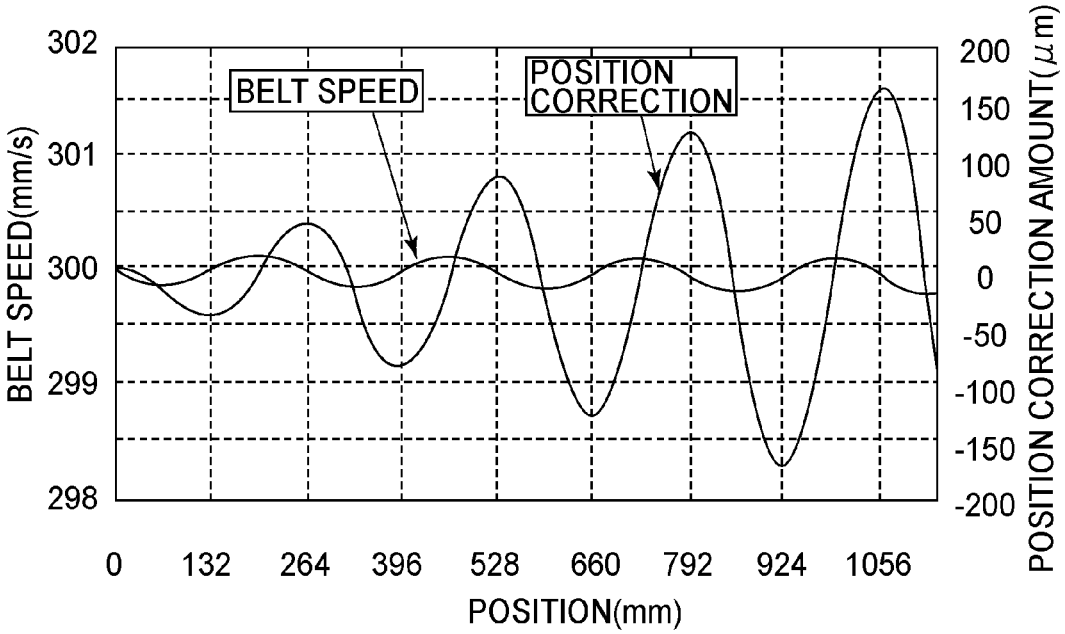
FIG. 34 is a graph showing a relationship between a speed fluctuation of the conveying member and a control amount of the second image bearing member.
Figure 35:
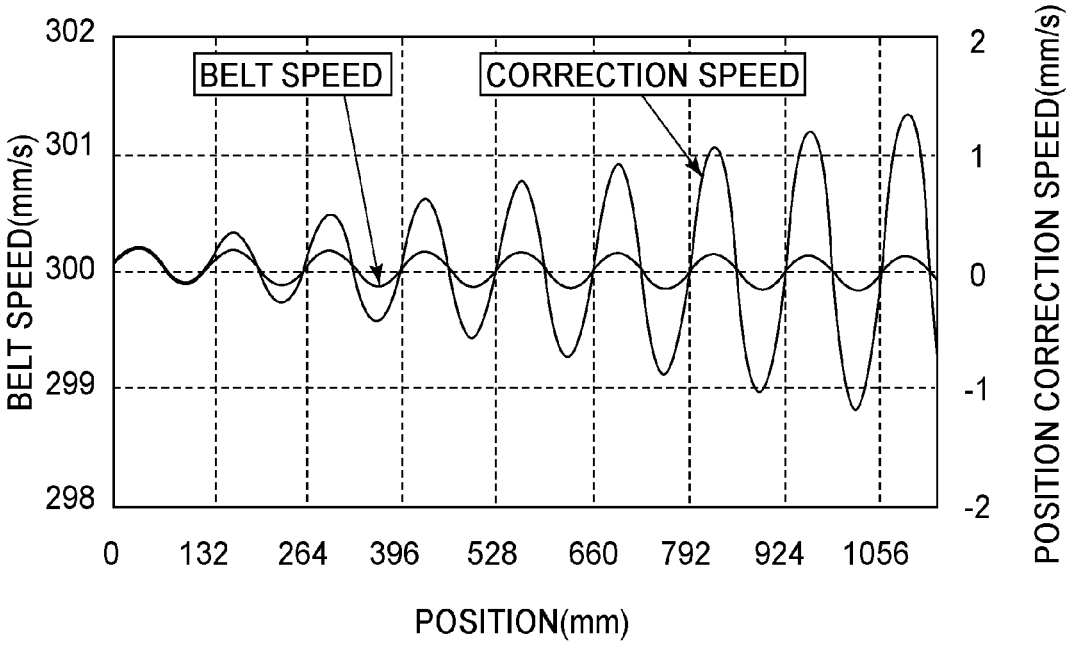
FIG. 35 is a graph for illustrating oscillation of a control amount in the case where a rotational speed of the second image bearing member is controlled.

FIG. 32 is a schematic view for illustrating a second image bearing member moving mechanism used in control in Embodiment 9, FIGS. 33(*a*) and 33(*b*) are schematic views for illustrating correspondence of images carried on a conveying member and a second image bearing member, respectively, FIG. 34 is a graph showing a relationship between a speed fluctuation of the conveying member and a control amount of the second image bearing member, and FIG. 35 is a graph for illustrating oscillation of a control amount in the case where a rotational speed of the second image bearing member is controlled.

In Embodiment 9, the second image bearing member moving mechanism for moving the second image bearing member along the conveying member rotational direction described in Embodiment 3 is described as another embodiment. The constitution of the image forming station PM, rewriting and association among the first position index, the second position index and the conveying member position index, the determination process of the amounts of control, and the like are the same as those partly described in Embodiments 1 and 3. Therefore, portions overlapping with those in the preceding Embodiments are represented by common reference numerals or symbols, thus being omitted from redundant explanation.

As shown in FIG. 32, the magenta toner image formed on the photosensitive drum 1M is conveyed to the primary transfer portion TM and is primary-transferred onto the intermediary transfer belt 9 by being superposed on the yellow toner image carried on the intermediary transfer belt 9. The magenta toner image is superposed on the yellow toner image at the primary transfer portion TM by using the second position index 222 formed on the photosensitive drum 1M and the conveying member position index 251 formed on the intermediary transfer belt 9.

The exposure device 3M effects scanning exposure of the surface of the photosensitive drum 1M by reflecting a laser beam LM, subjected to scanning through the rotatable polygonal mirror 91, by folding mirror 92. An electrostatic image for the second position index 222 formed simultaneously with writing of an electrostatic image for an image by the scanning with the laser beam LM is developed by the developing device (4M: FIG. 1) to provide an optically detectable second position index 222. That is, the second position index is successively formed on the image bearing member. The second position index 222 is detected by the reader 32M, as the optical sensor, disposed immediately before the primary transfer portion TM.

On the other hand, on the intermediary transfer belt 9, the conveying member position index 251 as the reflection/absorption optical pattern is formed. The conveying member position index 251 is detected by the reader 35M, as the optical sensor, disposed equidistantly from the primary transfer portion TM with respect to the reader 32M.

The second position index and the conveying member position index 251 are read at a position close to the primary transfer portion TM, so that it is also possible to cancel the speed fluctuation of the photosensitive drum 1M in a period from the writing of the electrostatic image until the magenta toner image reaches the primary transfer portion TM.

A position correction control portion 117 calculates an amount of deviation between corresponding scanning lines from a detection result of the reader 32M and a detection result of the reader 35M. Then, the position correction control portion 117 effects position correction of the photosensitive drum 1M so that the second image bearing member position information of the photosensitive drum 1M coincides with the conveying member position information of the intermediary transfer belt 9 until the corresponding scanning lines reach the primary transfer portion TM.

The position correction control portion 117 measures a time difference between a first detection time of the conveying member position index 251 by the reader 35M and a second detection time of the second position index 222 by the reader 32M. Then, the position correction control portion 117 calculates an amount of control of a position correction device 94 depending on the time difference.

The position correction control portion 117 actuates the position correction device 94 with the calculated control amount to move the photosensitive drum 1M in the rotational direction of the intermediary transfer belt 9, so that a corresponding second position index 222 is caused to reach the primary transfer portion TM simultaneously with a corresponding conveying member position index 251.

The process as described above is carried out intermittently with timing of, e.g., every four scanning lines. Then, a similar process is continuously and independently carried out with respect to the photosensitive drums 1M, 1C and 1K, so that the respective toner images of magenta, cyan and black are superposed on the yellow toner image to prevent color deviation with respect to the rotational direction.

The position correction device 94 in Embodiment 9 is a linear actuator for moving the photosensitive drum 1M in the photosensitive drum of the intermediary transfer belt 9 in a plurality of steps with a minute pitch. As the position correction device 94, a device employing an ultrasonic motor and a device employing a piezoelectric actuator utilizing a piezoelectric effect may preferably be used.

The position correction device 94 is fixed to an apparatus housing 90 at its left-hand end and is fixed to a drum supporting member at its right-hand end.

The position correction device 94 expands laterally (horizontally) by a length corresponding to a position correction amount when a sign of the position correction amount is positive and contracts laterally (horizontally) by a length corresponding to a position correction amount when the sign of the position correction amount is negative.

The photosensitive drum supporting member 93 integrally supports movable portions moved by the position correction device 94. The photosensitive drum 1M, the charging device 2M, and unshown developing device, cleaning device and primary transfer roller are attached to the photosensitive drum supporting member 93, thus resulting in less fluctuation in image forming condition and less change of the primary transfer portion TM.

The photosensitive drum supporting member 93 is movably attached to a linear guide supporting member 96 through linear guides 95*f* and 95*r*. The primary transfer roller, as shown in FIG. 1, presses the intermediary transfer belt 9 on an opposite side to a side contacting the photosensitive drum 1M, thus forming the primary transfer portion TM between the photosensitive drum 1M and the intermediary transfer belt 9.

Incidentally, as described in Embodiment 1, the second position index 222 may also be formed in a potential pattern by only the light exposure in place of formation through the exposure/development process. Further, it is also possible to magnetically record the second position index 222 in the magnetic recording layer of the photosensitive drum 1M by disposing a dedicated writing device or to write an optical track as in an optical disk after formation of an optical writing layer.

The linear guides 95*f* and 95*r* are constituted to slide by rotation of inner bearings but may also employ a constitution for sliding these guides by using a solid member with less friction or a liquid as anther method. The linear guide supporting member 96 supports the linear guides 95*f* and 95*r*, the photosensitive drum supporting member 93, and the like, so that it may also be directly attached to the apparatus housing 90.

Here, assumption is made that the conveying member position index 251 is formed at regular intervals, that the photosensitive drum 1M has a perfectly circular cross section and rotates at a constant angular speed with no eccentricity, and that the exposure device 3M forms the second position index 222 in a constant period.

In such a condition, in the case where the intermediary transfer belt 9 is not changed in speed, detection timing of the conveying member position index 251 by the reader 35M and detection timing of the second position index by the reader 32M continuously synchronize with each other. For this reason, the position correction is not performed after the position correction device is actuated initially.

However, in the case where the rotational speed of the intermediary transfer belt 9 is decreased, the detection timing of the conveying member position index 251 is later than the detection timing of the second position index 222. Therefore, the position correction control portion 117 converts an amount of deviation based on the time difference between the detection timings into a distance and actuates the position correction device 94 by the distance.

As a result, the photosensitive drum 1M is moved toward the upstream side with respect to the rotational direction of the intermediary transfer belt 9, so that the delayed conveying member position index 251 on the intermediary transfer belt 9 side and the second position index 222 are caused to reach the primary transfer portion TM at the same time.

As shown in FIG. 33(*a*), in an end portion area of the intermediary transfer belt 9, the conveying member position index 251 which is a linear scale provided with markings at regular intervals and one origin index 250 indicating the origin with respect to the circumferential direction is provided. The conveying member position index 251 is formed in a width of one scanning line with at an interval of every four scanning lines and the origin index 250 is formed so as to be longer than the conveying member position index 251. The origin indication method may also be, in addition to the method of changing the length of the markings, a method of changing a width with respect to the circumferential direction, a method of changing a distance between adjacent markings, and the like method.

To the scale markings, a number from 1 for the origin is assigned in ascending order in advance and is prefixed by "M1-" in order to be distinguished from scale (marking) number on the photosensitive drum 1M side. In FIG. 33(*a*), M1-4 is assigned to a leading end of an image formed by 32 scanning lines. The number assignment may be performed during the transfer from the photosensitive drum for the first color toner image (1Y: FIG. 1) and then the position control of the photosensitive drums for the second color toner image and the following color toner images may be performed in accordance with the scale numbers assigned during the transfer from the first photosensitive drum. Further, after the number assignment for the first photosensitive drum is performed in advance, the positioning control of the respective photosensitive drums may also be performed.

As shown in FIG. 33(*b*), in an end portion area of the photosensitive drum 1M, the second position index 222 which is a linear scale provided with markings each written correspondingly to one scanning line located every four scanning lines written during image formation is provided. To each of the respective scale (marking) numbers of the second position index 222, in order to be distinguished from those on the intermediary transfer belt 9 side, a prefix "M2-" is provided.

Table 8 shows a relationship between the scale numbers assigned to every four scanning lines in ascending order from the origin index on the intermediary transfer belt 9 side and those assigned to every four scanning lines in ascending order from the first scanning line.

TABLE 8

| LINE NO. OF IMAGE | SCALE NO. ON BELT | SCALE NO. ON DRUM |
|---|---|---|
| 1 | M1-4 | M2-1 |
| 5 | M1-5 | M2-2 |
| 9 | M1-6 | M2-3 |
| 13 | M1-7 | M2-4 |
| 17 | M1-8 | M2-5 |
| 21 | M1-9 | M2-6 |
| 25 | M1-10 | M2-7 |
| 29 | M1-11 | M2-8 |

With respect to the first scanning line of the image, the scale number on the intermediary transfer belt 9 side is M1-4 and the scale number on the photosensitive drum 1M side is M2-1.

The position correction control portion 117 stores a time at which each of the scale numbers pass through the readers 35M and 32M located in the neighborhood of the primary transfer portion TM and calculates the scale number.

The scale numbers on the intermediary transfer belt 9 are counted and obtained in the order of M1-1, M-2, . . . from the origin. The scale numbers on the photosensitive drum 1M side are counted and obtained in such a manner that the first detected scale marking is counted as M2-1 and the subsequent scale markings are counted as M2-2, M2-3, . . . .

The position correction control portion 117 calculates an amount of movement of the photosensitive drum 1M, for passing the scale numbers for the same scanning line number through the primary transfer portion TM at the same time, from the above obtained scale numbers and elapsed times. For example, the position correction is performed by detecting the deviation amount in the neighborhood of each of the primary transfer portions (TM, TC, TK: FIG. 1) for associated of the photosensitive drums (1M, 1C, 1K: FIG. 1), so that it is possible to effect superposition correction even when the speed fluctuation after the exposure or the speed fluctuation with a short period occurs.

Incidentally, with respect to the exposure device 3M using the rotatable polygonal mirror 91 rotating at a high speed of several tens of thousands of revolutions per minute, a scanning spot is deviated even when minute vibration occurs, so that the exposure device 3M is fixed to the apparatus housing 90 by a sturdy supporting member.

For this reason, during the position correction of the photosensitive drum 1M, the exposure device 3M is not moved even when the photosensitive drum 1M is moved.

As a result, when the photosensitive drum 1M is moved for the position correction, the scanning lines and the second position index 222 formed on the photosensitive drum 1M are moved at the surface of the photosensitive drum 1M to change in interval. That is, a scanning line density and a second position index 222 density with respect to the sub-scanning direction are changed.

For example, in the case where the speed of the intermediary transfer belt 9 is decreased, when the photosensitive drum 1M is moved to the upstream side, an irradiation position of the laser beam LM is moved to the upstream side with respect to the rotational direction of the photosensitive drum 1M. Thus, an interval between the previously recorded scale of the second position index 222 and a scale, to be currently recorded, of the second position index 222 is increased.

Thereafter, even if the speed fluctuation of the intermediary transfer belt 9 is eliminated and is equal in peripheral speed to the photosensitive drum 1M, when the second position index 222 increased in interval reaches the reader 32M, the detection timing of the second position index 222 is delayed by the increased interval.

Therefore, the position correction control portion 117 moves the photosensitive drum 1M toward the downstream side with respect to the rotational direction of the intermediary transfer belt 9 so as to catch up with the conveying member position index 251, on the intermediary transfer belt 9 side, which has passed earlier than the second position index 222.

Then, when the photosensitive drum 1M is moved to the downstream side, contrary to the original position, the irradiation position of the laser beam LM is moved toward the downstream side with respect to the rotational direction of the photosensitive drum 1M, so that the interval of the second position index 222 to be recorded is decreased.

In this way, the position correction amount of the photosensitive drum 1M affects the position correction amount of the photosensitive drum 1M in a period corresponding to a time from the exposure to the transfer.

Then, in the case where the speed fluctuation of the intermediary transfer belt 9 is random, the position correction amount of the photosensitive drum 1M fluctuates with 0 as the center but in the case where the speed of the intermediary transfer belt 9 fluctuates in a specific period, a maximum of the position correction amount is increased with time to exceed a control range of the position correction amount in some cases.

As shown in FIG. 34, when the period of the speed fluctuation and the period of the position correction amount overlap with each other, the position correction amount is accumulated to gradually increase, so that the correction cannot follow the speed fluctuation after all.

FIG. 34 shows a simulation result in the case of a diameter of the photosensitive drum 1M of 84 mm, a peripheral length from the exposure position to the transfer position of 132 mm, a process speed of 300 mm/sec, and a speed fluctuation of the intermediary transfer belt 9 of ±0.15% (in a period which is two times a period from the exposure to the transfer). In the figure, an abscissa represents a position (mm) on the intermediary transfer belt 9, a left-hand ordinate represents a peripheral speed (mm/sec) of the intermediary transfer belt 9, and a right-hand ordinate represents a position correction amount (μm).

As shown in FIG. 34, a maximum of the position correction amount of the photosensitive drum 1M oscillates so as to increase by ±42 μm every 264 mm rotation of the photosensitive drum 1M. Specifically, the maximum increase is ±42 μm in a range of 0-264 mm, ±84 μm in a range of 264-528 mm, ±126 μm in a range of 528-792 mm, and 168 μm in a range of 792-1056 mm.

A speed fluctuation frequency f of the intermediary transfer belt 9 by the oscillation of the position correction amount is represented by the following equation:

$$f=f0\times(2\times n-1)/2\ (n=1, 2, 3, \ldots)$$

wherein f0 represents a frequency with a time from the exposure to the transfer as one period.

FIG. 35 shows a change in control amount in the case where the second position index 222 is superposed on the conveying member position index 251 by controlling the rotational speed of the photosensitive drum 1M as described in the constitution of FIG. 32 in Embodiment 1.

In this case, a position correction speed (m/sec) of the photosensitive drum 1M is simulated by making the speed fluctuation period of the intermediary transfer belt 9 equal to the time from the exposure to the transfer.

In the figure, the abscissa and the left-hand ordinate are the same as those in FIG. 34 and the left-hand ordinate represents the position correction speed (an amount of increase and decrease of the peripheral speed relative to the process speed) (mm/sec).

As shown in FIG. 35, the maximum of the position correction amount of the photosensitive drum 1M oscillates so as to increase by ±0.15 mm/sec every 132 mm rotation of the photosensitive drum 1M. Specifically, the maximum increase is ±0.15 mm/sec in a range of 0-132 mm, ±0.30 mm/sec in a range of 132-264 mm, ±0.45 mm/sec in a range of 264-396 mm, ±0.60 mm/sec in a range of 396-528 mm, ±0.75 mm/sec in a range of 528-660 mm, and ±0.9 mm/sec in a range of 660-792 mm.

A speed fluctuation frequency f of the intermediary transfer belt 9 by the oscillation of the position correction speed is represented by the following equation:

$$f=f0\times n\ (n=1, 2, 3, \ldots)$$

wherein f0 represents a frequency with the time from the exposure to the transfer as one period.

When such a speed fluctuation with the period (frequency f) occurs in the intermediary transfer belt 9, it is difficult to carry out the position correction control, so that it is desirable that the position correction is initialized by stopping the movement of the irradiation position of the laser beam LM every image formation on one sheet.

However, in order to initialize the position correction, it is necessary to provide an interval between images (so-called sheet interval) longer than the distance from the exposure position to the transfer. With respect to the photosensitive drum IM used in the above-described simulation, the distance from the exposure position to the transfer position is 132 mm, so that it is necessary to control the interval between images so as to be about 140 mm.

Then, in the case where continuous image formation is performed with the interval between images of 100 mm or less, when the interval between images is controlled so as to be about 140 mm, the number of image formable sheets per unit time is decreased.

Embodiment 10

Figure 36:
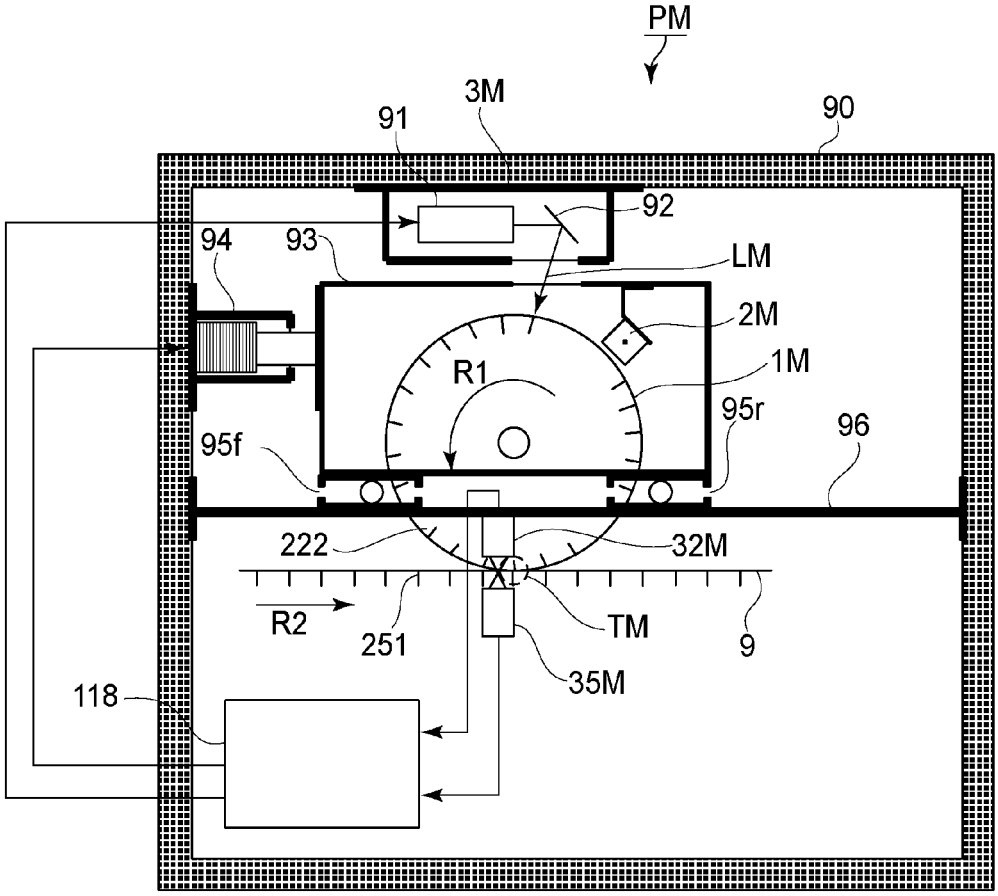
FIG. 36 is a schematic view for illustrating a second image bearing member moving mechanism used in control in Embodiment 10.
Figure 37:
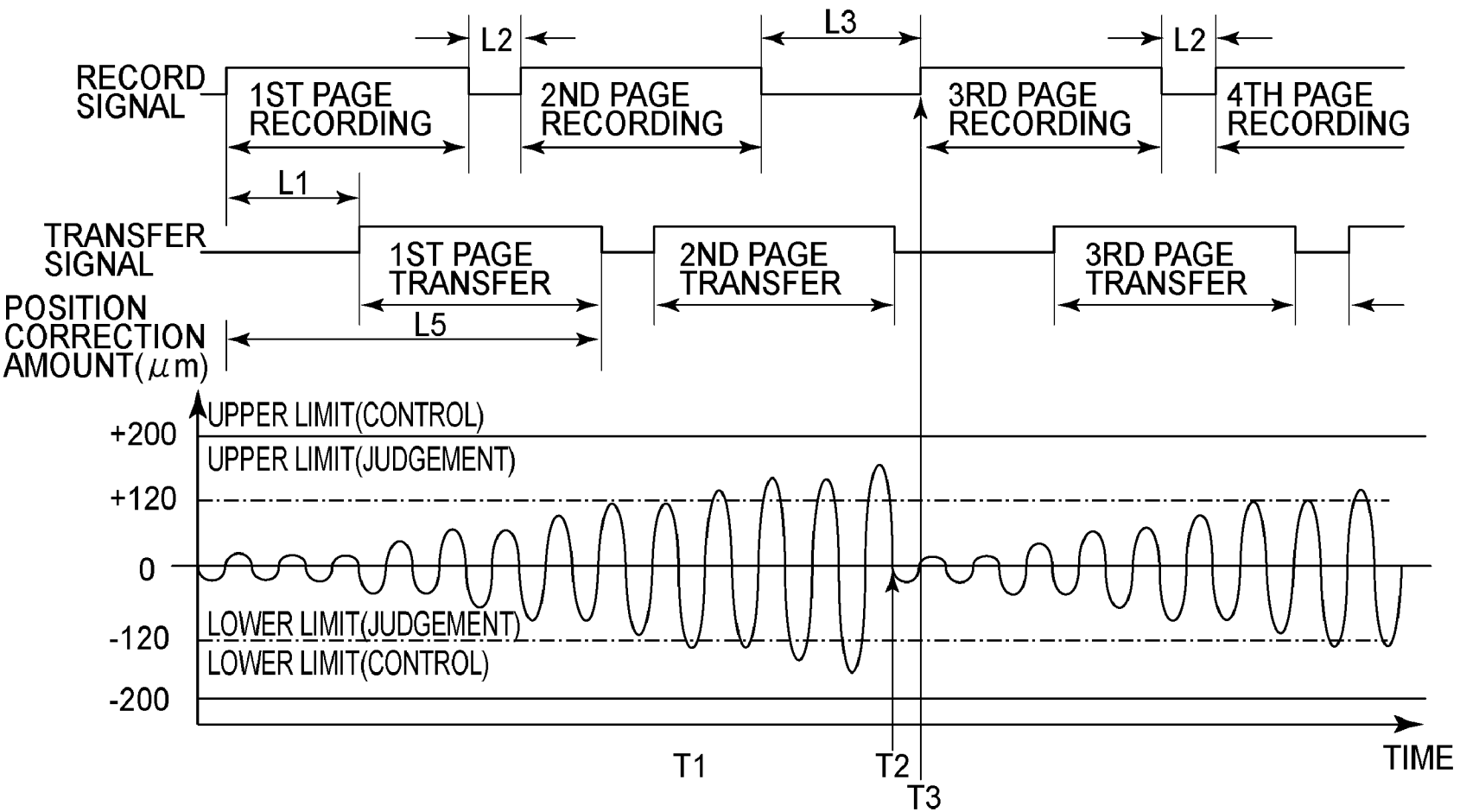
FIG. 37 is a time chart of the control in Embodiment 10.
Figure 38:
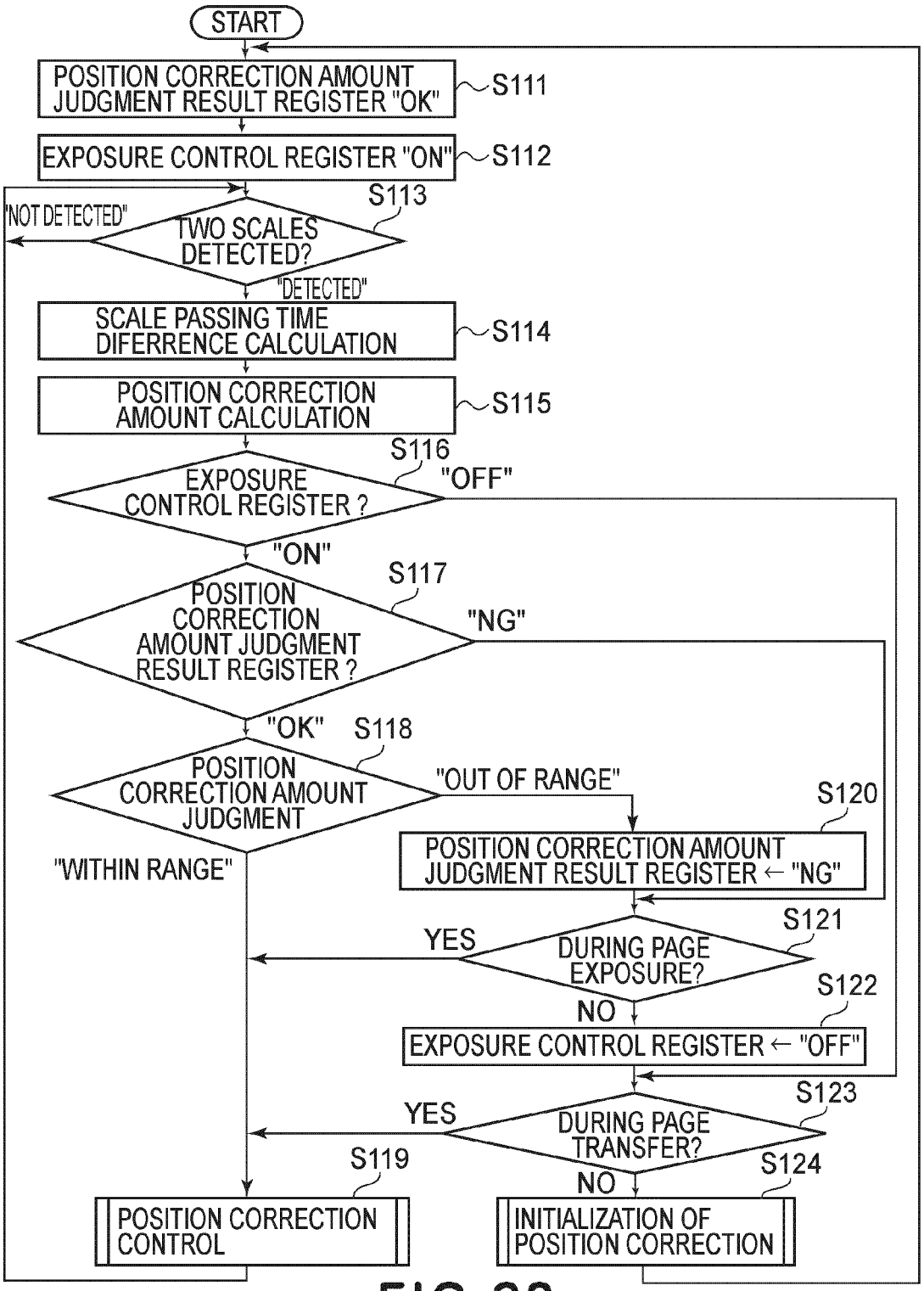
FIG. 38 is a flow chart of the control in Embodiment 10.
Figure 39:
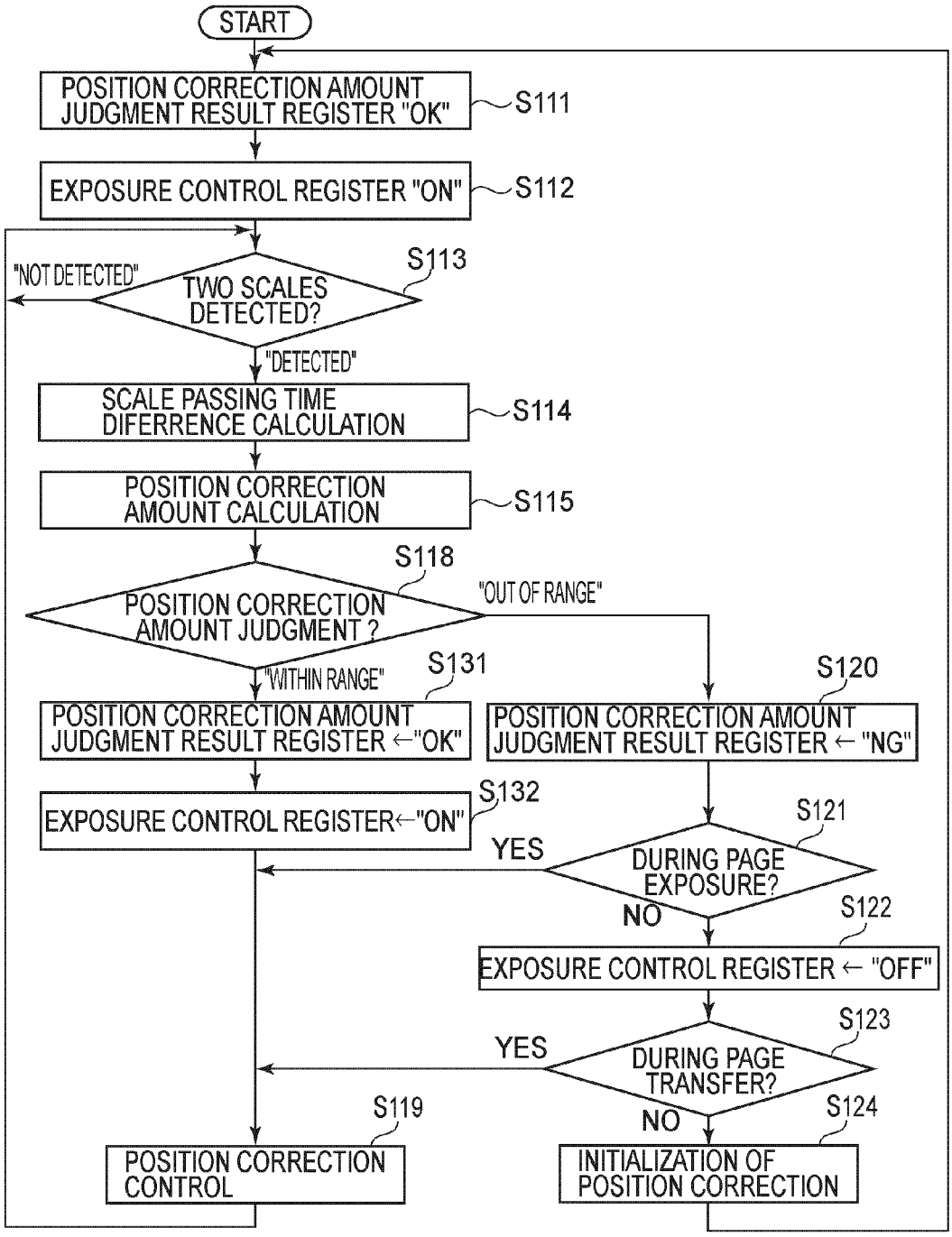
FIG. 39 is a flow chart of another control in Embodiment 10.

FIG. 36 is a schematic view for illustrating a second image bearing member moving mechanism used in control in Embodiment 10, FIG. 37 is a time chart of the control in Embodiment 10, FIG. 38 is a flow chart of the control in Embodiment 10, and FIG. 39 is a flow chart of another control.

In Embodiment 10, similarly as in Embodiment 9, the second position index is positioned on the conveying member position index by moving the second image bearing member in the conveying member movement direction. Therefore, in FIG. 36, constituent members common to FIG. 32 are represented by common reference numerals or symbols, thus being omitted from redundant explanation.

In Embodiment 10, continuous image formation is carried out at a short interval so long as the position correction amount is out of a predetermined range but when the position correction amount is deviated from the predetermined range, an adjusting amount of the adjusting means (adjusting device) is set to an initial value again.

As shown in FIG. 36, a position correction control portion 118 compares an estimated position (a distance from a home position) after the position correction obtained by adding a position correction amount to the position before the position correction with a preset tolerable range of ±120 μm. In the case where the estimated position after position correction (deviation amount) exceeds +120 μm or is below ±120 μm, the position correction is initialized after subsequent image formation is placed in a stand-by state with an interval of about 140 mm by controlling the exposure device 3M. That is, an initializing operation is performed in the case where an absolute value of the deviation amount exceeds a predetermined value (120 μm in this case). Alternatively, in the case where the deviation amount is out of a predetermined range, the initializing operation is performed. As a result, the interval between images is longer than the distance from the exposure position to the transfer position, so that the position correction initialization does not affect the resultant image.

The initializing operation refers to movement of the photosensitive drum 1M to the home position after the scanning lines changed in irradiation position of the laser beam LM by the control are completely primary-transferred from the photosensitive drum 1M. Herein, the home position refers to an initial position of the photosensitive drum 1M, which has been determined in advance, with respect to a conveyance direction of the intermediary transfer belt 9. The initializing operation is controlled by the position correction control portion 118 (initializing portion).

As shown in FIG. 37 with reference to FIG. 36, the exposure device 3M continuously writes an image with an interval of a distance L2. A recording signal is a signal indicating writing of a page (image) and a transfer signal is a signal indicating transfer of the page (image).

The position correction control portion 118 awaits completion of writing of a second page when the estimated position is below a judgment lower-limit value at a time T1 and executes waiting of the photosensitive drum 1M with a distance L3 longer than the distance from the exposure position to the transfer position. Then, the photosensitive drum 1M is moved to the home position (the estimated position after the position correction=0).

That is, when the writing (exposure) of the first page is started, the primary transfer is started after lapse of a time L1. The time L1 is a time until the exposure position of the photosensitive drum 1M reaches the primary transfer portion TM.

With respect to the first page, the maximum of the estimated position after the position correction is within the range of ±120 μm, so that recording of the second page is carried out with the time L2 shorter than the time L1. However, at the time T1 during the primary transfer for the second page, the estimated position after the position correction is below −120 μm, so that the position correction is initialized at a time T2 at which the primary transfer for the second page is completed and thereafter recording of a third page is started (resumed) from a time T3.

In this case, a relationship between the time L1 and a time L3 between the second page and the third page is set as follows:

$$L3>L1.$$

As shown in FIG. 38 with reference to FIG. 36, the position correction control portion 118 initially sets "OK in a position correction amount judgment result register during recording start (S111) and initially sets "ON" in an exposure control register so as to start exposure by the exposure device 3M (S112).

The position correction control portion 118 calculates a time difference of passing timing (S114) when the conveying member position index 251 and the second position index 222 are detected (S113) and calculates a position correction amount from the time difference (S115).

The position correction control portion 118 compares an estimated position after the position correction on the basis of the position correction amount with a range of judgment value (S118) and executes position correction control described in Embodiment 9 (S119) when the estimated position is within the range ("WITHIN RANGE" of S118).

The position correction control portion 118 controls the exposure device 3M when the estimated position after the position correction is within the range of the judgment value (exposure control register "ON") so as to continuously write an image with an interval of the short distance (L2: FIG. 37).

The position correction control portion 118 sets "NG" in the position correction amount judgment result register (S120) when the estimated position after the position correction is increased and deviated from the judgment value range ("OUT OF RANGE" of S118). Then, the exposure device 3M is stopped (S122) after completion of the image writing ("NO" of S121). This is because when the writing is immediately stopped during the image formation, the image is interrupted at the stopped portion.

The position correction control portion 118 sets "OFF" in the exposure control register (S122) when the page is not during exposure ("NO" of S121), thus preventing exposure of a subsequent page (image).

The position correction control portion 118 awaits completion of primary transfer of the image formed on the photosensitive drum 1M (S123) and then executes an initializing operation of the position correction (S124). This is because when the position correction is immediately initialized during the image formation, image deterioration at an interrupted portion cannot be obviated. The initializing operation is performed in a state in which a subsequent image forming operation is placed in a stand-by state.

The position correction control portion resumes recording of a subsequent page after the position correction initialization is completed (from S111).

The position correction device 94 performs the position correction of the photosensitive drum 1M in accordance with the position correction amount sent from the position correction control portion 118 to superpose the second position index 222 on the conveying member 251 passing through the primary transfer portion TM.

However, in the position correction initialization (S124), the position correction device 94 is controlled to move the photosensitive drum supporting member 93, thus returning the photosensitive drum 1M to the home position.

By repeating the above-described process, image formation on a necessary number of sheets is completed.

Incidentally, the control of the flow chart shown in FIG. 38 always initializes the position correction after the transfer of an associated page (image) is completed when once a judgment result of the estimated position after the position correction is out of range.

However, the recording of the subsequent page (image) may also be started in the case where the estimated position after the position correction is returned within the range before the transfer of the associated page (image) is completed. A flow chart of such control is shown in FIG. 39. In FIG. 39, steps common to FIG. 38 are represented by common reference symbols, thus being omitted from redundant explanation.

As shown in FIG. 39 with reference to FIG. 36, the position correction control portion 118 calculates the position correction amount (S115) when the conveying member position index 251 and the second position index 222 and detected ("DETECTED" of S113).

The position correction control portion 118 judges whether or not the estimated position after the position correction on the basis of the position correction amount even in a period during the page exposure ("YES" of S121) or a period during the page transfer ("YES" of S123). Then, when the estimated position after the position correction returned within the range ("WITHIN RANGE" of S118), the position correction amount judgment result register is returned to "OK" (S131) and thereafter the exposure control register is returned to "OK" (S132) to avoid the position correction initialization (S124). That is, as shown in FIG. 37, the exposure device 3M continuously writes the image with the interval of the short distance L2.

Incidentally, in the step S118, the judgment value when the judgment from "OUT OF RANGE" to "WITHIN RANGE" is made may be identical to that used when the judgment from "WITHIN RANGE" to "OUT OF RANGE" is made. However, by providing a value smaller than the value for the judgment from "WITHIN RANGE" to "OUT OF RANGE" (a value providing a narrower range), it is possible to prevent repetition of "WITHIN RANGE" and "OUT OF RANGE" with respect to the judgment result in a short time.

In Embodiment 10, when the estimated position after the position correction is deviated from the tolerance range, the position correction initialization is performed after completion of the primary transfer of the page and the position correction of the photosensitive drum 1M using the position correction device 94 is continued until the primary transfer of the page is completed. For this reason, an occurrence of such a position correction amount as to exceed a control image controllable by the position correction device 94 during a period within the position correction control portion 118 awaits the completion of the primary transfer of the page is prevented by providing a margin to the judgment value range.

Actually, a speed fluctuation frequency of a mechanical mechanism such as a gear or the like is designed so as not to overlap with a frequency generated by the position correction, so that there is no deviation of the position correction amount from a correctable range in a period from the writing start of one page to the completion of the primary transfer of the page.

Here, a control range in which the position correction device S4 can carry out the position control from the home position is taken as ±200 μm (upper limit=+200 μm; lower limit=−200 μm). Further, with respect to a range of the judgment value, the judgment value used for judgment is taken as ±120 μm (upper limit=+120 μm; lower limit=−120 μm). These numerical values are not position correction amounts for correction at a time but represent estimated positions after the position correction in terms of a distance from the home position after the position correction device 94 corrects the position.

Therefore, the position correction control portion 118 composes the estimated position after the position correction with the judgment upper limit of +120 μm and the judgment lower limit of −120 μm.

As shown in FIG. 37, an increase is estimated position after the position correction within one page is ±80 μm at the maximum. For this reason, in Embodiment 10, the judgment value range is taken as ±120 μm, so that a margin of ±80 μm is provided with respect to the control range of ±200 μm which is a position-controllable range.

For example, in the case where the estimated position after the position correction exceeds the judgment value of +120 μm immediately after the start of exposure for a third page, the estimated position after the position correction does not exceed +200 μm even when the position correction is continued until the primary transfer for the third page is completed.

In this way, by providing the margin to the judgment value with respect to the control range in which the position control can be carried out.

In Embodiment 10, the judgment value is a fixed value but may also be changed to a value close to the upper and lower limits of the control range depending on an elapsed time from the writing start or the transfer start. That is, the judgment value is made variable so that the margin is decreased with time.

For example, the judgment value is changed so that the judgment value is set at ±120 μm (margin=80 μm) in synchronism with the writing start of each page and is changed to ±200 μm (margin=0 μm) at the time of completion of the primary transfer of an associated page. Then, even during the primary transfer of each page, the judgment value is returned to ±120 μm (margin=80 μm) in synchronism with the exposure start of a subsequent page and is then similarly changed.

For this reason, the judgment value is set at 120 μm every writing start of the page. A time L5 from the writing start of the first page to the completion of the primary transfer is determined, so that thereafter the judgment value is changed with elapsed time so as to be 200 μm at the time of the primary transfer completion of an associated page.

Incidentally, also in the case of carrying out the rotational speed control of the photosensitive drum 1M described in Embodiment 1, it is possible to carry out similar control accompanied with initialization of the control.

In this case, the initialization of the speed control refers to that the scanning lines changed in irradiation position of the laser beam LM are completely primary-transferred from the photosensitive drum 1M by the control and then the rotational speed of the photosensitive drum 1M is caused to coincide with the rotational speed of the intermediary transfer belt 9 in the case where the speed fluctuation is zero. That is, the rotational speed of the photosensitive drum 1M is changed to an initial value determined in advance.

Then, a speed difference of the rotational speed from a default speed of a rotational speed after the speed correction obtained by adding a speed correction amount to the speed before the speed correction is taken as an estimated speed and then may be compared with a judgment upper limit and a judgment lower limit which have the default speed (initial value) as a center.

Then, in the case where the estimated speed after the speed correction, the writing is interrupted and the correction of the speed control is initialized after the completion of the primary transfer.

As a result, it is possible to realize efficient continuous image formation with a large number of output sheets per unit time while retaining a short interval between images by carrying out the initialization of the speed control only in the case where the estimated speed after the speed correction exceeds the tolerable range. When the initialization is not performed, image formation is continuously carried out at the short interval, so that a lowering in the number of output sheets of the image does not occur substantially. In this way, it is possible to realize high image quality by reducing the color deviation while minimizing the lowering in the number of output sheets per unit time.

Embodiment 11

Figure 40:
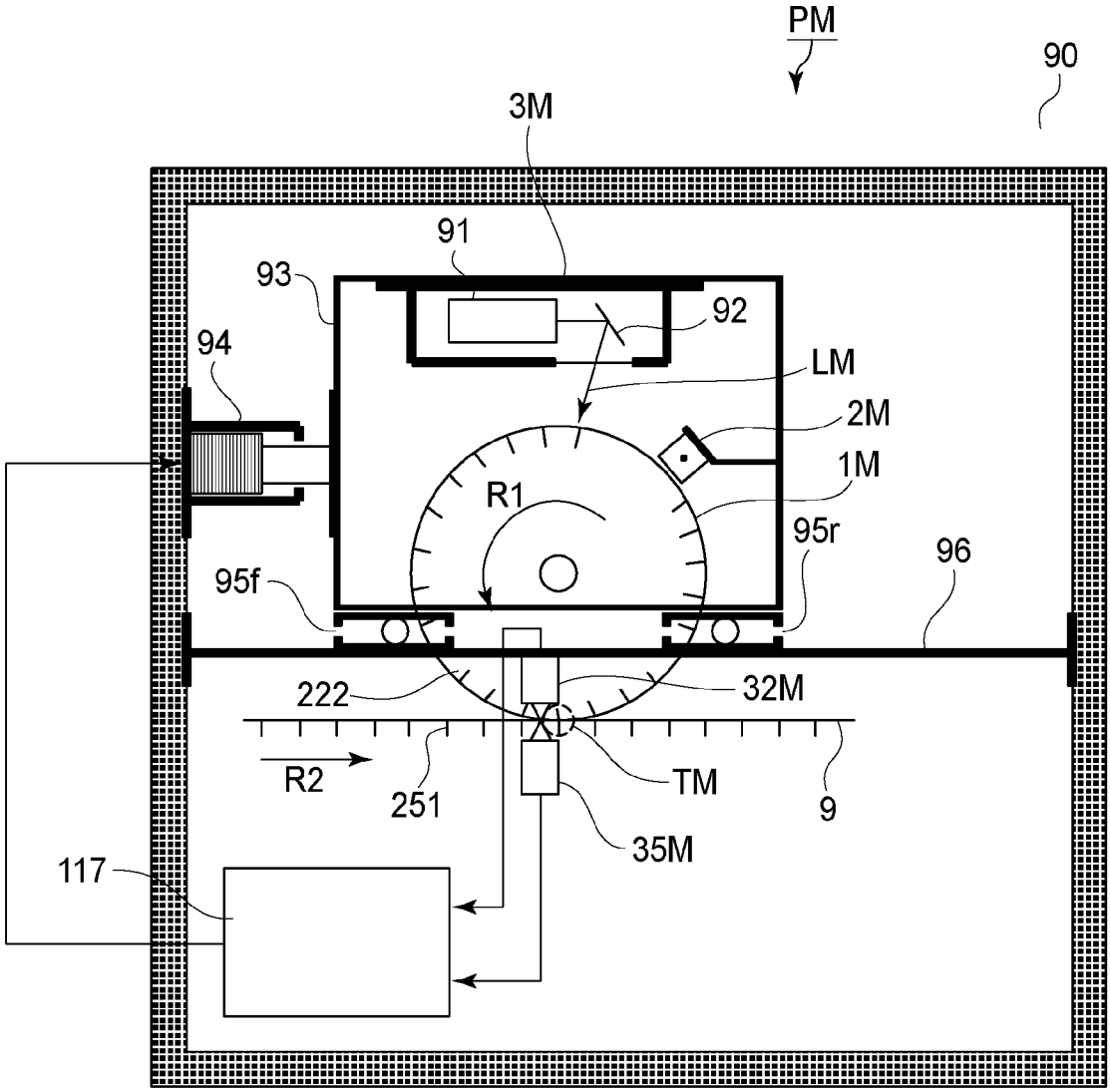
FIG. 40 is a schematic view for illustrating a constitution of a magenta image forming portion in Embodiment 11.
Figure 41:
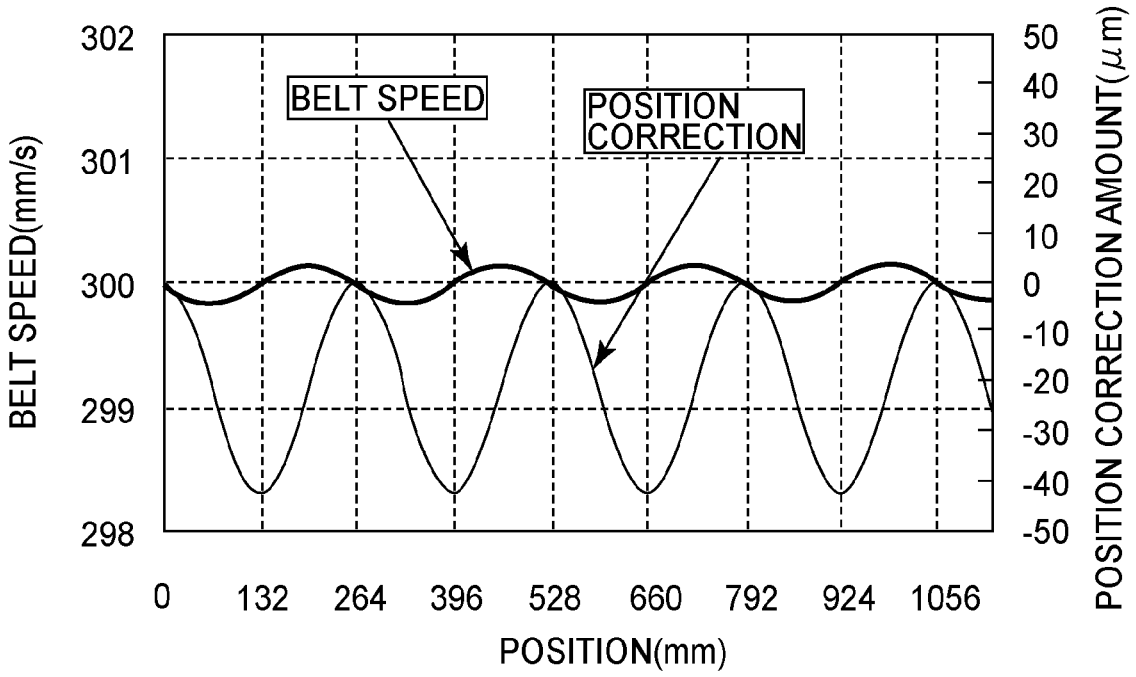
FIG. 41 is a graph for illustrating an effect of fixing an exposure device to a photosensitive member supporting member.

FIG. 40 is a schematic view for illustrating a constitution of a magenta image forming station in Embodiment 11 and FIG. 41 is a graph for illustrating an effect of fixing an exposure device to a photosensitive drum supporting member.

In Embodiment 11, similarly as in Embodiment 9, the third image bearing member is moved in the movement direction of the conveying member to position the second position index on the conveying member position index. Therefore, in FIG. 40, constitutional members common to FIG. 32 are represented by common reference numerals or symbols, thus being omitted from explanation.

As shown in FIG. 40, in Embodiment 11, the electrostatic image 3M is fixed to the photosensitive drum supporting member 93 so as to be integrally moved with the photosensitive drum supporting member 93, so that possible deviation of the exposure scanning position, due to the position correction, which occurs in the constitution of FIG. 32 is eliminated.

As shown in FIG. 32, in Embodiment 9, the exposure device 3M is fixed to the apparatus housing 90. For this reason, even when the position correction device 94 moves the photosensitive drum 1M through the photosensitive drum supporting member 93, a positional relationship between the photosensitive drum 1M and the exposure device 3M is not changed at all.

In the case where the exposure device 3M and the photosensitive drum 1M are integrally moved, in order to eliminate the influence of vibration during the movement, the photosensitive drum supporting member 93 is formed robustly and has a heavy weight compared with that in Embodiment 9. In the case where such a heavy photosensitive drum supporting member 93 is subjected to movement control so as to be moved by a minute distance with accuracy of micron/submicron, a piezoelectric actuator is suitable as the position correction device 94. The piezoelectric actuator which is a linear actuator utilizing a piezoelectric effect has a small amount of maximum movement but is characterized by a large load-carrying capacity and minute distance position control.

The amount of color deviation to be solved by the constitution of Embodiment 9 is 200 μm or less, so that the position correction amount required for the position correction device 94 is also 200 μm or less. For this reason, there is no problem with respect to the maximum movement amount which is a weak point of the piezoelectric actuator.

In FIG. 40, a single piezoelectric actuator is used but two piezoelectric actuators may be disposed oppositely to each other so as to ensure high-accuracy movement control in both directions. Depending on the movement direction, the two piezoelectric actuators are used in a switching manner or used simultaneously, so that minute and high-accuracy movement control can be carried out.

As described above, by employing the piezoelectric actuator as the position correction device 94, it is possible to effect the position correction of the photosensitive drum 1M and the heavy photosensitive drum supporting member 93 to which the exposure device 3M is fixed.

By fixing the positional relationship between the photosensitive drum 1M and the exposure device 3M, a density of scanning lines on the photosensitive drum 1M with respect to the sub-scanning direction is not changed by the position correction, so that the writing is always performed at regular intervals.

As shown in FIG. 41, in Embodiment 11, it is possible to eliminate oscillation of the position correction amount irrespective of a frequency of speed fluctuation of the intermediary transfer belt 9. FIG. 41 is a simulation result of the position correction amount under the same condition as that in FIG. 34. Even when the intermediary transfer belt 9 causes the speed fluctuation, it is confirmed that oscillation dispersion of the position correction amount does not occur.

Embodiment 12

Figure 42:
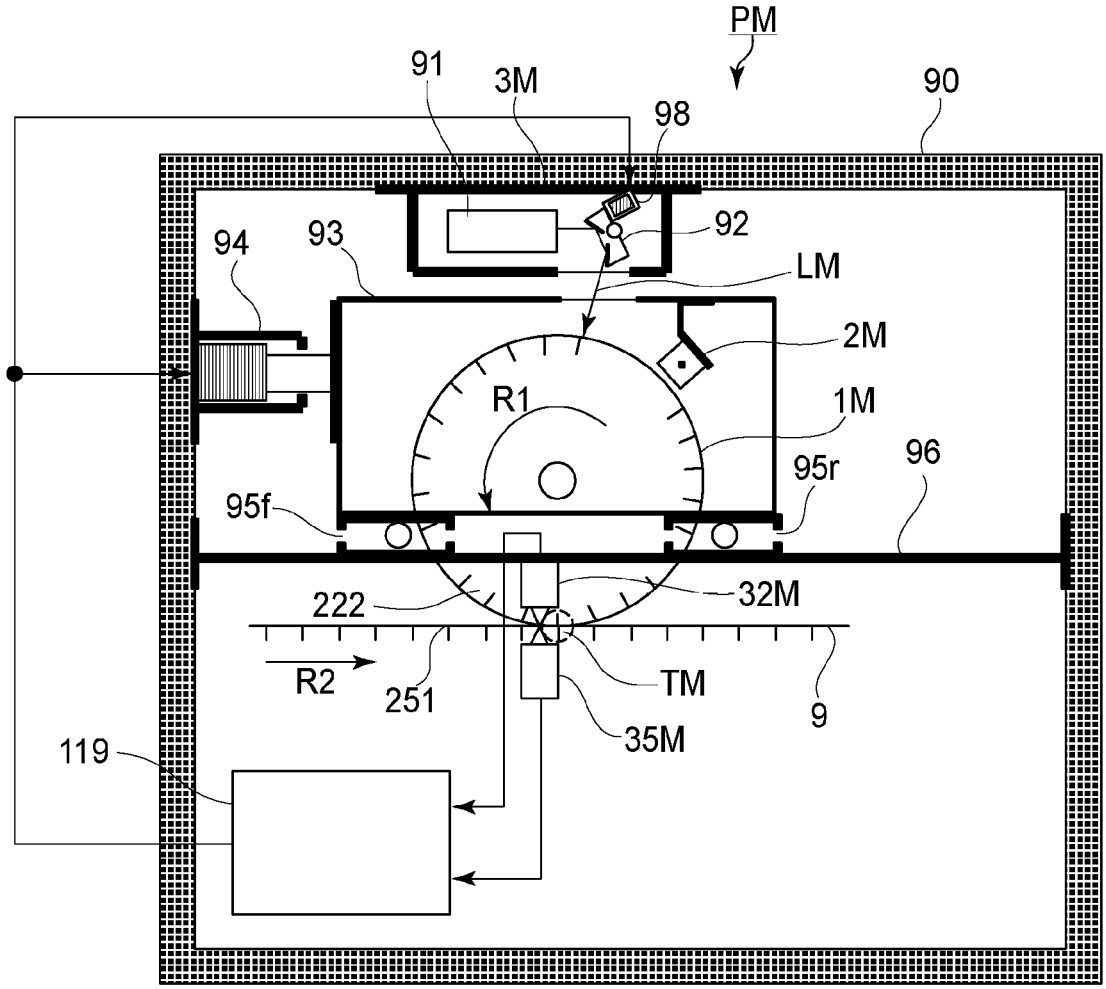
FIG. 42 is a schematic view for illustrating a constitution of a magenta image forming portion in Embodiment 12.

FIG. 42 is a schematic view for illustrating a constitution of a magenta image forming station in Embodiment 12.

In Embodiment 12, similarly as in Embodiment 9, the second image bearing member is moved in the movement direction of the conveying member to position the second position index on the conveying member position index. Therefore, constituent members common to FIG. 32 are represented by common reference numerals or symbols, thus being omitted from redundant explanation.

In Embodiment 1, the exposure device 3M is fixed to the photosensitive drum supporting member 93M to be integrally moved with the photosensitive drum 1M, so that the influence of the position correction on the interval of the scanning lines (exposure density) written on the photosensitive drum 1M is eliminated.

As shown in FIG. 42, in Embodiment 12, by changing an angle (attitude) of the folding mirror (reflection member) 92 in synchronism with the position correction operation of the photosensitive drum 1M, possible deviation of the exposure scanning position, due to the position correction, which occurs in the constitution of FIG. 32 is eliminated.

The folding mirror 92 reflects the laser beam LM by two mirrors provided with reflection surfaces of which extension lines intersect at a center of a rotation shaft of the folding mirror 92, thus permitting scanning exposure of a position on the photosensitive drum 1M equal to that in the case of the folding mirror 92 shown in FIG. 32.

The folding mirror 92 in this embodiment as the example of the writing position moving means is supported so that the inclination angle is adjustable with the rotation shaft as the center by fixing a positional relationship between the two mirrors. For this reason, when the inclination angle of the folding mirror 92 is changed, the exposure scanning position can be moved while an optical path length of the laser beam LM is kept at a constant level (i.e., a focus state is not changed).

A mirror angle correcting device (reflecting member moving device) 98 changes the inclination angle (attitude) of the folding mirror 92 by carrying out minute angle control with high accuracy by using a piezoelectric actuator or the like using the piezoelectric effect.

A position correction control portion 119 controls the mirror angle correcting device 98 to adjust the inclination angle of the folding mirror 92 so as to cancel the movement amount of the scanning line writing position on the photosensitive drum 1M by the position correction of the photosensitive drum 1M. That is, the attitude of the reflecting member is changed so as to follow the movement of the photosensitive drum 1M. As a result, the scanning line forming interval is brought close to a regular interval pitch.

That is, the inclination angle of the folding mirror 92 is corrected so that the scanning exposure position of the laser beam LM on the photosensitive drum 1M is not moved even when the position correction device 94 moves the photosensitive drum 1M.

In Embodiment 12, there is no need to integrally move the exposure device 3M and the photosensitive drum 1M. Therefore, a driving weight of the position correction device 94 including the photosensitive drum supporting member 93 is reduced, so that it is possible to carry out the position correction with high responsivity while oscillation dispersion of the position correction is obviated.

Embodiment 13

Figure 49:
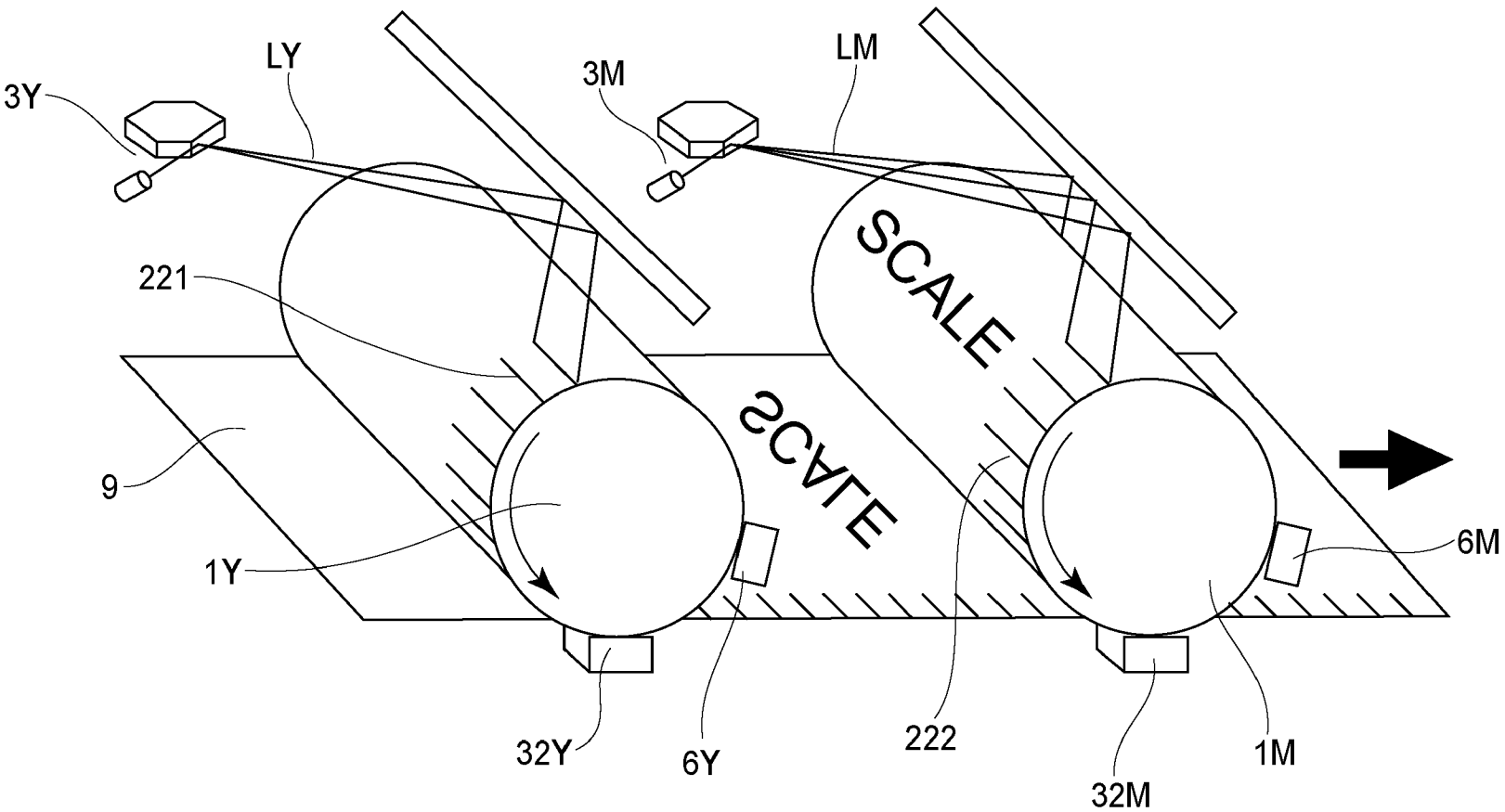
FIG. 49 is a schematic view for illustrating a constitution used in control in Embodiment 13.

FIG. 49 is a schematic view for illustrating a method of writing the first position index and the second position index by laser beam scanning exposure.

In Embodiment 1, the magnetic recording layer EY (EM) is formed on the photosensitive drum 1Y (1M) and the first position index 221 (the second position index 222) is recorded in the magnetic recording layer EY (EM).

In Embodiment 3, by using the exposure device 3Y (3M) and the developing device 4Y (4M), the first position index 221 (the second position index 222) for the toner image is written outside the image area on the surface of the photosensitive drum 1Y (1M).

In Embodiment 13, by using the exposure device 3Y (3M), the first position index 221 (the second position index 222) for the electrostatic image is written outside the image area on the surface of the photosensitive drum 1Y (1M).

In Embodiment 13, other constitutions are basically identical to those in Embodiment 1, thus being omitted from illustration and redundant explanation.

As shown in FIG. 49, the laser beam LY emitted from an optical source of the exposure device 3Y reaches the surface of the photosensitive drum 1Y through scanning by a rotatable mirror, thus drawing scanning lines of an electrostatic image for the yellow image. At the same time, the laser beam LM writes an electrostatic image for the first position index 221 as an end portion of the scanning lines outside the image forming area.

The first position index 221 is written on the surface of the photosensitive drum 1Y (1M) by using the light and is recorded as a difference in surface potential.

In order to read such a first position index 221 recorded as the surface potential difference, as the reader 32Y (32M), a surface potential sensor or an applied device thereof is used.

As such a sensor, e.g., a sensor disclosed in JP-A Hei 11-183542 can be used.

Also in this case, it is possible to use the method in which the information written with the pitch of about 100 μm is read and then this position information is divided by the signal processing. In order to read the 100 μm-pitch information formed in the first position index 221, it is desirable that a conductor of a detecting probe of the reader 32Y (32M) has a diameter of 100 μm or less.

Incidentally, the recording of the conveying member position index 251 on the intermediary transfer belt 9 is carried out in the same manner as in Embodiment 1. The writing device (34: FIG. 2) records the conveying member position index (251: FIG. 5) in the magnetic recording layer (E9: FIG. 5) of the intermediary transfer belt 9 every detection of the first position index 221 correspondingly to the scanning line.

As another method, toner is attached to the electrostatic image by the developing device (4Y, 4M: FIG. 2) to convert the electrostatic image into visible information corresponding to the surface potential difference and then the visible information can be optically read.

Second Embodiment

Figure 47:
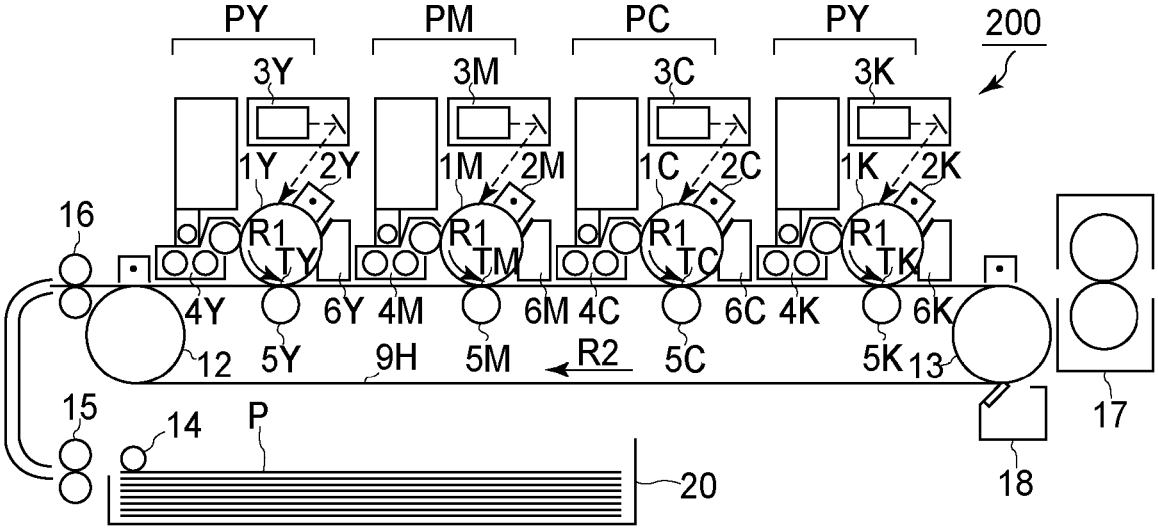
FIG. 47 is a schematic view for illustrating a constitution of an image forming apparatus of Second Embodiment.

FIG. 47 is a schematic view for illustrating a constitution of an image forming apparatus in Second Embodiment.

The constitution of Second Embodiment is identical to that of First Embodiment except that the intermediary transfer member is replaced with a recording material conveying member. Therefore, in FIG. 47, constituent members common to First Embodiment are represented by common reference numerals or symbols, thus being omitted from redundant explanation.

As shown in FIG. 47, an image forming apparatus 200 of Second Embodiment is a full-color laser beam printer in which image forming stations PY, PM, PC and PK for yellow, cyan, magenta and black are disposed along a recording material conveying belt 9H.

At the image forming station PY, a yellow toner image is formed on a photosensitive drum 1Y and is primary-transferred onto a recording material P carried on the recording material conveying belt 9H. At the image forming station PM, a magenta toner image is formed on a photosensitive drum 1M and is primary-transferred onto the recording material P by being superposed on the yellow toner image. At image forming stations PC and PK, a cyan toner image and a black toner image are formed on a photosensitive drum 1C and a photosensitive drum 1K, respectively, and are similarly transferred onto the recording material P in a superposition manner.

The recording material conveying belt 9H as an example of the conveying member is extended around and supported by a driving roller 13 and a tension roller 12 and is rotated in a direction of an arrow R2.

The recording material P is drawn from a sheet feeding cassette 20 by a sheet feeding roller 14 and separated one by one by a separating device 15 to be delivered to the recording material conveying belt 9H through registration rollers 16. The recording material P electrostatically carried on the recording material conveying belt 9H is electrostatically separated from the recording material P after the four color toner images are secondary-transferred onto the recording material P.

The recording material P onto which the four color toner images are secondary-transferred is delivered to a fixing device 17 and is subjected to heat pressing, so that a full-color image is fixed on a surface of the recording material P.

Also in the image forming apparatus using such a recording material conveying member, it is possible to carry out the constitutions and control of Embodiments 1 to 12.

The conveying member position index is formed on the recording material conveying belt 9H and the photosensitive drums 1M, 1C and 1K are controlled so that the second position index formed on the photosensitive drum 1M is superposed on the conveying member position index at the primary transfer portions TM, TC and TK, respectively.

Third Embodiment

Figure 48:
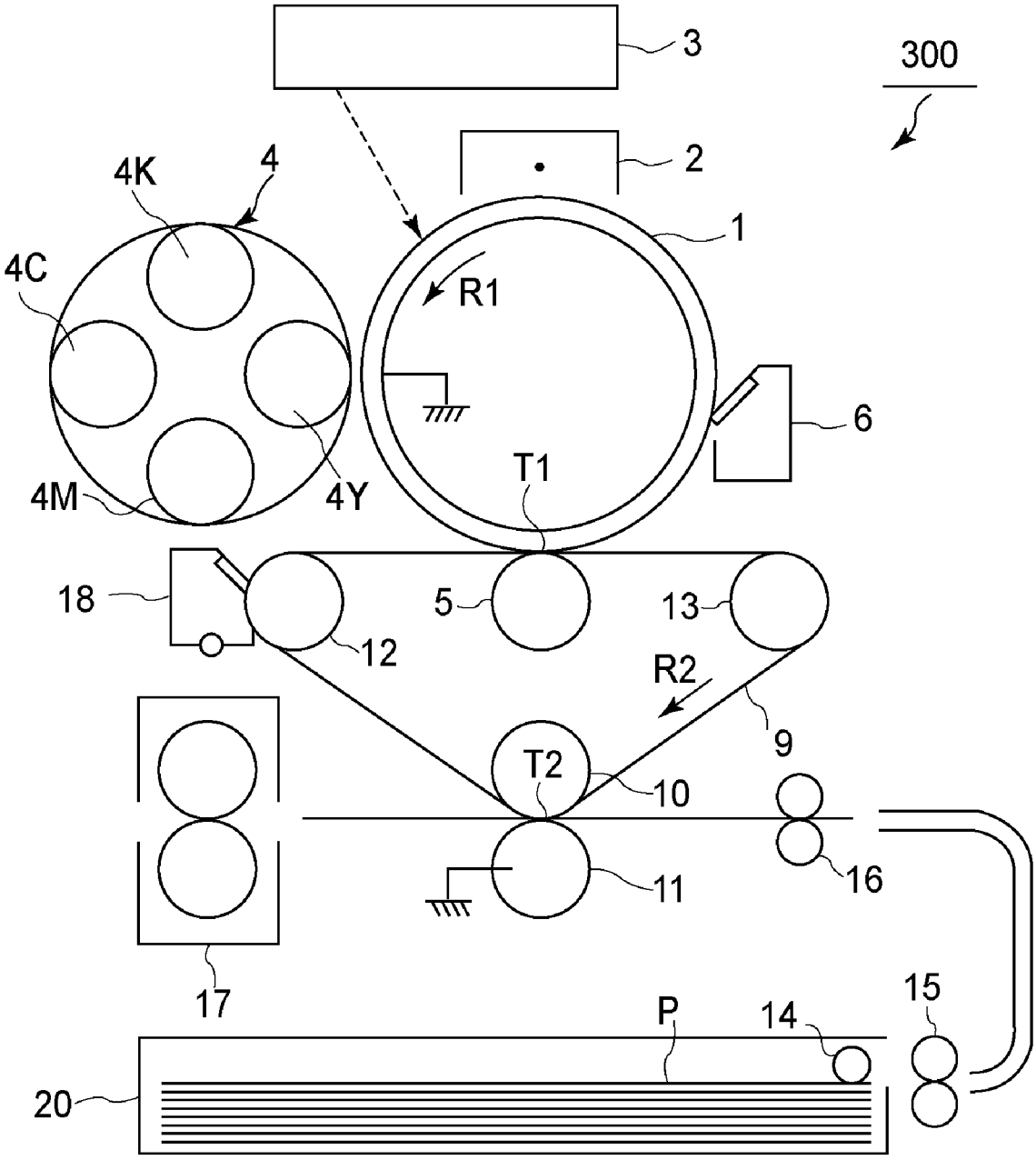
FIG. 48 is a schematic view for illustrating a constitution of an image forming apparatus of Third Embodiment.

FIG. 48 is a schematic view for illustrating a constitution of an image forming apparatus in Third Embodiment.

The constitution of Second Embodiment is identical to that of First Embodiment except that a single image bearing member is disposed along a conveying member. Therefore, in FIG. 47, constituent members common to First Embodiment are represented by common reference numerals or symbols, thus being omitted from redundant explanation.

As shown in FIG. 48, an image forming apparatus 300 in Third Embodiment is a one-drum type full-color printer in which a single photosensitive drum 1 capable of forming a plurality of color toner images is disposed along the intermediary transfer belt 9. A rotary developing device 4 is capable of forming the plurality of color toner images by moving developing devices 4Y, 4M, 4C and 4K for yellow, magenta, cyan and black toward the photosensitive drum 1.

The exposure device 3 as the example of the electrostatic image forming means writes the electrostatic image on the photosensitive drum 1.

On the photosensitive drum 1 for first rotation, the yellow toner image is formed by using yellow toner as an example of the first color toner and then is primary-transferred onto the intermediary transfer belt 9.

The magenta toner image is formed on the photosensitive drum 1 for second rotation by using magenta toner as an example of the second color toner and then is primary-transferred onto the intermediary transfer belt 9 by being superposed on the yellow toner image.

The cyan toner image is formed on the photosensitive drum 1 for third rotation by using cyan toner as an example of the third color toner and then is primary-transferred onto the intermediary transfer belt 9 by being superposed on the magenta toner image.

The black toner image is formed on the photosensitive drum 1 for fourth rotation by using black toner as an example of the fourth color toner and then is primary-transferred onto the intermediary transfer belt 9 by being superposed on the cyan toner image.

The intermediary transfer belt 9 as an example of the conveying member is extended around and supported by a driving roller 13, a tension roller 12 and a back-up roller 10 and is rotated in a direction of an arrow R2.

The four color toner images carried on the intermediary transfer belt 9 are conveyed to a secondary transfer portion T2, at which the toner images are secondary-transferred collectively onto a recording material P. The recording material P is drawn from a sheet feeding cassette 20 by a sheet feeding roller 14 and separated one by one by a separating device 15 to be fed to registration rollers 16.

The registration rollers 16 feeds the recording material P to the secondary transfer portion T2 so that a leading end of the recording material P coincides with the toner images on the intermediary transfer belt 9.

The recording material P onto which the four color toner images are secondary-transferred is delivered to a fixing device 17 and is subjected to heat pressing, so that a full-color image is fixed on a surface of the recording material P.

Also in such a one-drum type image forming apparatus, it is possible to carry out the constitutions and control of Embodiments 1 to 12.

The conveying member position index is formed on the intermediary transfer belt 9 and the position index formed on the photosensitive drum 1 is detected by the position index detecting means. Then, the photosensitive drum 1 is controlled so that the position index is superposed on the conveying member position index at the primary transfer portion T1.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 292017/2007 filed Nov. 9, 2007, and 236582/2008 filed Sep. 16, 2008, which is hereby incorporated by reference.

What is claimed is:

1. An image forming apparatus comprising:

a first image bearing member on which a toner image is to be formed;

a second image bearing member on which a toner image is to be formed;

a conveying member for carrying and conveying the toner images;

a first transferring device for transferring the toner image on said first image bearing member onto said conveying member at a first transfer portion;

a second transferring device for transferring the toner image on said second image bearing member onto said conveying member at a second transfer portion located downstream of the first transfer portion with respect to a movement direction of said conveying member;

a conveying member position index provided on said conveying member along the movement direction of said conveying member;

image bearing member position indices successively formed on said second image bearing member along a rotational direction of said second image bearing member;

a conveying member position index detecting device for detecting said conveying member position index;

an image bearing member position index detecting device for detecting said image bearing member position indices;

an adjusting device for adjusting a rotational speed of said second image bearing member or a position of said second image bearing member with respect to the movement direction of said conveying member;

a controller for controlling said adjusting device so as to adjust a position of an image bearing member position index correspondingly to said conveying member position index which is going to reach the second transfer portion, on the basis of detection results of said conveying member position index detecting device and said image bearing member position index detecting device; and an initializing portion for performing an initializing operation of said adjusting device when an amount of deviation between said conveying member position index and the corresponding image bearing member position index is out of a predetermined range.

2. An apparatus according to claim 1, wherein the initializing operation includes an operation for setting an amount of adjustment of said adjusting device.

3. An apparatus according to claim 1, wherein the initializing operation is performed in a standby state of a subsequent image forming operation.

4. An apparatus according to claim 3, wherein said image forming apparatus further comprises:

an exposure device for exposing said second image bearing member to light to form an electrostatic image; and a developing device for developing the electrostatic image with toner to form a toner image, wherein the initializing operation is performed when an operation of said exposure device is not performed.

5. An image forming apparatus comprising:

a first image bearing member on which a toner image is to be formed;

a second image bearing member on which a toner image formed by developing an electrostatic image formed by an exposure device with toner is to be borne;

a conveying member for carrying and conveying the toner images;

a first transferring device for transferring the toner image on said first image bearing member onto said conveying member at a first transfer portion;

a second transferring device for transferring the toner image on said second image bearing member onto said conveying member at a second transfer portion located downstream of the first transfer portion with respect to a movement direction of said conveying member;

a conveying member position index provided on said conveying member along the movement direction of said conveying member;

image bearing member position indices successively formed on said second image bearing member along a rotational direction of said second image bearing member;

a conveying member position index detecting device for detecting said conveying member position index;

an image bearing member position index detecting device for detecting said image bearing member position indices;

an adjusting device for adjusting a position of said second image bearing member with respect to the movement direction of said conveying member;

a controller for controlling said adjusting device so as to adjust a position of an image bearing member position index correspondingly to said conveying member position index which is going to reach the second transfer portion, on the basis of detection results of said conveying member position index detecting device and said image bearing member position index detecting device; and a supporting member for supporting said second image bearing member and the exposure device so that said second image bearing member and the exposure device are integrally moved.

6. An image forming apparatus comprising:

a first image bearing member on which a toner image is to be formed;

a first exposure device provided with a reflecting member for reflecting laser light;

a second image bearing member on which a toner image formed by developing an electrostatic image formed by a second exposure device with toner is to be borne;

a conveying member for carrying and conveying the toner images;

a first transferring device for transferring the toner image on said first image bearing member onto said conveying member at a first transfer portion;

a second transferring device for transferring the toner image on said second image bearing member onto said conveying member at a second transfer portion located downstream of the first transfer portion with respect to a movement direction of said conveying member;

a conveying member position index provided on said conveying member along the movement direction of said conveying member;

image bearing member position indices successively formed on said second image bearing member along a rotational direction of said second image bearing member;

a conveying member position index detecting device for detecting said conveying member position index;

an image bearing member position index detecting device for detecting said image bearing member position indices;

an adjusting device for adjusting a position of said second image bearing member with respect to the movement direction of said conveying member;

a controller for controlling said adjusting device so as to adjust a position of an image bearing member position index correspondingly to said conveying member position index which is going to reach the second transfer portion, on the basis of detection results of said conveying member position index detecting device and said image bearing member position index detecting device; and a reflecting member moving device for changing an attitude so that an exposure position of said first exposure device follows said second image bearing member when said second image bearing member is adjusted by said adjusting device.

7. An image forming apparatus comprising:

a first image bearing member on which a toner image is to be formed;

a second image bearing member on which a toner image is to be formed;

a conveying member for carrying and conveying the toner images;

a first transferring device for transferring the toner image on said first image bearing member onto said conveying member at a first transfer portion;

a second transferring device for transferring the toner image on said second image bearing member onto said conveying member at a second transfer portion located downstream of the first transfer portion with respect to a movement direction of said conveying member;

a conveying member position index fixedly disposed on said conveying member along the movement direction of said conveying member;

image bearing member position indices fixedly disposed on said second image bearing member along a rotational direction of said second image bearing member;

a conveying member position index detecting device for detecting said conveying member position index;

an image bearing member position index detecting device for detecting said image bearing member position indices;

an adjusting device for adjusting a rotational speed of said second image bearing member; and a controller for controlling said adjusting device so as to adjust a position of an image bearing member position index correspondingly to said conveying member position index which is going to reach the second transfer portion, on the basis of detection results of said conveying member position index detecting device and said image bearing member position index detecting device.

8. An apparatus according to claim 7, wherein said controller controls a different pair of a conveying member position index and an image bearing member position index when at least the conveying member position index of a pair of the conveying member position index and the corresponding image bearing member position index which are to be controlled reaches a predetermined position located upstream of the second transfer portion with respect to the movement direction of said conveying member.

9. An apparatus according to claim 7, wherein said controller controls a different pair of a conveying member position index and an image bearing member position index when at least the image bearing member position index of a pair of the conveying member position index and the corresponding image bearing member position index which are to be controlled reaches a predetermined position located upstream of the second transfer portion with respect to the rotational direction of said second image bearing member.

10. An image forming apparatus comprising:

a first image bearing member on which a toner image is to be formed;

a second image bearing member on which a toner image is to be formed;

a conveying member for carrying and conveying the toner images;

a first transferring device for transferring the toner image on said first image bearing member onto said conveying member at a first transfer portion;

a second transferring device for transferring the toner image on said second image bearing member onto said conveying member at a second transfer portion located downstream of the first transfer portion with respect to a movement direction of said conveying member;

a conveying member position index provided on said conveying member along the movement direction of said conveying member;

image bearing member position indices provided on said second image bearing member along a rotational direction of said second image bearing member;

a conveying member position index detecting device for detecting said conveying member position index;

an image bearing member position index detecting device for detecting said image bearing member position indices;

an adjusting device for adjusting a position of said second image bearing member with respect to a rotational axis direction; and a controller for controlling said adjusting device so as to adjust a position of an image bearing member position index correspondingly to said conveying member position index which is going to reach the second transfer portion, on the basis of detection results of said conveying member position index detecting device and said image bearing member position index detecting device.

* * * * *